US012364308B2

(12) United States Patent
Bidal

(10) Patent No.: US 12,364,308 B2
(45) **Date of Patent: *Jul. 22, 2025**

(54) GOLF SHOE WITH REINFORCEMENT STRUCTURE

(71) Applicant: Acushnet Company, Fairhaven, MA (US)

(72) Inventor: Jean-Marie Bidal, Marlborough, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/522,380

(22) Filed: Nov. 29, 2023

(65) Prior Publication Data

US 2024/0090613 A1 Mar. 21, 2024

Related U.S. Application Data

(63) Continuation-in-part of application No. 17/821,996, filed on Aug. 24, 2022, which is a continuation-in-part of application No. 17/686,146, filed on Mar. 3, 2022, now Pat. No. 11,986,048.

(51) Int. Cl.
*A43B 5/00* (2022.01)
*A43B 13/12* (2006.01)

(52) U.S. Cl.
CPC ..... *A43B 5/001* (2013.01); *A43B 13/122* (2013.01); *A43B 13/127* (2013.01)

(58) Field of Classification Search
CPC ... A43B 13/122; A43B 13/127; A43B 13/026; A43B 5/001; A43B 7/1495; A43B 7/18
See application file for complete search history.

(56) References Cited

U.S. PATENT DOCUMENTS

| | | | | | |
|---|---|---|---|---|---|
| 892,152 | A * | 6/1908 | Harman | A43B 7/32 | 36/108 |
| 2,464,023 | A | 3/1949 | Carson | | |
| 4,268,981 | A * | 5/1981 | Olivieri | A43B 5/1666 | 36/115 |
| 4,947,560 | A * | 8/1990 | Fuerst | A43B 23/08 | 36/114 |
| 5,692,319 | A * | 12/1997 | Parker | A43C 1/00 | 36/114 |
| 5,832,634 | A * | 11/1998 | Wong | A43B 13/026 | 36/31 |
| 5,845,420 | A * | 12/1998 | Buccianti | A43B 3/0052 | 36/25 R |
| 6,401,366 | B2 * | 6/2002 | Foxen | A43B 7/1495 | 36/102 |
| 7,685,740 | B2 * | 3/2010 | Sokolowski | A43B 7/142 | 36/77 R |
| 8,074,379 | B2 * | 12/2011 | Robinson, Jr. | A43C 11/008 | 36/108 |
| 8,365,440 | B2 | 2/2013 | Rivas et al. | | |

(Continued)

*Primary Examiner* — Bao-Thieu L Nguyen

(57) ABSTRACT

A golf shoe with an upper and a sole assembly connected to the upper. The sole assembly comprises a reinforcement structure integrated with a midsole component and/or an outsole component of the shoe. The reinforcement structure may comprise a reinforcing material. The reinforcement structure may hold and support the medial and/or lateral sides of a subject's foot during a golf-related action or movement.

19 Claims, 43 Drawing Sheets

(56) References Cited

U.S. PATENT DOCUMENTS

| | | | | |
|---|---|---|---|---|
| 8,479,415 | B2 * | 7/2013 | Berger | A43C 1/00 36/50.1 |
| 8,850,721 | B2 * | 10/2014 | Long | A43B 7/22 36/107 |
| 9,451,805 | B2 | 9/2016 | Barnes et al. | |
| 9,687,042 | B2 | 6/2017 | Berend et al. | |
| 9,743,709 | B2 * | 8/2017 | Hesterberg | A43B 13/16 |
| 9,788,599 | B2 * | 10/2017 | Hesterberg | A43B 5/001 |
| 9,936,759 | B2 | 4/2018 | Nurse et al. | |
| 10,244,821 | B2 | 4/2019 | Elder et al. | |
| 10,681,957 | B2 * | 6/2020 | Duarte | A43B 7/1495 |
| 11,033,068 | B2 * | 6/2021 | Devoe | A43B 7/1495 |
| 11,452,335 | B2 | 9/2022 | Conrad et al. | |
| 11,638,461 | B2 * | 5/2023 | Hanat | A43B 7/1495 36/30 R |
| 11,986,048 | B2 * | 5/2024 | Bidal | A43B 13/14 |
| 2002/0092207 | A1 * | 7/2002 | Girard | B29D 35/122 36/117.3 |
| 2011/0239486 | A1 * | 10/2011 | Berger | A43B 7/1495 36/25 R |
| 2012/0324761 | A1 * | 12/2012 | Sills | A43B 7/24 12/146 B |
| 2013/0059116 | A1 * | 3/2013 | Peikert | A43B 13/12 36/25 R |
| 2015/0342300 | A1 * | 12/2015 | Cin | A43B 13/127 36/103 |
| 2018/0110285 | A1 * | 4/2018 | Cohen | A43B 7/226 |
| 2020/0282290 | A1 * | 9/2020 | Smirman | A43B 7/1445 |
| 2020/0323309 | A1 * | 10/2020 | Hanat | A43B 13/122 |
| 2021/0186150 | A1 * | 6/2021 | Truelsen | A43B 13/181 |
| 2021/0315320 | A1 * | 10/2021 | Takamasu | A43B 13/187 |
| 2022/0053885 | A1 | 2/2022 | Kuerbis et al. | |

* cited by examiner

Bottom View

MEDIAL VIEW

BOTTOM VIEW

LATERAL VIEW

BOTTOM REAR PERSPECTIVE EXPLODED VIEW

SECTION A1-A2

SECTION A1-A2

GOLF SHOE WITH REINFORCEMENT STRUCTURE

CROSS-REFERENCE TO RELATED APPLICATIONS

This application is a continuation-in-part of U.S. patent application Ser. No. 17/821,996 filed on Aug. 24, 2022, which is a continuation-in-part of U.S. patent application Ser. No. 17/686,146 filed on Mar. 3, 2022, each of which is incorporated herein by reference in its entirety for all purposes.

BACKGROUND

The sport of golf involves a variety of actions that a golfer may perform, such as a golf swing, walking a golf course, crouching down to line-up a putt, and other golfing actions. Having proper equipment when playing the sport of golf may be a factor in how well the golfer may be able to perform these actions. Golf shoes are one example piece of equipment that can affect a golfer's performance. For example, when a golfer swings a club and transfers their weight on their feet, there are high forces placed on the foot. The shoe needs to provide a stable platform for the golfer when he/she makes their swing, but the foot also needs to be able to flex to a certain degree. The bending of the shoe also is important when the golfer is walking, crouching down, and other golfing actions.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe a golf shoe comprising a sidewall reinforcement structure for providing increasing bending stiffness, torsion stiffness, and cushioning of the shoe.

In an example, the technology relates to a golf shoe comprising: an upper; a bending axis passing through a bite line; and a sole assembly connected to the upper, the sole assembly comprising: an outsole; a midsole; and a U-shaped reinforcement structure, the reinforcement structure comprising: a bridge extending a transverse width across the sole assembly, the bridge having centroid positioned a first vertical distance from the bending axis; a lateral wing extending upward from a lateral side of the bridge along a periphery of a lateral sidewall of the sole assembly, the lateral wing having a centroid located a second vertical distance from the bending axis, the second vertical distance being less than the first vertical distance; and a medial wing extending upward from a medial side of the bridge upward along a periphery of a medial sidewall of the sole assembly, the medial wing having a centroid located a third vertical distance from the bending axis, the third vertical distance being less than the first vertical distance.

In another example, the technology relates to a golf shoe comprising: an upper; and a sole assembly connected to the upper, the upper and sole assembly, the sole assembly comprising: an outsole; a midsole comprising a foam material; and a U-shaped reinforcement structure, the reinforcement structure comprising: a bridge extending a transverse width across the sole assembly, the transverse width being at least 60 mm; a lateral wing extending from a lateral side of the bridge upward a first height along a periphery of a lateral sidewall of the sole assembly outside of the foam material of the midsole, the first height being at least 12 mm; and a medial wing extending from a medial side of the bridge upward a second height along a periphery of a medial sidewall of the sole assembly outside of the foam material of the midsole, the second height being at least 12 mm.

In another example, the technology relates to a golf shoe comprising: an upper; a bending axis passing through a bite line; and a sole assembly connected to the upper, the sole assembly comprising: an outsole; a midsole; and a U-shaped reinforcement structure, the reinforcement structure comprising: a bridge extending a transverse width ($x_B$) across the sole assembly, the bridge having: a bridge thickness ($y_B$); and a centroid positioned a first vertical distance ($D_{BC}$) from the bending axis; a lateral wing extending upward from a lateral side of the bridge along a periphery of a lateral sidewall of the sole assembly, the lateral wing having: a lateral-wing thickness ($x_L$); a lateral-wing height ($y_L$); and a centroid located a second vertical distance from the bending axis, the second vertical distance ($D_L$); and a medial wing extending upward from a medial side of the bridge upward along a periphery of a medial sidewall of the sole assembly, the medial wing having: a medial-wing thickness ($x_M$); a medial-wing height ($y_M$); and a centroid located a third vertical distance ($D_M$) from the bending axis, wherein the reinforcement structure has an area moment of inertia about the bending axis between 6,139 $mm^4$ and 21,477 $mm^4$, wherein the area moment of inertia is calculated according to the following equation:

$$I_x = \left[\left(\frac{1}{12}x_B y_B^3\right) + \left(x_B y_B D_{BC}^2\right)\right] + \left[\left(\frac{1}{12}x_M y_M^3\right) + \left(x_M y_M D_M^2\right)\right] + \left[\left(\frac{1}{12}x_L y_L^3\right) + \left(x_L y_L D_L^2\right)\right].$$

In another aspect, the present disclosure provides a golf shoe, comprising an upper and a sole assembly connected to the upper. In some embodiments, the sole assembly comprises a midsole and an outsole. In some embodiments, the midsole comprises (i) a first midsole component extending from a heel region of the sole assembly to a midfoot region of the sole assembly and (ii) a second midsole component extending from a forefoot region of the sole assembly to the midfoot region of the sole assembly. In some embodiments, the first midsole component and the second midsole component have a variable thickness that tapers towards the midfoot region of the sole assembly.

In some embodiments, the golf shoe comprises a reinforcement structure. In some embodiments, the reinforcement structures comprises (i) a lateral side wing that extends upward from a lateral side of the sole assembly and crosses over a lateral side of the upper, (ii) a medial side wing that extends upward from a medial side of the sole assembly and crosses over a medial side of the upper, and (iii) a bridge section that extends between the lateral side wing and the medial side wing.

In some embodiments, the first midsole component has a first thickness at the heel region and a second thickness at the midfoot region. In some embodiments, the second thickness is less than the first thickness. In some embodiments, the second midsole component has a first thickness at the forefoot region and a second thickness at the midfoot region. In some embodiments, the second thickness is less than the first thickness.

In some embodiments, the first midsole component extends to a first location in the midfoot region, and the second midsole component extends to a second location in the midfoot region. In some embodiments, the first location and the second location are offset relative to each other. In some embodiments, the first midsole component and the second midsole component overlap each other. In other embodiments, the first midsole component and the second midsole component may not or need not overlap each other.

In some embodiments, the first midsole component comprises a first end disposed in the heel region and a second end disposed in the midfoot region, and the second midsole component comprises a first end disposed in the forefoot region and a second end disposed in the midfoot region. In some embodiments, the second end of the first midsole component is positioned closer to the forefoot region of the sole assembly than the second end of the second midsole component. In some embodiments, the second end of the second midsole component is positioned closer to the heel region of the sole assembly than the second end of the first midsole component.

In some embodiments, the first midsole component has a top surface that contacts a bottom surface of the reinforcement structure, and the second midsole component has a bottom surface that contacts a top surface of the reinforcement structure. In some embodiments, the top surface of the first midsole component is configured to slope downwards as the first midsole component extends from the heel region towards the midfoot region. In some embodiments, a curvature of the top surface of the first midsole component corresponds to a curvature of the bottom surface of the reinforcement structure. In some embodiments, the bottom surface of the second midsole component is configured to slope upwards as the second midsole component extends from the forefoot region towards the midfoot region. In some embodiments, a curvature of the bottom surface of the second midsole component corresponds to a curvature of the top surface of the reinforcement structure.

In some embodiments, the reinforcement structure is positioned between the first midsole component and the second midsole component. In some embodiments, the reinforcement structure comprises a symmetric wing configuration. In some embodiments, the reinforcement structure comprises an asymmetric wing configuration. In some embodiments, the lateral side wing and the medial side wing include a curved upper edge and a curved lower edge forming a curvilinear distal end of the medial or lateral side wing. In some embodiments, the lateral side wing or the medial side wing extends forward to the forefoot region of the sole assembly. In some embodiments, the lateral side wing or the medial side wing extends rearward to the heel region of the sole assembly. In some embodiments, the lateral side wing extends forward to the forefoot region of the sole assembly, and the medial side wing extends rearward to the heel region of the sole assembly.

In another aspect, the present disclosure provides a golf shoe comprising an upper, a sole assembly connected to the upper, the sole assembly comprising an outsole and a midsole comprising a first midsole region with a first hardness and a second midsole region with a second hardness, and a three-dimensional shank comprising a suspension system and a plurality of supports extending on different sides of the suspension system to support a lateral side and a medial side of the sole assembly. In some embodiments, the suspension system comprises (i) a body portion that is integrally formed with the plurality of supports and (ii) a spring portion that extends underneath the body portion from a first end of the body portion to a second end of the body portion. In some embodiments, the spring portion and the body portion are configured to move vertically relative to each other based on an amount of force exerted on the sole assembly during a golf-related action or movement.

In some embodiments, the suspension system comprises an opening disposed between the spring portion and the body portion. In some embodiments, the opening extends transversely between the plurality of supports positioned on the different sides of the suspension system. In some embodiments, the spring portion and the body portion are configured to move towards each other to decrease a size of the opening when a force exceeding a pre-determined threshold is exerted on the sole assembly. In some embodiments, the spring portion and the body portion are configured to move away from each other to increase the size of the opening when said force is released or reduced.

In some embodiments, the spring portion is visible on or through a bottom surface of the outsole. In some embodiments, the bottom surface of the outsole includes one or more apertures or windows configured to expose the spring portion of the suspension system. In some embodiments, the outsole comprises a rubber-based material and/or a TPU-based material.

In some embodiments, the suspension system further comprises a composite layer extending between the plurality of supports. In some embodiments, the composite layer is configured to extend under the body portion and through an opening disposed between the spring portion and the body portion of the suspension system.

In some embodiments, the plurality of supports comprise one or more supports extending upward along the upper of the golf shoe. In some embodiments, the one or more supports comprise a medial support and/or a lateral support.

In some embodiments, the golf shoe may further comprise a saddle system configured to engage a lace or a cable of the golf shoe. In some embodiments, the saddle system comprises an external saddle system extending from the plurality of supports. In some embodiments, the saddle system comprises an internal saddle extending under an outermost layer of the upper. In some embodiments, the outermost layer of the upper extends between the internal saddle and the plurality of supports.

In some embodiments, the first midsole region extends between a forefoot region and a midfoot region of the sole assembly, and the second midsole region extends between the midfoot region and a rearfoot region of the sole assembly. In some embodiments, the first hardness of the first midsole region is greater than the second hardness of the second midsole region. In some embodiments, the first hardness ranges from about 60 Shore C hardness to about 70 Shore C hardness, and the second hardness ranges from about 45 Shore C hardness to about 55 Shore C hardness.

In some embodiments, the midsole comprises one or more recessed regions on a medial side or a lateral side of the midsole. In some embodiments, the one or more recessed regions are positioned below the plurality of supports.

In some embodiments, the golf shoe may further comprise an EVA cookie. In some embodiments, the EVA cookie may be positioned between the body portion and the spring portion of the suspension system.

In some embodiments, the midsole comprises a split bottom configuration. In some embodiments, the split bottom configuration exposes a portion of the midsole underneath the plurality of supports.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples and embodiments are described with reference to the following figures.

DETAILED DESCRIPTION

Figure 1A:
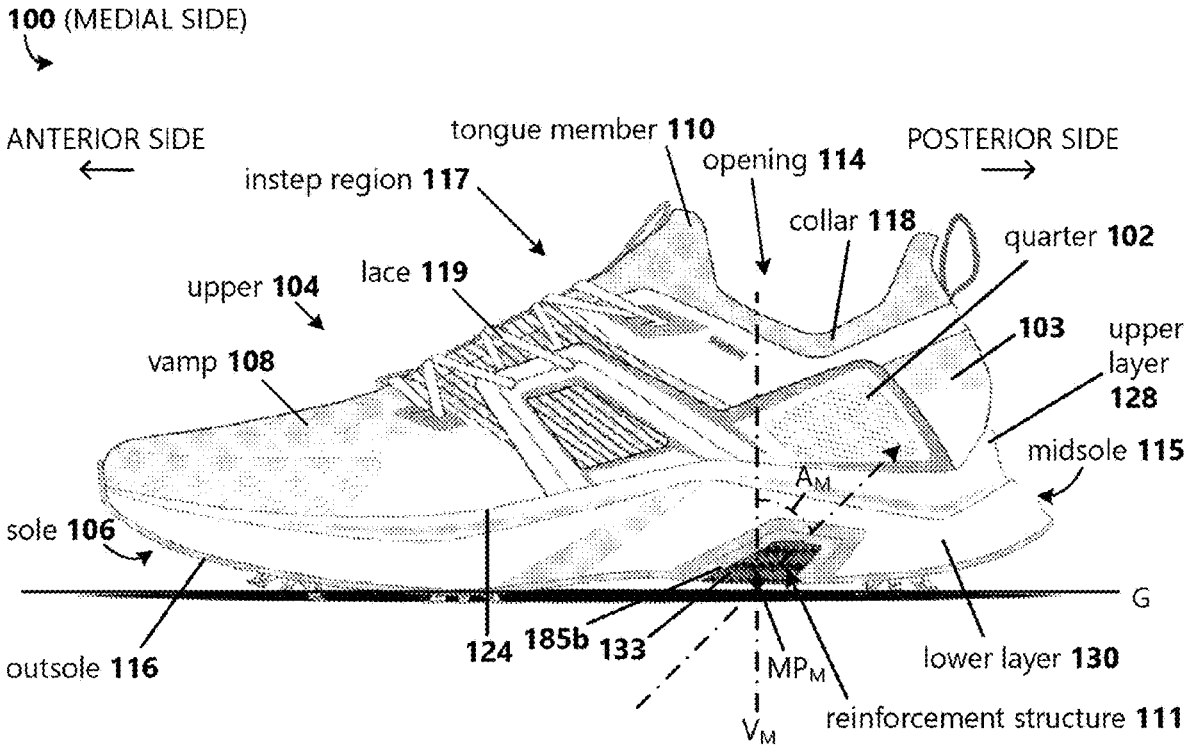
FIG. 1A depicts a medial side view of a golf shoe in which a reinforcement structure may be implemented according to an example.

The present technology now will be described more fully in reference to the accompanying figures, in which embodiments of the technology are shown. However, this technology should not be construed as limited to the embodiments set forth herein. Rather, these embodiments are provided so that this disclosure will be thorough and complete, and will fully convey the scope of the technology to those skilled in the art. In the drawings, like numbers refer to like elements throughout. Thicknesses and dimensions of some components may be exaggerated for clarity. The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present technology are explained in detail in the specification set forth below.

As briefly discussed above, when walking and playing golf, there are numerous and varied forces that may act on the foot and different parts of a golfer's shoe. For example, downward and upward forces can act on a midsole during a golf swing. Various features of a midsole that may be designed for increased cushioning and comfort, may also cause the midsole to be less rigid. Accordingly, increasing comfort of the shoe with a softer midsole may decrease an amount of support provided by the shoe when forces are applied; and alternatively, increasing the rigidity of the midsole may decrease the amount of cushioning, forefoot flex, and other comfort characteristics. One drawback with some athletic golf shoes is these shoes may help provide the golfer with good cushioning, forefoot flex, and other comfort characteristics; however, there may be a loss in rigidity of the midsole, which may not provide a stable platform for the golfer when he/she maker their swing. For example, a softer midsole may decrease the amount of support to prevent collapse of the shoe's suspension during a golf swing. Thus, there is a need for a golf shoe that can provide a high level of stability, such as that may be provided in a classic golf shoe having a rigid midsole designed for optimal stability, and yet also provide high flexibility, such as that may be provided in an athletic golf shoe that may have a midsole designed for optimal forefoot flex and underfoot cushioning/comfort.

To help alleviate the above problems, among other things, the examples of the present disclosure describe a golf shoe comprising a reinforcement structure. A sole of a shoe comprising the reinforcement structure may help provide additional stability. For example, the reinforcement structure may aid the shoe in being able to hold and support the medial and lateral sides of the golfer's foot as they shift their weight while making a golf shot. Thus, the golfer has a stable platform to drive power for a golf swing while being able to stay balanced during the follow through of the golf swing. The reinforcement structure may further provide greater bending and torsion stiffness in the midfoot area of the sole. For instance, the reinforcement structure may help provide the shoe with additional mechanical strength and structural integrity that does not allow excessive flexure, twisting or turning of the shoe. Thus, the shoe may provide improved midfoot stability. At the same time, the shoe may retain forefoot flexibility so the golfer is able to walk and play the course and engage in other golf activities comfortably.

Figure 1B:
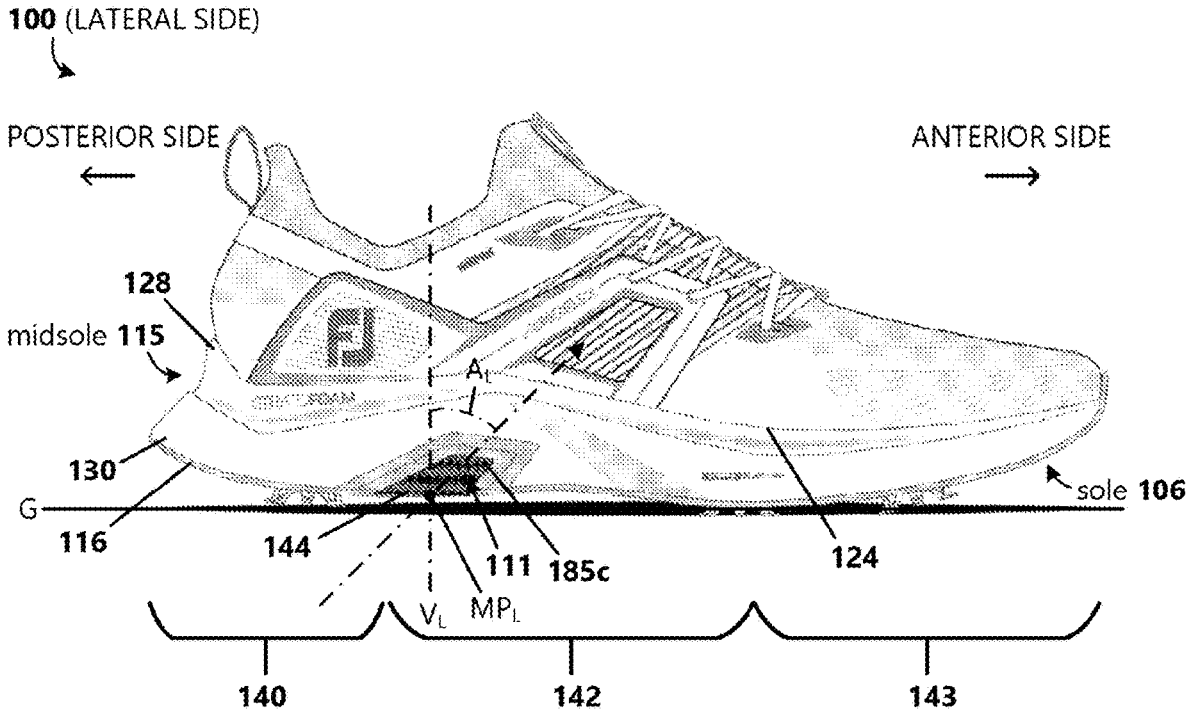
FIG. 1B depicts a lateral side view of the golf shoe of FIG. 1A according to an example.
Figure 1C:
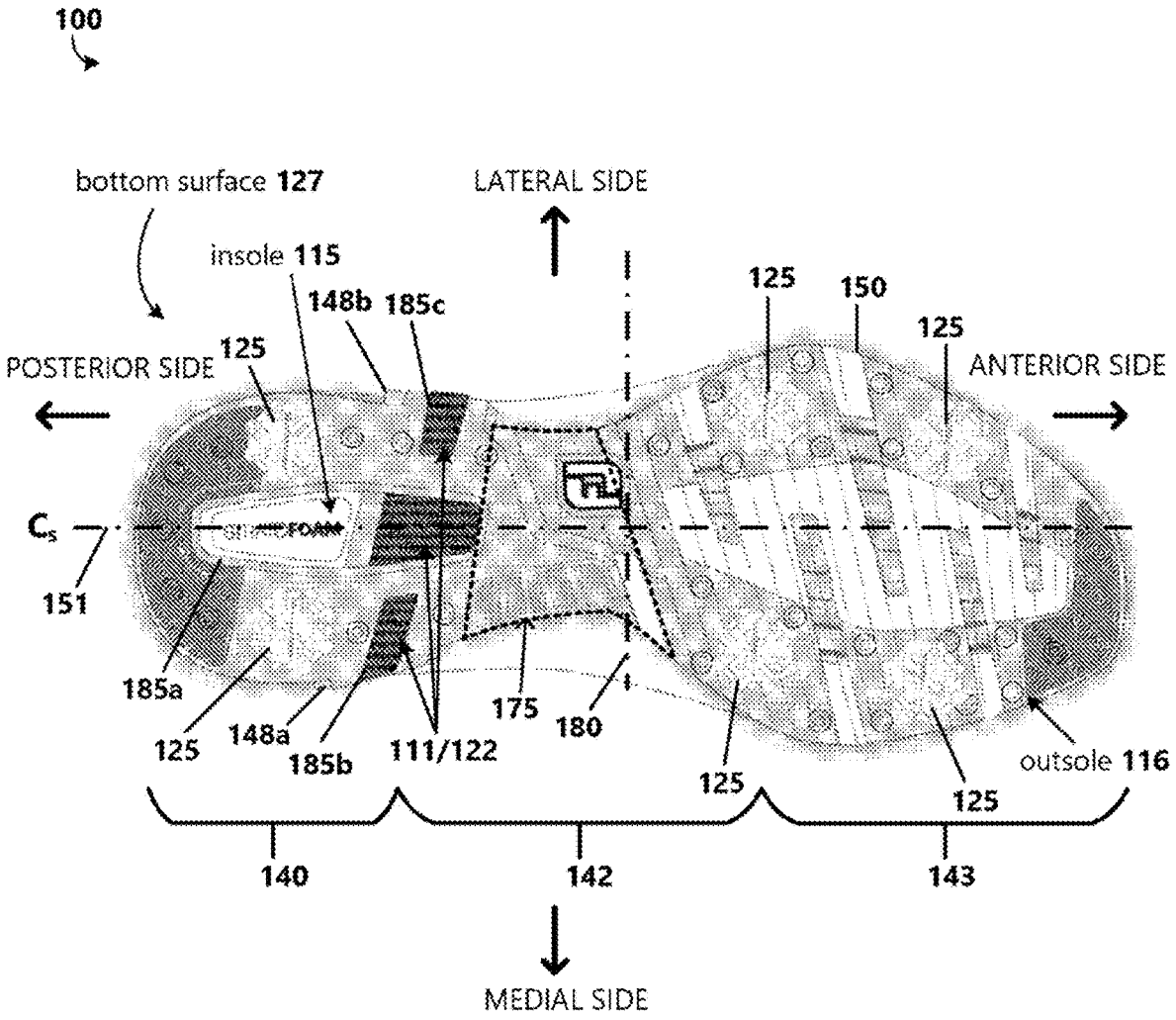
FIG. 1C depicts a bottom view of the golf shoe of FIG. 1A according to an example.

FIGS. 1A-1C depict various views of an example golf shoe 100, sometimes referred to herein generally as a shoe, in which aspects of a U-shaped reinforcement structure may be implemented. For example, FIG. 1A is a medial (e.g., inner) side view of the shoe 100, FIG. 1B is a lateral (e.g., outer) side view of the of the shoe 100, FIG. 1C is a bottom view of the shoe 100. The shoe 100 may generally include a shoe upper 104 and a sole assembly 106. The sole assembly 106 may include a midsole 115 and outsole 116. Some example sole assemblies 106 that can be incorporated in the shoe 100 are described in U.S. Pat. No. 11,019,874 titled "Golf Shoe Having Outsole with All-Surface Traction Areas" filed on Dec. 20, 2018, and U.S. Patent Application No. 2020/038,3421 titled "Golf Shoe Having Midsole and Outsole for Providing Flex and Stability" filed Aug. 26, 2019, the disclosures of which are incorporated by reference herein in their entireties.

The midsole 115 may be positioned above the outsole 116, such that the midsole 115 may be between the wearer's foot and the outsole 116. According to an example, a reinforcement structure 111 may be at least partially embedded within or otherwise secured to the sole assembly 106. A bottom or outer surface 127 of the outsole 116 may be configured to engage the ground surface G on which the wearer is standing, walking, or performing a golfing action. A top or inner surface of the outsole 116 (not shown) may be configured to engage a bottom surface 131 of the midsole 115 and, in some examples, a bottom surface of the reinforcement structure 111, which may be arranged between the midsole 115 and outsole 116. As will be described in further detail below, the reinforcement structure 111 may be formed to cradle a portion of the golfer's foot to provide midsole rigidity and allow forefoot flex. For example, the material from which the reinforcement structure 111 is constructed may have a hardness level (durometer) higher than the material(s) of the midsole 115 and outsole 116. For example, the reinforcement structure 111 may be constructed of any suitable reinforcing material such as a carbon composite material, fiberglass composite material, TPU composite material, or other material that may provide additional structural rigidity to the shoe 100. In one example, the material may comprise a binding matrix (resin) and reinforcing fiber. The binding polymer can be a thermoset material, such as polyester, polyolefin, nylon, or polyurethane. In an example, a carbon fiber, such as graphite, may be used as the reinforcing fibers. Other fibers, such as aramids (e.g., Kevlar™), aluminum, or glass fibers can be used in addition to or in place of the carbon fibers. In an example, the material may have a flexural rigidity of approximately greater than 45 N-cm, as determined via the ASTM D790-10 method. In another example, the material may have a flexural strength of approximately greater than 148 MPa and a flexural modulus of approximately greater than 7,445 MPa, as determined via the ASTM D790-10 method per testing performed in carbon direction. In an illustrative example, the fiber-reinforced thermoplastic composite material may have an approximate thickness of 1.0 mm or between 0.6 mm to 2.0 mm.

In general, the anatomy of the foot can be divided into three bony regions. A rearfoot region generally includes the ankle (talus) and heel (calcaneus) bones. A midfoot region includes the cuboid, cuneiform, and navicular bones that form the longitudinal arch of the foot. The forefoot region includes the metatarsals and the toes. The shoe 100, and accordingly, the upper 104, midsole 115, and outsole 116, may generally include a rearfoot area 140 corresponding to the rearfoot and that may include a heel area, a midfoot area 142 that corresponds to the midfoot region, and a forefoot area 143 corresponding to the forefoot region and which may include a toe area. It is understood that the rearfoot area 140, midfoot area 142, and forefoot area 143 are intended to represent general areas of footwear and not demarcate precise areas. As described herein, the rearfoot area 140 (and heel area) is considered to be a posterior end of the shoe 100, and, conversely, the forefoot area 143, including the toe area, is considered to be an anterior end of the shoe 100.

As shown in FIG. 1C, in addition to having a rearfoot area 140, midfoot area 142, and forefoot area 143, the shoe 100, and accordingly, the upper 104, midsole 115, and outsole 116, may also have a medial side and a lateral side that are opposite to one another. The medial side may generally correspond with an inside area of the wearer's foot and a surface that faces toward the wearer's other foot. The lateral side may generally correspond with an outside area of the wearer's foot and a surface that faces away from the wearer's other foot. The lateral side and the medial side may extend through each of the rearfoot area 140, the midfoot area 142, and the forefoot area 143 and correspond with opposite sides of the shoe 100 (e.g., and upper 104, midsole 115, and outsole 116). The medial side and a lateral side may extend around the periphery 150 or perimeter of the shoe 100. For example, the anterior end and posterior end may apply to the shoe 100 in general, and an anterior end and posterior end may apply to each of the upper 104, midsole 115, and outsole 116 and associated areas in reference or relation to orientation toward the front or back of the shoe 100.

The upper 104 may have a traditional shape and may be made from a combination of standard upper materials such as, for example, natural leather, synthetic leather, knits, non-woven materials, natural fabrics, and synthetic fabrics. For example, breathable mesh and synthetic textile fabrics made from nylons, polyesters, polyolefins, polyurethanes, rubbers, foams, and combinations thereof can be used. The material used to construct the upper 104 may be selected based on desired properties such as breathability, durability, flexibility, comfort, and water resistance. The upper material is stitched or bonded together to form an upper structure using traditional or non-traditional manufacturing methods. As an example of a non-traditional manufacturing method, the shoe 100 may have an upper 104 comprised of a single piece of flat knit engineered mesh with vacuum hot melt reinforcements. In one example, the shoe 100 may be waterproof, and the forefoot area 143 of the upper 104 and at least an outermost layer of the upper 104 may be constructed of one or a combination of materials having water resistant properties. Additional waterproofing features (described below) may be applied in construction of the shoe 100 for providing additional waterproofing capabilities.

The upper 104 may include a vamp 108, for covering a forepart of the foot, connected to a quarter 102, for covering and/or supporting the rear portions of a wearer's foot (e.g., the area surrounding and below the Achilles tendon, the posterior of the heel, and the talus and calcaneus bones). In one example, the heel area of the quarter 102 may include a molded heel cup 103. In another example, the quarter 102 may be a molded heel cup. For instance, the quarter 102 may be comprised of a plurality of layers that may be molded together to form the heel cup 103. In another example, the upper 104 may include a continuous piece of material for the vamp 108 and quarter 102.

The upper 104 may include an instep region 117 with an opening 114 for inserting a foot. In some examples, the upper 104 may further include a soft, molded foam heel collar 118 extending around at least a portion of the opening 114 for providing enhanced comfort and fit. The instep region 117 may include a tongue member 110. A variety of tightening system can be used for tightening the shoe 100 around the contour of the foot. For example, laces 119 of various types of materials (e.g., natural or synthetic fibers, metal cable) may be included in the tightening system. In one example, the shoe 100 may include a metal cable (lace)-tightening assembly that may comprise a dial, spool, and housing and locking mechanism for locking the cable in place.

Figure 2A:
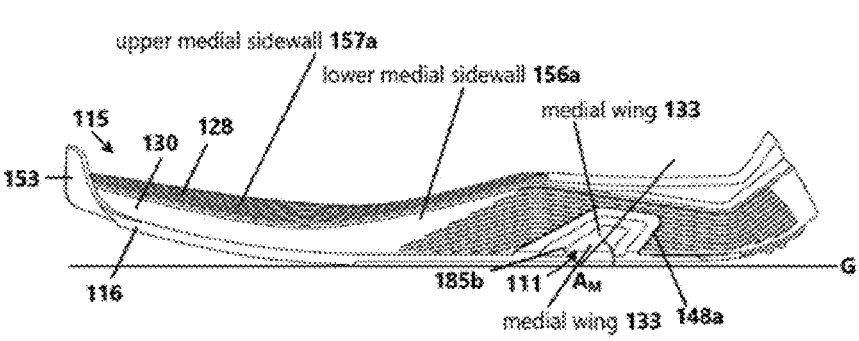
FIG. 2A depicts a medial side view of a sole of a golf shoe in which a reinforcement structure may be implemented according to an example.

It should be understood that the above-described upper 104 shown in FIGS. 1A-1C represents only one example of an upper design that can be used in the shoe 100 construction of this disclosure and other upper designs can be used without departing from the spirit and scope of this disclosure. Some features of the shoe 100 may be similar to that described in U.S. patent application Ser. No. 16/576,854, titled "GOLF SHOE HAVING COMPOSITE PLATE IN MIDSOLE FOR PROVIDING FLEX AND STABILITY," filed on Sep. 20, 2019, the entire disclosure of which is incorporated by reference in its entirety. Referring still to FIGS. 1A-1C, and with concurrent reference to FIGS. 2A-2C and 3A-3C, a sole assembly 106 according to a first example is described. FIG. 2A includes a medial view of an example sole assembly 106, FIG. 2B includes a bottom view of the sole assembly 106 of FIG. 2A, and FIG. 2C includes a lateral view of the sole assembly 106 of FIGS. 2A-2B. FIG. 3A includes an exploded view of the first example sole assembly 106, FIG. 3B includes a top schematic view of the first example sole assembly 106, and FIG. 3C includes a cross-sectional view of the first example sole assembly 106.

As used herein, a longitudinal centerline $C_s$ 151 of the sole assembly 106 (FIGS. 2B, 3B, and 4C) may refer to a primary axis of length along the center of the shoe 100. The longitudinal centerline $C_s$ 151 may bisect the rearfoot area 140 and may extend parallel or approximately parallel to the lateral side edge of the sole assembly 106. For example, the centerline of at least the back half of the wearer's foot, which may extend centrally through the wearer's calcaneus, may generally align with the longitudinal centerline $C_s$ 151. Thus, the longitudinal centerline $C_s$ 151 may represent both the centerline of the wearer's foot and the centerline of the rearfoot area 140 of the sole assembly 106, although, as appreciated, a true centerline of the wearer's foot may intersect the longitudinal centerline $C_s$ 151 at a slight acute angle and extend between the second and third metatarsal.

As stated above, the sole assembly 106 may comprise a midsole 115 and an outsole 116. The midsole 115 may be relatively lightweight and provides cushioning to the shoe 100. The midsole 115 may be made from midsole materials such as, for example, foamed ethylene vinyl acetate copolymer (EVA) or foamed polyurethane compositions. In one example, the midsole 115 may be constructed using two different foamed materials as described below.

As shown in FIGS. 1A, 1B, 2A, 2C, 3A, and 3C, the midsole 115, 215 may comprise two (2) regions: an upper layer 128 and a lower layer 130. The upper layer 128 may be made of a relatively soft and flexible material. For example, the upper layer 128 may be made of a relatively soft first EVA foam composition having a first hardness level (durometer). The lower layer 130 may be made of a relatively firm material, such as a second EVA foam composition having a second hardness level (durometer). That is, the lower layer 130 may have a greater hardness level (durometer) than the upper layer 128. In one example, a blend of EVA and styrenic block copolymer rubber (such as "SI", "SIS", "SB", "SBS", "SIBS", "SEBS", "SEPS" and the like, where "S" is styrene, "I" is isobutylene, "E" is ethylene, "P" is propylene, and "B" is butadiene), can be used to form the relatively firm second EVA foam composition.

As stated above, the lower layer 130 may have a greater hardness level (durometer) than the upper layer 128. In an example, the upper layer 128 may have a durometer ranging from approximately 40 to about 75 Shore C, while the lower layer 130 may have a durometer ranging from approximately 45 to about 80 Shore C. In another example, the relatively soft first EVA foam composition of the upper layer 128 may have a Shore C hardness in the range of approximately 50 to approximately 70, and the relatively firm second EVA foam composition of the lower layer 130 may have a Shore C hardness in the range of approximately 50 to approximately 75 Shore C. In another example, the relatively soft first EVA foam composition of the upper layer 128 may have a durometer in the range of approximately 55 to approximately 60 Shore C, and the relatively firm second EVA foam composition of the lower layer 130 may have a durometer in the range of approximately 65 to approximately 70 Shore C. For example, the hardness of the foamed lower layer 130 may be at least 5% greater than the hardness of the foamed upper layer 128. In some examples, the hardness of the foamed lower layer 130 may be at least 10% or 15% greater; and in other examples, at least 20% or 25% greater.

The densities of the first foamed composition and second foamed composition may also be different. For example, the density of the relatively firm second EVA foamed composition used to form the lower layer 130 may be greater than the density of the relatively soft first EVA foamed composition used to form the upper layer 128. Different foaming additives and catalysts may be used to produce the EVA foam compositions used to form the midsole 115. For example, the EVA foam composition normally contains polyethylene. The EVA foam compositions have various properties making them particularly suitable for constructing midsoles 115 including good cushioning and shock absorption; high water and moisture-resistance; and long-term durability. In some examples, the lower layer 130 of the midsole 115 may form a first (lower) sidewall 156 of the midsole 115, which may help hold and support the medial and lateral sides of the golfer's foot. The lower sidewall 156 may include a lower medial sidewall 156*a* disposed on the medial side of the lower layer 130 of the midsole 115 and a lower lateral sidewall 156*b* disposed on the lateral side of the lower layer 130 of the midsole 115. In other examples, a second (upper) sidewall 157 of the midsole 115 may be formed by the upper layer 128. The upper sidewall 157 may include an upper medial sidewall 157*a* disposed on the medial side of the upper layer 128 of the midsole 115 and an upper lateral sidewall 157*b* disposed on the lateral side of the upper layer 128 of the midsole 115.

In some examples, and as shown in FIG. 3A, the midsole 115 may include a cavity comprised of a plurality of nesting areas 169, 171, 173 defined in the lower surface of the lower layer 130 of the midsole 115 and in the lower sidewalls 156 that may be configured to receive the reinforcement structure 111. In some examples and as shown in FIGS. 3A, 3C, 5A and 5B, the reinforcement structure 111 may be generally U-shaped with a medial wing 133, a lateral wing 144, and a bridge 122 connecting the medial wing 133 and lateral wing 144. For example, the reinforcement structure 111 may be positioned within the plurality of nesting areas and sandwiched between the midsole 115 and outsole 116. In other examples (described below with reference to FIGS. 4A-4D, 8, and 10), the reinforcement structure 111 may be at least partially embedded within the midsole 115. As shown in FIGS. 1C, 3B, and 4C, the reinforcement structure 111 may be included in the sole assembly 106 and positioned behind a shank area 175 that may be located at approximately a midline 180 of the shoe 100. For instance, the reinforcement structure 111 may be located at the posterior (rearward) end of the midfoot area 142, between the rearfoot area 140 and the midfoot area 142, and/or at the anterior (forward) end of the rearfoot area 140.

According to an example, a central nesting area 169 of the cavity defined in the midsole 115 may be formed across the bottom surface 131 of the lower layer 130, a medial nesting area 171 may be formed into the lower medial sidewall 156*a*, and a lateral nesting area 173 may be formed into the lower lateral sidewall 156*b*. For example, the medial nesting area 171 formed in the lower medial sidewall 156*a* may be configured to receive the medial wing 133 of the reinforcement structure 111, the lateral nesting area 173 formed into the lower lateral sidewall 156*b* may be configured to receive the lateral wing 144 of the reinforcement structure 111, and the central nesting area 169 formed into the bottom surface 131 of the lower layer 130 of the midsole 115 may be configured to receive the bridge 122 connecting the medial wing 133 and lateral wing 144. For example, the central nesting area 169 may extend from the medial side to the lateral side of the bottom surface 131 of the lower layer 130 of the midsole 115. As should be appreciated, the central nesting area 169, medial nesting area 171, and lateral nesting area 173 may be configured to assume a similar contour and positioning as the reinforcement structure 111 to provide a nest for the reinforcement structure 111. Contour and positioning of the reinforcement structure 111 are described in detail below.

The outsole 116 may be designed to provide support and traction for the shoe. As shown in FIGS. 1C and 3A, a bottom surface 127 of the outsole 116 may include a plurality of traction members 125 (e.g., spikes, soft spikes, or other removable or permanent features) to help provide traction between the shoe 100 and the different surfaces of a golf course or other ground surfaces (G). The traction members 125 can be made of any suitable material such as rubbers, plastics, and combinations thereof. Thermoplastics such as nylons, polyesters, polyolefins, and polyurethanes can be used. In one preferred embodiment, the traction members 125 are made of a relatively hard thermoplastic polyurethane (TPU) composition. Different polyamide compositions including polyamide copolymers and aramids also can be used to form the traction members. In an example, an elastomer comprised of block copolymers of rigid polyamide blocks and soft polyether blocks can be used. Suitable rubber materials include, but are not limited to, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, nitrile rubber, and blends of two or more thereof. Various structures and geometries of traction members 125 and outsoles 116 may be included and are within the scope of the present disclosure.

In some examples, and as shown in FIGS. 1C, 2A-2C, and 3A, the outsole 116 may comprise a medial extension 148*a* and a lateral extension 148*b*, and a toe cap 153. The medial extension 148*a* may extend from the medial perimeter of the outsole 116, and may be molded or otherwise formed to project upward in alignment with the medial nesting area 171 formed into the lower medial sidewall 156*a* of the midsole 115 and the medial wing 133 of the reinforcement structure 111. For example, the medial extension 148*a* may be molded to fit around and accommodate the medial wing 133 of the reinforcement structure 111, such that the medial wing 133 may be sandwiched between the midsole 115 and the outsole 116. Additionally, the lateral extension 148*b* may extend from the lateral perimeter of the outsole 116, and may be molded or otherwise formed to project upward in alignment with the lateral nesting area 173 formed into the lower lateral sidewall 156*b* of the midsole 115 and the lateral wing 144 of the reinforcement structure 111. For example, the lateral extension 148*b* may be molded to fit around and accommodate the lateral wing 144 of the reinforcement structure 111, such that the lateral wing 144 may be sandwiched between the midsole 115 and the outsole 116.

Figure 2B:
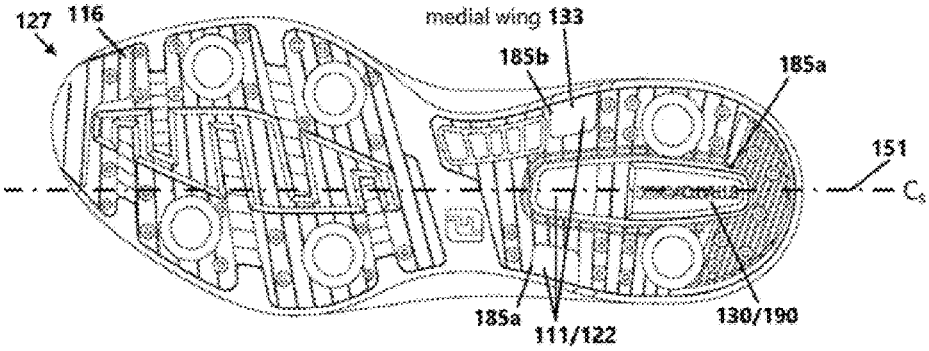
FIG. 2B depicts a bottom view of the sole of FIG. 2A according to an example.
Figure 2C:
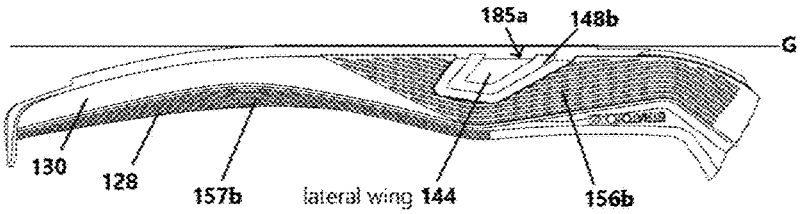
FIG. 2C depicts a lateral side view of the sole of FIG. 2A according to an example.
Figure 3A:
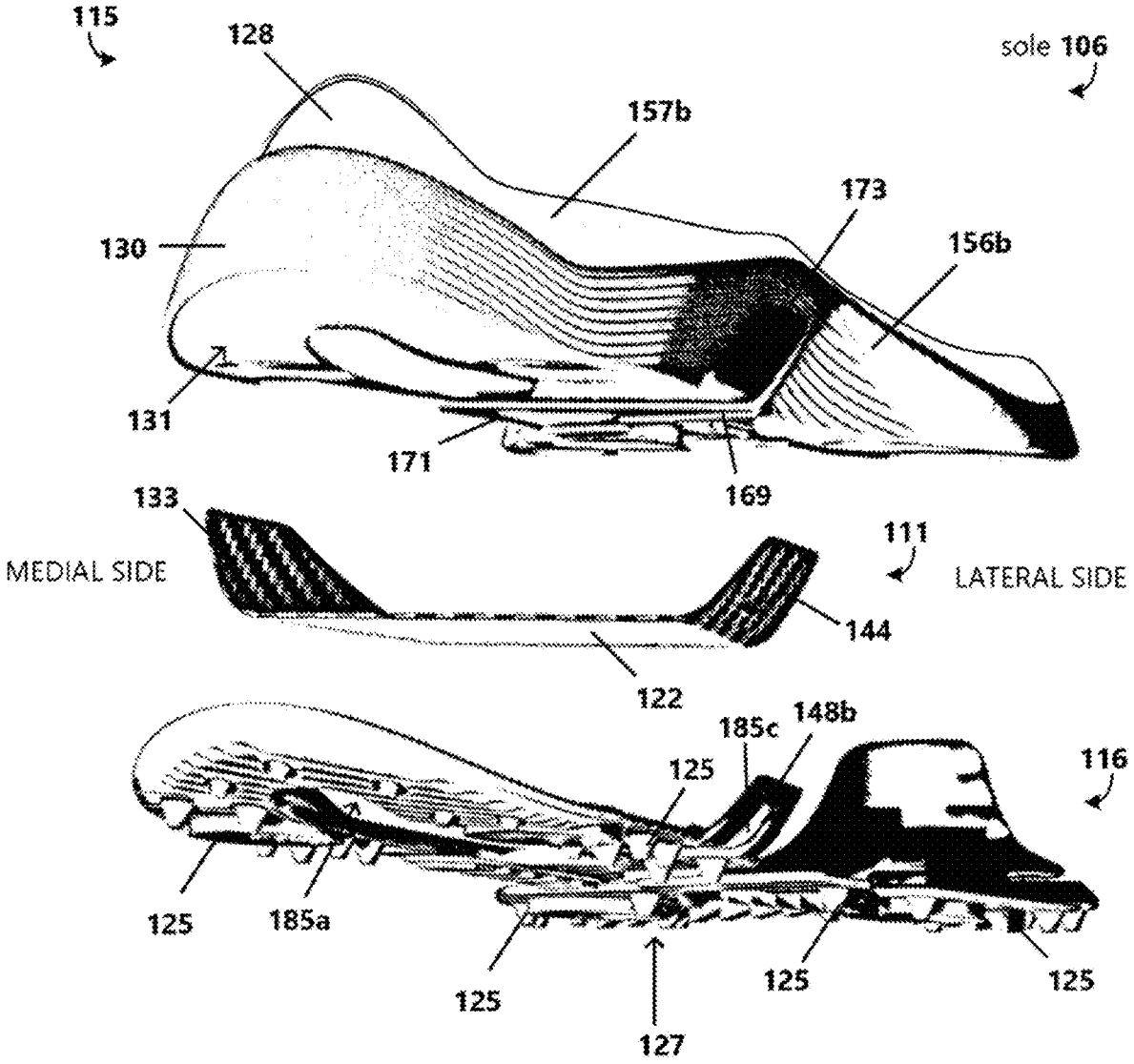
FIG. 3A depicts a bottom rear perspective exploded view of a sole assembly of a golf shoe in which a reinforcement structure may be implemented according to an example.
Figure 3B:
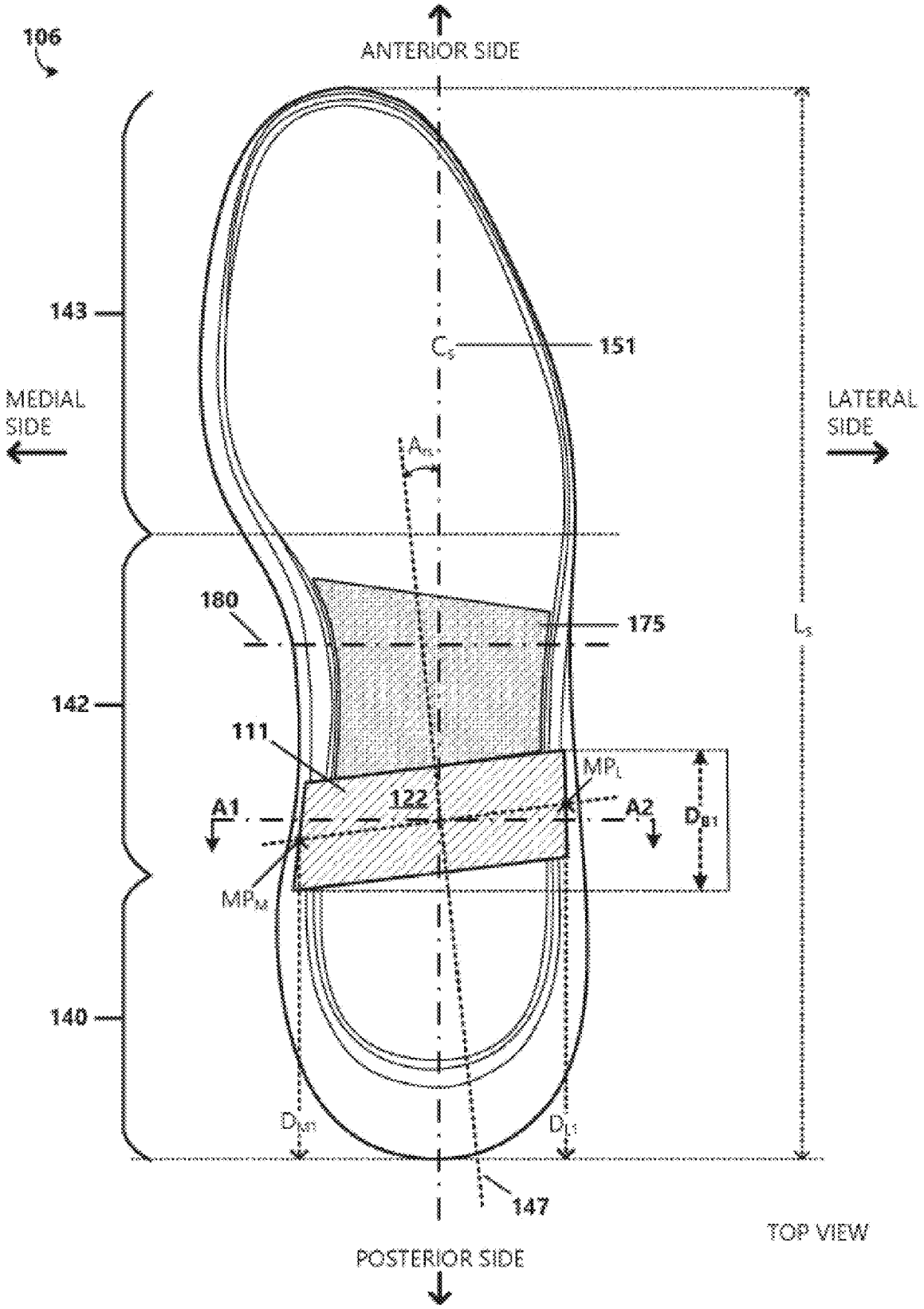
FIG. 3B depicts a top schematic view of a sole assembly of a golf shoe in which a reinforcement structure may be implemented according to an example.
Figure 3C:
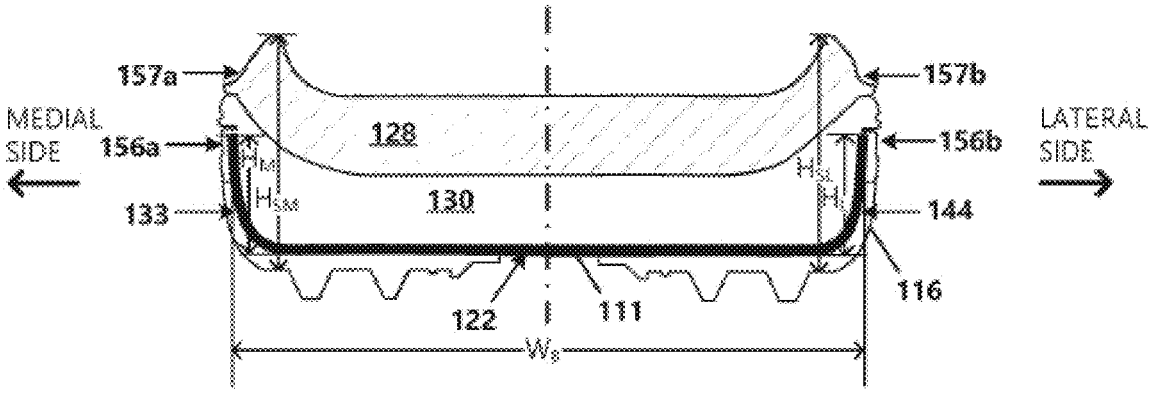
FIG. 3C depicts a cross-sectional view of the sole assembly of FIG. 3B according to an example.
Figure 5A:
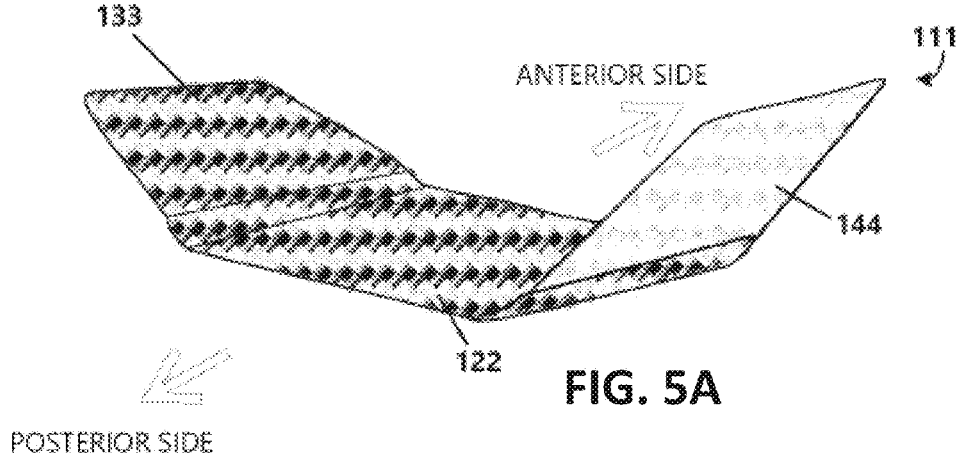
FIG. 5A depicts a rear perspective view of a reinforcement structure, where the bridge may be configured to extend a first example distance within the sole assembly according to an example.
Figure 5B:
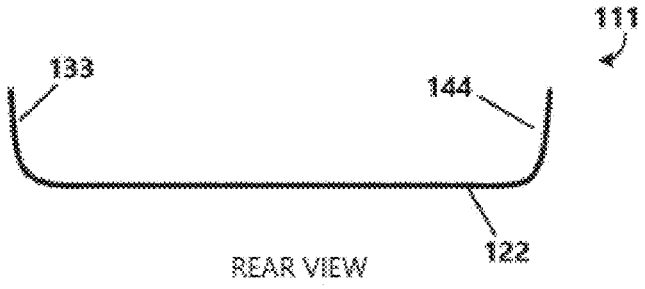
FIG. 5B depicts a rear view of the example reinforcement structure of FIG. 5A according to an example.

FIGS. 1A-1C, 2A-2C, 3A-3C, 5A, and 5B, illustrate an example reinforcement structure 111 according to a first example, shown from the medial side and embedded in the sole assembly 106 in FIGS. 1A and 2A, shown from the lateral side and embedded in the sole assembly 106 in FIGS. 1B and 2C, shown from below and embedded in the sole assembly 106 in FIGS. 1C and 2B, shown from behind and below in FIG. 3A, in a schematic representation from above and embedded in the sole assembly 106 in FIG. 3B, shown in a rear sectional view in FIG. 3C, shown from behind and above in FIG. 5A, shown in a rear view in FIG. 5B, and shown from the top in a cut but unformed state in FIG. 5C. As shown, the reinforcement structure 111 may be formed to be generally U-shaped to form the medial wing 133, lateral wing 144, and bridge 122 connecting the medial wing 133 and lateral wing 144.

Generally, the medial wing 133 may extend from the medial side of the bridge 122 and may be molded or otherwise formed to extend upward along the lower medial midsole sidewall 156*a*, and the lateral wing 144 may extend from the lateral side of the bridge 122 and may be molded or otherwise formed to extend upward along the lower lateral sidewall 156*a* of the midsole 115. The medial wing 133 may provide increased reinforcement to the lower medial midsole sidewall 156*a*, which may help hold and support the medial side of the golfer's foot. The lateral wing 144 may reinforce the lower lateral midsole sidewall 156*b*, which may help hold and support the lateral side of the golfer's foot. According to one example, the medial wing 133 and the lateral wing 144 may be formed such that an angle between the bridge 122 and the medial and lateral wings may range between 90-110 degrees.

In some examples, heights $H_M$,$H_L$ (FIG. 3C) of the medial wing 133 and lateral wing 144 may vary. In some examples, the medial wing 133 height $H_M$ and the lateral wing 144 $H_L$ may be the same or approximately similar. As an illustrative example, the medial wing height $H_M$ and the lateral wing height $H_L$ may range from approximately 25-80% of the medial height $H_{SM}$ and lateral height $H_{SL}$, respectively, of the sole assembly 106 of the shoe 100. The medial $H_M$ and lateral $H_L$ wing heights may be measured from the bottom surface of the bridge 122 to a top edge of the medial wing 133 and lateral wing 144, and the medial height $H_{SM}$ and lateral height $H_{SL}$ of the sole assembly 106 may be measured from the bottom surface 127 of the outsole 116 (excluding the traction members 125) along vertical axes $V_M$ and $V_L$ (shown in FIGS. 1A and 1B) to a top edge of the upper layer 128 of the midsole 115.

Figure 5C:
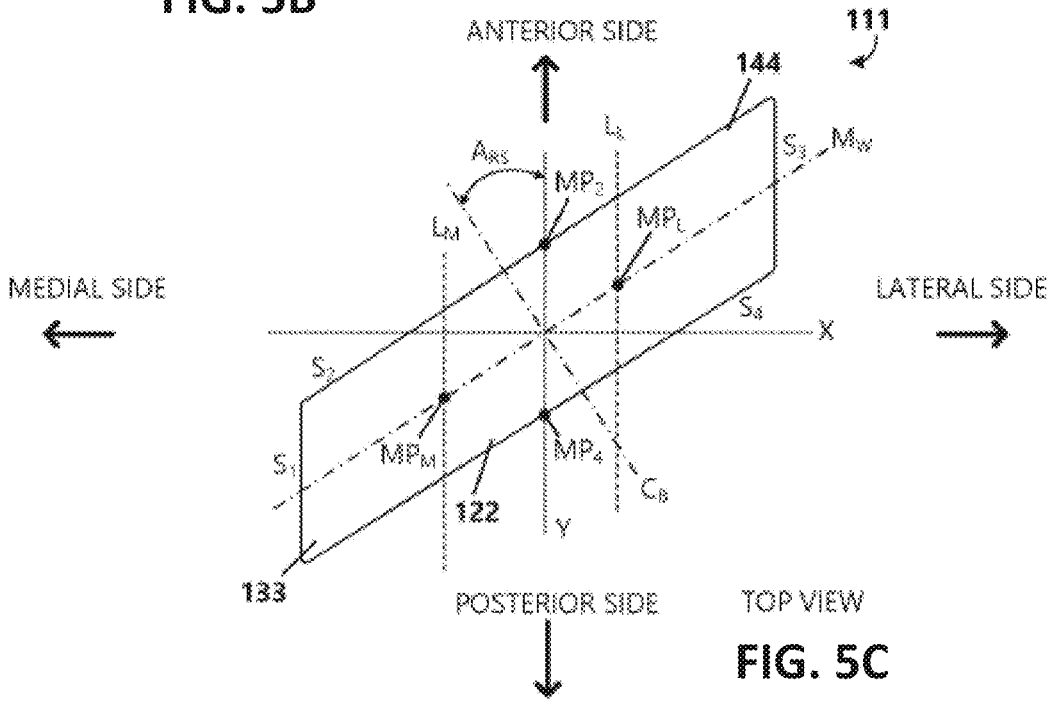
FIG. 5C depicts a top view of the example reinforcement structure of FIGS. 5A and 5B prior to being formed according to an example.

The medial vertical axis $V_M$ may be parallel to the ground surface G and intersect the perimeter of the bottom edge of the medial wing 133 at a midpoint $MP_M$ along the bottom edge of the medial wing 133 (shown in FIGS. 1A, 3B, and 5C). For example, the bottom edge of the medial wing 133 may be an intersecting line between the bridge 122 and the medial wing 133, and the medial midpoint $MP_M$ may divide the intersecting line in half. Likewise, the lateral vertical axis $V_L$ may be parallel to the ground surface G and intersect the perimeter of the bottom edge of the lateral wing 144 at a midpoint $MP_L$ along the bottom edge of the lateral wing 144 (shown in FIGS. 1B, 3B, and 5C). For example, the bottom edge of the lateral wing 144 may be an intersecting line between the bridge 122 and the lateral wing 144, and the lateral midpoint $MP_L$ may divide the intersecting line in half.

As another illustrative example, for an average adult male shoe size, the medial wing height $H_M$ and the lateral wing height $H_L$ may range approximately between 10-30 mm, 12-20 mm, or 14-18 mm in height. As another illustrative example, the medial wing height $H_M$ and the lateral wing height $H_L$ may extend to the height Hs of the sole assembly 106. In other examples, the medial wing 133 height $H_M$ and the lateral wing 144 $H_L$ may differ, such that one wing may extend higher along the midsole 115 that the other wing. In one example, the lateral wing 144 $H_L$ may extend higher than the medial wing 133. In another example, the medial wing 133 may extend higher than the lateral wing 144 $H_L$.

With reference to FIG. 5C, a top view of the reinforcement structure 111, prior to being formed into its U shape, is shown according to an example. As shown, the reinforcement structure 111 may be cut into a shape of a parallelogram having 4 sides $S_1$-$S_4$, where the first side $S_1$ may be a top edge of the medial wing 133, the third side $S_3$ may be a top edge of the lateral wing 144, the second side $S_2$ may be a front (anterior) facing edge of the medial wing 133, bridge 122, and lateral wing 144, and the fourth side $S_4$ may be a back (posterior) facing edge of the medial wing 133, bridge 122, and lateral wing 144. According to an example, the lengths of the first side $S_1$ and the third side $S_3$ and the heights $H_M$,$H_L$ (FIG. 3C) of the medial wing 133 and lateral wing 144 may vary based on the lengths of the second side $S_2$ and the fourth side $S_4$. In one illustrative example, the lengths of the first side $S_1$ and the third side $S_3$ may be approximately ⅓ of the lengths of the second side $S_2$ and the fourth side $S_4$. In another illustrative example, for an average adult male shoe size, the average lengths of the first side $S_1$ and the third side $S_3$ may range from approximately 40-50 mm, and average lengths of the second side $S_2$ and the fourth side $S_4$ may range from approximately 90-125 mm.

Figure 6:
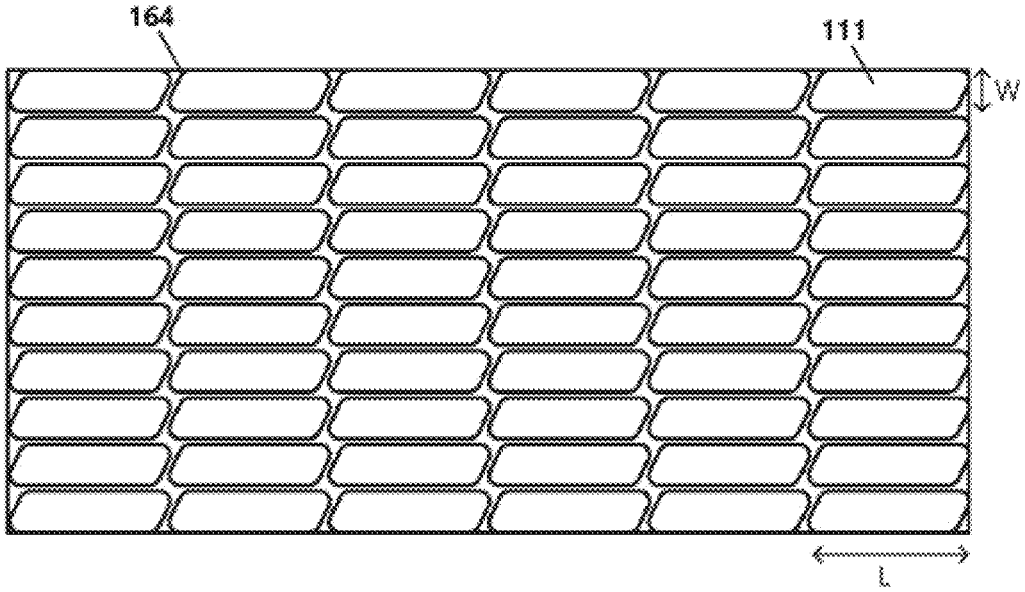
FIG. 6 depicts an example sheet of material from which a plurality of reinforcement structures may be produced.

In addition to providing various reinforcement benefits, as will be described in further detail below, the shape of the reinforcement structure 111 provides benefits and efficiency improvements for the manufacturing process as well. With reference to FIG. 6, as part of manufacturing the reinforcement structure 111, a plurality of reinforcement structures 111 may be cut from a sheet 164 of material. Due to the parallelogram shape, as shown, the sheet 164 of material may be efficiently used for producing a maximum number of reinforcement structures 111 with minimal additional material of the sheet 164 going unused. The reinforcement structures 111 may be cut using manufacturing cutting methods, such as via water jet, laser jet, die cut, etc. Additionally, after a plurality of reinforcement structures 111 having a width (W) and a length (L) are cut and formed, a plurality of reinforcement structures 111 may be easily and efficiently stacked. As can be appreciated, being able to easily and efficiently stack reinforcement structures 111 may increase various operational efficiencies of the shoe 100 manufacturing process (e.g., storing, transporting, handling, assembling).

With reference again to FIG. 5C, the reinforcement structure 111 is shown rotated, such that the first side $S_1$ and the third side $S_3$ of the reinforcement structure 111 may be approximately parallel in reference to a first axis Y (and approximately perpendicular to a second axis X). Additionally, the second side $S_2$ and the fourth side $S_4$ may be angled inward in reference to the first axis Y. When the reinforcement structure 111 is assembled into the sole assembly 106, the reinforcement structure 111 may be positioned similar to the illustrated rotation, such that the first axis Y may be in alignment with the longitudinal centerline $C_s$ 151 of the sole assembly 106, and the horizontal axis H may be perpendicular to the longitudinal centerline $C_s$ 151. According to an example, the second axis X may be approximately in alignment with the cross-section plane A1-A2 shown in FIG. 3B.

With reference again to FIG. 5C, according to an example, a midline $M_W$ of the wings of the reinforcement structure 111 may connect the medial and lateral midpoints $MP_M$, $MP_L$. In some examples, such as in the examples shown in FIGS. 1A-1C, 2A-2C, 3A-3C, and 5A and 5B, the midline $M_W$ of the wings of the reinforcement structure 111 may be approximately the same as the midline of the reinforcement structure 111.

Additionally, a longitudinal centerline $C_B$ of the bridge 122 of the reinforcement structure 111 may be perpendicular to the midline $M_W$ of the wings and connect midpoints $MP_2$, $MP_4$ of the bridge 122 portion of the second side $S_2$ and the fourth side $S_4$ of the reinforcement structure 111. When the reinforcement structure 111 is assembled into the sole assembly 106, the reinforcement structure 111 may be positioned such that the longitudinal centerline $C_B$ of the bridge 122 of the reinforcement structure 111 may have an inward angular deviation $A_{RS}$ of approximately 5-25 degrees relative to the longitudinal centerline $C_s$ 151. For instance, the angle $A_{RS}$ between the longitudinal centerline $C_B$ of the bridge 122 and the longitudinal centerline $C_s$ 151 may be between 5-25 degrees.

According to an example, the medial wing 133 and the lateral wing 144 may be formed by bending the material of the cut reinforcement structure 111 along a medial form line $L_M$ and a lateral form line $L_L$ (e.g., shown in FIG. 5C). Thus, the bridge 122 portion of the second side $S_2$ and the fourth side $S_4$ of the reinforcement structure 111 may include the segments between the intersections of the medial form line $L_M$ and a lateral form line $L_L$.

Figure 4A:
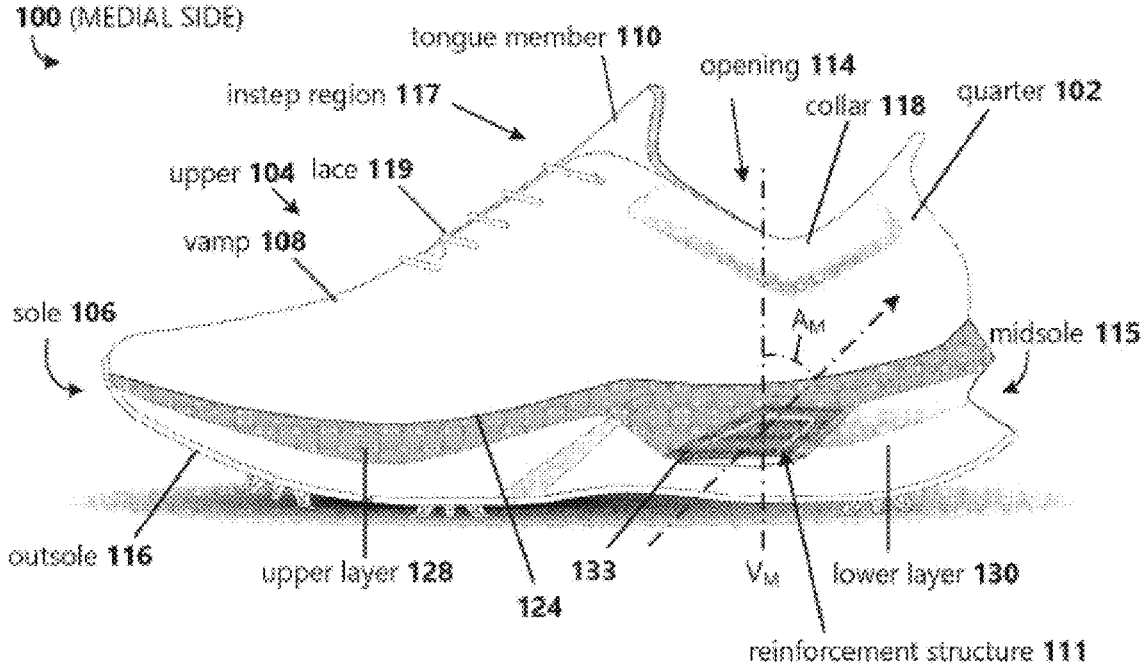
FIG. 4A depicts a medial side view of a golf shoe including a reinforcement structure according to another example.

The medial and lateral form lines $L_M$, $L_L$ may be approximately parallel to the first axis Y, such that when the reinforcement structure 111 is bent along the medial form line $L_M$ and assembled into the sole assembly 106, the medial wing 133 may extend rearward toward the posterior side of the sole assembly 106 (as shown in FIGS. 1A, 2A, and 4A). As an illustrative example, the medial wing 133 may have a rearward angle deviation $A_M$ of approximately 45 degrees relative to the medial vertical axis $V_M$. In some examples, the rearward angle $A_M$ of the medial wing 133 may be between 30-60 degrees or 40-50 degrees. According to an example, the medial wing 133 of the reinforcement structure 111 may reinforce the lower medial midsole sidewall 156*a*, which may help hold and support the medial side of the golfer's foot. For instance, the medial wing 133 may help support the driving foot in the downswing or the stabilizing foot in the upswing.

Figure 4B:
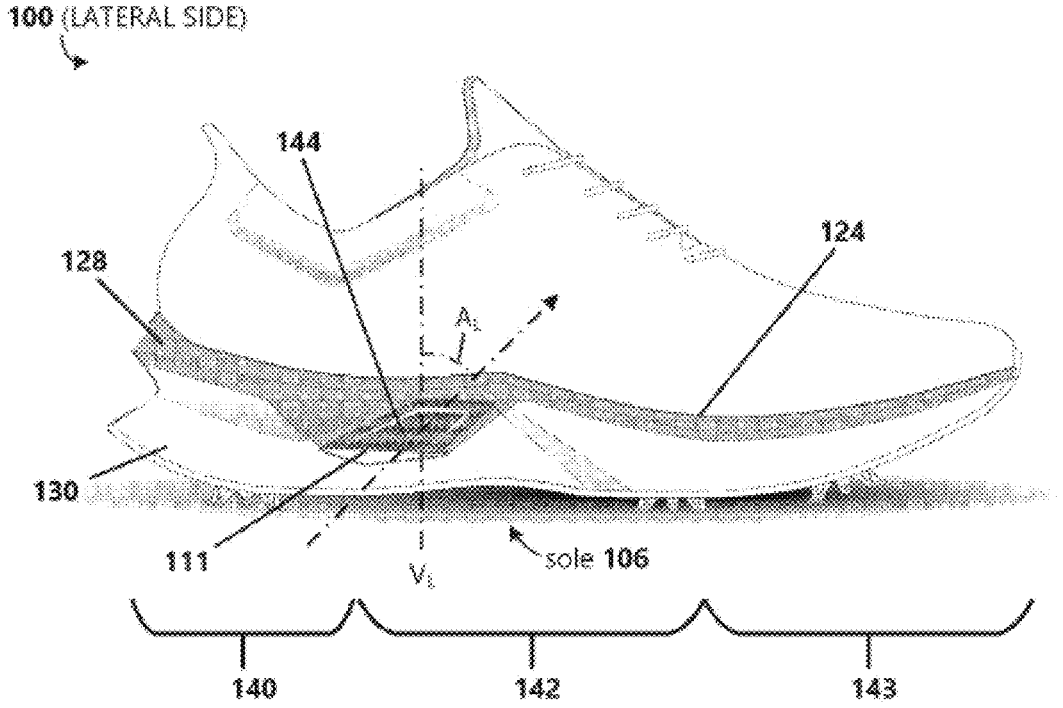
FIG. 4B depicts a lateral side view of the golf shoe of FIG. 4A according to an example.
Figure 4C:
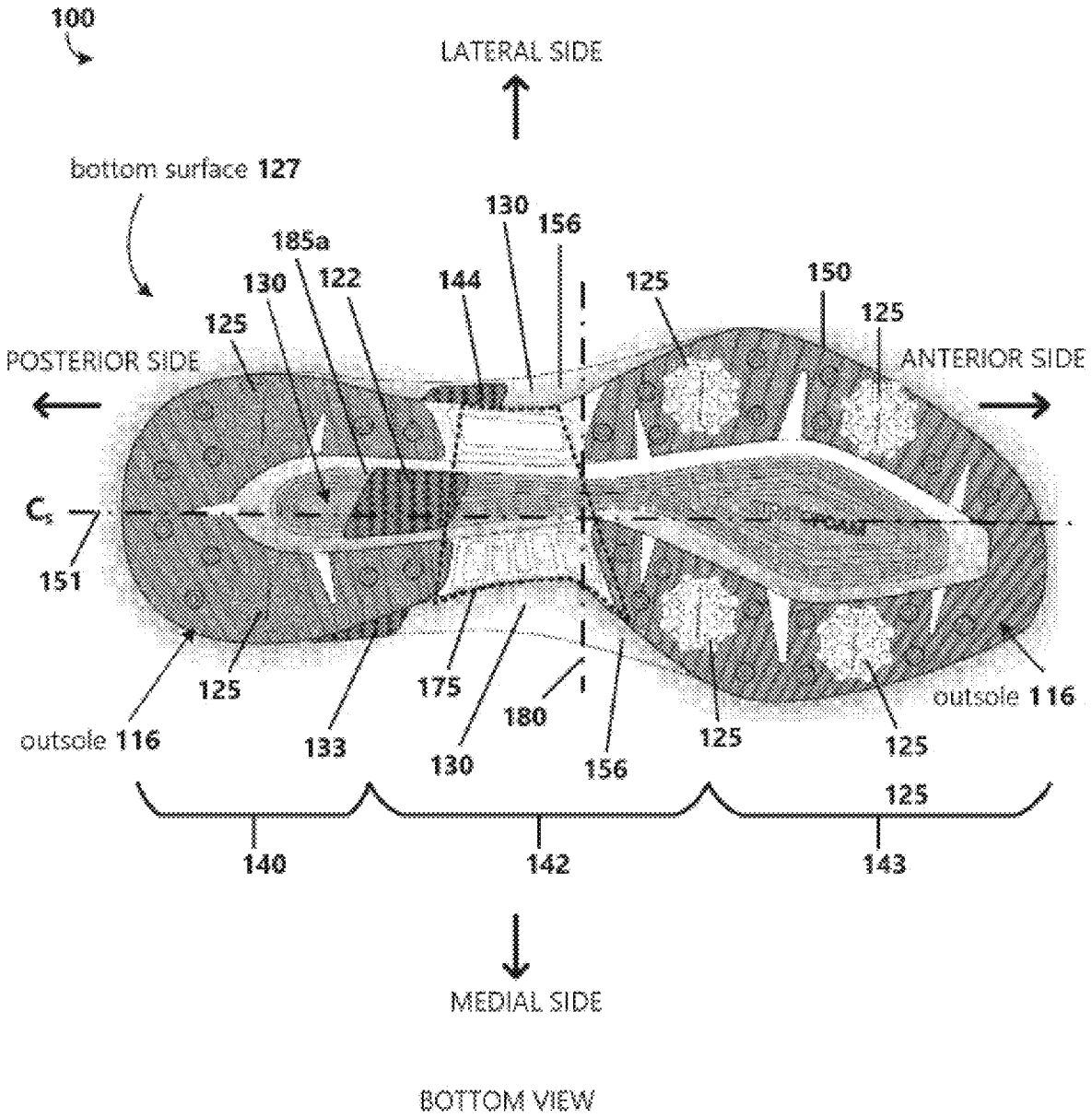
FIG. 4C depicts a bottom view of the golf shoe of FIG. 4A according to an example.
Figure 4D:
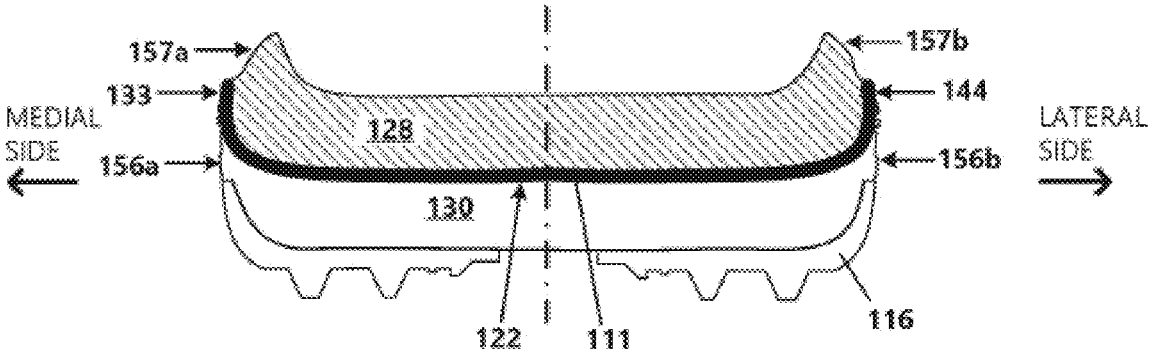
FIG. 4D depicts a cross-sectional view of the sole assembly of FIG. 3B, where the reinforcement structure is at least partially embedded within a midsole according to an example.

As mentioned above, the lateral form line $L_L$ may be approximately parallel to the first axis Y, such that when the reinforcement structure 111 is bent along the lateral form line $L_L$ and assembled into the sole assembly 106, the lateral wing 144 may extend forward toward the anterior side of the sole assembly 106 (as shown in FIGS. 1B, 2C, and 4B). As an illustrative example, the lateral wing 144 may have a forward angle deviation $A_L$ of approximately 45 degrees relative to the lateral vertical axis $V_L$. In some examples, the forward angle $A_L$ of the lateral wing 144 may be between 30-60 degrees or 40-50 degrees. According to an example, the lateral wing 144 of the reinforcement structure 111 may reinforce the lower lateral midsole sidewall 156*b*, which may help hold and support the lateral side of the golfer's foot. For instance, the lateral wing 144 may provide a stiffer midfoot area 142 to provide midfoot support for the golfer's driving foot during the golf swing.

In some examples and as shown in FIG. 3B, the reinforcement structure 111 may be designed and positioned in the sole assembly 106 such that the medial midpoint $MP_M$ along the bottom edge of the medial wing 133 may be located at a distance $D_{M1}$ that (e.g., for an average adult male shoe size) may range from approximately 85-105 mm measured from the most-posterior point of the sole assembly 106 toward the anterior side of the sole assembly 106 along the longitudinal centerline $C_s$ 151 axis. According to another example, the reinforcement structure 111 may be designed and positioned in the sole assembly 106 such that the medial midpoint $MP_M$ is located an approximate range of 25-33% of the total sole assembly 106 length $L_S$ from the most-posterior point to the most-anterior point of the sole assembly 106 as measured along the longitudinal centerline $C_s$ 151 axis.

In some examples, the reinforcement structure 111 may be designed and positioned in the sole assembly 106 such that the lateral midpoint $MP_L$ along the bottom edge of the lateral wing 144 may be located at a distance $D_{L1}$ that (e.g., for an average adult male shoe size) may range from approximately 95-115 mm measured from the most-posterior point of the sole assembly 106 toward the anterior side of the sole assembly 106 along the longitudinal centerline $C_s$ 151 axis. According to another example, the reinforcement structure 111 may be designed and positioned in the sole assembly 106 such that the lateral midpoint $MP_L$ may be located at a distance $D_{L1}$ that is within an approximate range of 30-36% of the total sole assembly 106 length $L_S$ from the most-posterior point to the most-anterior point of the sole assembly 106 as measured along the longitudinal centerline $C_s$ 151 axis. In some examples, such as in the examples shown in FIGS. 1A-3C, the bridge 122 may extend from the periphery 150 of the medial side of the sole assembly 106 to the periphery 150 of the lateral side of the sole assembly 106. As can be appreciated, the width of the sole assembly 106 and, accordingly, the bridge 122 $W_B$ may vary relative to the size of the shoe 100.

In some examples, and as will be described in further detail below, a distance $D_B$ that the bridge 122 may extend within the sole assembly 106 may vary. The distance $D_B$ that the bridge 122 may extend within the sole assembly 106 may be measured generally from a front-most (or a most-anterior) point of the bridge 122 to a back-most (or a most-posterior) point of the bridge 122. For example, the distance $D_B$ that the bridge 122 may be measured along the first (Y) axis of the reinforcement structure 111 and the longitudinal centerline $C_s$ 151 axis of the sole assembly 106 from the most-posterior point of the bridge 122 along the fourth side $S_4$ of the reinforcement structure 111 to most-anterior point of the bridge 122 along the second side $S_2$ of the reinforcement structure 111.

In some examples, and as shown in FIGS. 1C, 2B, 3A, and 4C, one or more openings 185*a-n* may be defined in the outsole 116 through which portions of other structures of the sole assembly 106 may be exposed and/or may be visible. According to an example, a first opening 185*a* may be defined in the rearfoot area 140 of the outsole 116 and may generally align with the longitudinal centerline $C_s$ 151 of the sole assembly 106. The first opening 185*a* may sometimes be referred to as a central opening. In some examples, a portion of the reinforcement structure 111 included in the sole assembly 106 may be exposed through the first opening 185*a*. In some examples, a portion of the lower layer 130 of the midsole 115 may additionally be exposed through the first opening 185*a*.

According to another example, a second opening 185*b*, which may sometimes be referred to as a medial opening, may be defined along a portion of the medial perimeter of the bottom surface 127 of the outsole 116, and may extend into the medial extension 148*a* of the outsole 116. For instance, the second opening 185*b* may generally align with the medial wing 133 of the reinforcement structure 111 included in the sole assembly 106, a portion of which may be exposed through the second opening 185*b*. A portion of the bridge 122 may additionally be exposed through the second opening 185*b*, as shown in FIG. 1C.

According to another example, a third opening 185*c*, which may sometimes be referred to as a lateral opening, may be defined along a portion of the lateral perimeter of the bottom surface 127 of the outsole 116, and may extend into the lateral extension 148*b* of the outsole 116. For instance, the third opening 185*c* may generally align with the lateral wing 144 of the reinforcement structure 111 included in the sole assembly 106, a portion of which may be exposed through the third opening 185*c*. A portion of the bridge 122 may additionally be exposed through the third opening 185*c*, as also shown in FIG. 1C.

As described above with reference to FIGS. 1A-1C, 2A-2C, 3A, and 3C, in some examples, the reinforcement structure 111 may be disposed between the midsole 115 and the outsole 116. In some examples, the reinforcement structure 111 and the outsole 116 may be fabricated as a co-molded assembly and then aligned and coupled to the midsole 115. In one example, the reinforcement structure 111 may be cut from a sheet of material, molded into shape, and then placed in a TPU mold, where TPU resin may flow around the reinforcement structure 111 to produce a more rigid structure and connection to the outsole 116. In another example, the outsole 116 may be formed and the reinforcement structure 111 may be cut, formed, and then aligned and attached to the outsole 116 in the defined cavity configured to receive the reinforcement structure 111. According to an example, the midsole 115 can be molded as a separate piece and then joined to a top surface (not shown) of the outsole 116 by stitching, adhesives, or other suitable means using standard techniques known in the art. For example, the midsole 115 can be heat-pressed and bonded to the top surface of the outsole 116 and reinforcement structure 111 assembly. In some examples, the midsole 115 can be molded using a 'two-shot' molding method. The sole assembly 106 may be attached to the upper 104 at a bite line 124 (shown in FIGS. 1A and 1B). Prior to attachment to the sole assembly 106, the upper 104 may be pulled onto a last, and a lasting board may be attached to the upper 104 with an adhesive. The lasting board may then be attached to the sole assembly 106 with an adhesive for producing the shoe 100. It should be understood that other sole characteristics can be used in the shoe 100 constructions of this disclosure can be used without departing from the spirit and scope of this technology.

In some examples, an insole (not shown), which may be worn inside the shoe 100, may be designed to provide cushioning or comfort for the wearer of the shoe 100. The insole may be above the outsole 116 when in use. In some embodiments, the insole may be designed to provide support. The insole may be flexible, semi-rigid, or rigid. In some examples, the insole may be removable.

As mentioned above, in other examples, and as shown in FIGS. 4A-4C, 8, and 10, the bridge 122 of the reinforcement structure 111 may be at least partially embedded within the midsole 115. According to one example, the reinforcement structure 111 may be disposed between the upper layer 128 and the lower layer 130 of the midsole 115. In this example, a cavity or nesting area may be formed on one or both of: an upper surface of the lower layer 130 and a lower surface of the upper layer 128 that may be used to position the reinforcement structure 111 between the lower layer 130 and the upper layer 128. For example, the cavity or nesting area may be a recessed area configured to receive the reinforcement structure 111, similar to the cavity defined in the lower surface of the lower layer 130 of the midsole 115 and in the lower sidewalls 156 comprising the plurality of nesting areas 169, 171, 173 that may be configured to receive the reinforcement structure 111.

When the reinforcement structure 111 is disposed between the midsole 115 and the outsole 116 (the first example as shown in FIGS. 1A-1C, 2A-2C, and 3A-3C), the reinforcement structure 111 may be in a relatively far position (e.g., a distance in range of approximately 12 to 16 mm) from the wearer's foot (e.g., top of the insole or footbed). That is, the reinforcement structure 111 may be located relatively close to the ground. Alternatively, when the reinforcement structure 111 is disposed between lower layer 130 and the upper layer 128 of the midsole 115 (the second example as shown in FIGS. 4A-D, 8, and 10), the reinforcement structure 111 may be in a relatively close position (e.g., a distance in the range of about 2 to about 6 mm) to the wearer's foot (e.g., top of the insole or footbed). That is, the reinforcement structure 111 may be located relatively far from the ground as compared to the first example.

By positioning the reinforcement structure 111 closer to or farther away from the wearer's foot, and thus, closer to or farther away from a natural bending axis of the foot, the area moment of inertia of the reinforcement structure 111 may be adjusted (e.g., according to a parallel axis theorem described below). In other words, the bending resistance of the reinforcement structure 111 may be controlled by where the reinforcement structure 111 is located in relation to a distance to/from the wearer's foot (e.g., with respect to the flexion bending axis and the extension bending axis of the foot).

In general, the moment of inertia of an area is a geometrical property which reflects how the area's points are distributed with regard to an arbitrary axis. The moment of inertia of the area may be calculated with respect to a reference axis, such as X or Y, that is normally a centroid or neutral axis. For standard shapes, such as a rectangle, the moment of inertia of an area may be calculated by the formula:

$$I = \frac{1}{12}bh^3,$$

where B is the base (horizontal) and H is the height (vertical) of the object. In an example of a rectangular cross-section, the bending may occur about the X axis, which is a centroid axis. For more complex shapes having multiple cross-sectional areas, such as an I-Beam, the parallel-axis theorem can be used to find the area moment of inertia. For example, an object may be divided into multiple simple cross-sectional areas. The parallel-axis theorem states the moment of inertia for an area about an axis is equal to its moment of inertia about a parallel axis passing through the area's centroid plus the product of the area and the square of the perpendicular distance between the axes. Using this theorem, the individual area moments of inertia for each of the three rectangular areas in an I-beam can be calculated with respect to one common axis of bending, and summated to determine the total area moment of inertia for the I-beam. The parallel axis theorem indicates that as the distance of an area from the bending axis increases, its contribution to the magnitude of the area moment of inertia also increases.

Thus, when the reinforcement structure 111 is positioned closer to the foot (e.g., and the flexion bending axis of the foot), such as in the second example where the reinforcement structure is disposed in the midsole 115, then the area moment of inertia may be lower and the reinforcement structure 111 may be easier to bend (i.e., there may be less bending-resistance). Alternatively, when the reinforcement structure 111 is positioned farther away from the foot (e.g., and the flexion bending axis of the foot), such as in the first example where the reinforcement structure is disposed between the midsole 115 and the outsole 116, then the area moment of inertia may be increased. Thus, in the first example, the reinforcement structure 111 may be able to resist dorsal flexion to a greater extent, the midsole sidewalls 156 may be reinforced, and the midsole 115 may be more rigid in comparison to the second example, where the reinforcement structure is disposed in the midsole 115.

As mentioned above, in some examples, the distance $D_B$ the bridge 122 may extend within the sole assembly 106 may vary, where the distance $D_B$ may be measured generally along the longitudinal centerline $C_s$ 151 axis of the sole assembly 106 and the first axis Y of the reinforcement structure 111 from a front-most (or a most-anterior) point of the bridge 122 to a back-most (or a most-posterior) point of the bridge 122. For example, a first example distance $D_{B1}$ (FIG. 3B) the bridge 122 may range from approximately 10-18% of the length $L_s$ of the sole assembly 106. For example, for an average adult male shoe size, the first example distance $D_{B1}$ the bridge 122 may range from approximately 31-60 mm within a sole assembly 106 that may be approximately 310-330 mm long ($L_s$) measured from the front-most point to the back-most point of the sole assembly 106. For instance, the first example distance $D_{B1}$ the bridge 122 may be between 40-50 mm.

A longitudinal width of the bridge 122 may be measured along the centerline $C_B$ or in a direction parallel to the centerline $C_B$. For instance, the longitudinal width of the bridge 122 may be the distance between the anterior side $S_2$ of the bridge 122 and the posterior side $S_4$ of the bridge 122 as measured in direction that is substantially perpendicular to the anterior side $S_2$ and/or the posterior side $S_4$. The longitudinal width of the bridge 122 may be between 30-60 mm, 40-50 mm, or 44-48 mm. The longitudinal width of the bridge 122 may be between 5-18% a total length of the shoe into which the reinforcement structure 111 is incorporated.

In some examples, a transverse width of the reinforcement structure 111 may be measured along the midline $M_W$ when the reinforcement structure is in its flat or unformed state. In other examples, the transverse width of the reinforcement structure 111 may be measured along the top surface of the reinforcement structure 111 when the reinforcement structure 111 is in its formed u-shape. The transverse width of the reinforcement structure 111 may be measured from the medial-most point to the lateral-most point of the reinforcement structure 111. In some examples, the transverse width may be between 3 to 5 times the longitudinal width of the reinforcement structure 111. In some examples, the transverse width is approximately in a range of 60 mm to 100 mm.

As an illustrative example, the reinforcement structure 111 may be positioned in the sole assembly 106 such that the intersection of the centerline $C_B$ of the bridge 122 and the midline $M_W$ of the medial and lateral wings of the reinforcement structure 111 may be located in alignment with the longitudinal centerline $C_s$ 151 of the sole assembly 106 at a distance of approximately 30-36% of the total sole assembly 106 length $L_S$ from the most-posterior point of the sole assembly 106. For instance, for an average adult male shoe size, the intersection of $C_B$ and $M_W$ may be located at approximately 95-115 mm from the most-posterior point of the sole assembly 106. Thus, at least the bridge 122 of the reinforcement structure 111 may be positioned at a location in the sole assembly 106 where it may extend between a range of approximately 65-145 mm from the most-posterior point of the sole assembly 106.

Figure 7:
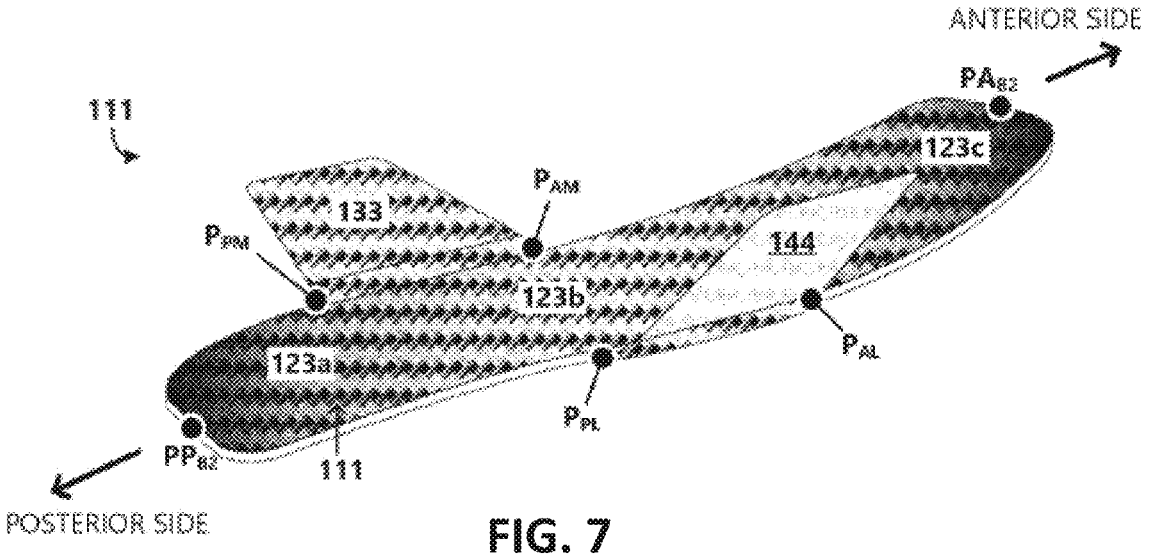
FIG. 7 depicts a perspective view of a reinforcement structure, where the bridge may be configured to extend a second example distance within the sole assembly according to an example.
Figure 8:
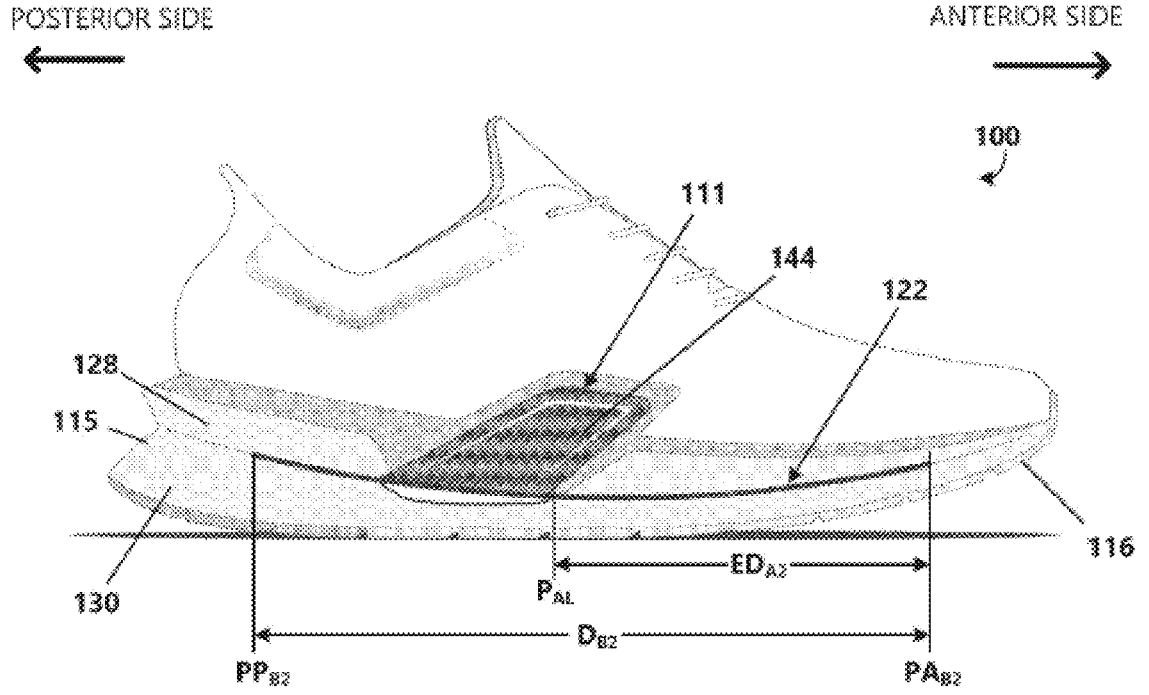
FIG. 8 depicts a lateral side view of an example shoe including the example reinforcement structure of FIG. 7.

With reference now to FIGS. 7 and 8, a second example reinforcement structure 111 is shown that may have a second example distance $D_{B2}$ the bridge 122 may extend within the sole assembly 106. The second example distance $D_{B2}$ may be greater than the first example distance $D_{B1}$. According to an example, the first example distance $D_{B1}$ may include the longitudinal length of a middle portion 123*b* of the bridge 122 (measured along the longitudinal centerline $C_s$ 151 axis from the intersecting point $P_{AL}$ of the anterior side of the lateral wing 144 and the lateral side of the bridge 122 to the intersecting point $P_{PM}$ of the posterior side of the medial wing 133 and the medial side of the bridge 122). For instance, the middle portion 123*b* may be disposed between the medial and lateral wings, and may have a similar or approximately the same profile as the first example bridge 122 of the first example reinforcement structure 111. The posterior portion 123*a* may extend from the posterior side of the middle portion 123*b* toward the posterior side of the sole assembly 106 to a back-most point $PP_{B2}$ along the posterior side of the posterior portion 123*a*, and the anterior portion 123*c* may extend from the anterior side of the middle portion 123*b* toward the anterior side of the sole assembly 106 to a front-most point $PA_{B2}$ along the anterior side of the anterior portion 123*c*.

The second example distance $D_{B2}$ may include the first example distance $D_{B1}$, a first extended distance $ED_{P2}$ (not shown), and a second extended distance $ED_{A2}$. The first extended distance $ED_{P2}$ may include a distance a posterior portion 123*a* of the bridge 122 may extend in the posterior direction. According to an example, the first extended distance $ED_{P2}$ may be measured along the longitudinal centerline $C_S$ 151 axis from the back-most point of the middle portion 123*b* of the bridge 122 (e.g., the intersecting point $P_{PM}$ of the posterior side of the medial wing 133 and the medial side of the bridge 122) to the back-most point $PP_{B2}$ of the bridge 122. The second extended distance $ED_{A2}$ may include a distance an anterior portion 123*c* of the bridge 122 may extend in the anterior direction. According to an example, the second extended distance $ED_{A2}$ may be measured along the longitudinal centerline $C_S$ 151 axis from the front-most point of the middle portion 123*b* of the bridge 122 (e.g., the intersecting point $P_{AL}$ of the anterior side of the lateral wing 144 and the lateral side of the bridge 122) to the front-most point $PA_{B2}$ of the bridge 122.

In an example, the medial wing 133 and lateral wing 144 dimensions and positions may be generally the same as the first example reinforcement structure 111. For instance, the second example reinforcement structure 111 may be configured and positioned such that the medial midpoint $MP_M$ of the medial wing 133 may be located at an approximate range of 25-33% of the total sole assembly 106 length $L_S$ from the most-posterior point of the sole assembly 106 as measured along the longitudinal centerline $C_S$ 151 axis, and the lateral midpoint $MP_L$ of the lateral wing 144 may be located at an approximate range of 30-36% of the total sole assembly 106 length $L_S$ from the most-posterior point of the sole assembly 106 as measured along the longitudinal centerline $C_S$ 151 axis.

According to an example, the second example distance $D_{B2}$ that the bridge 122 may extend within the sole assembly 106 may be the distance from the back-most point $PP_{B2}$ of the bridge 122 to the front-most point $PA_{B2}$ of the bridge 122 measured along the longitudinal centerline $C_S$ 151 axis. According to one example, the second example bridge 122 may be positioned so that it generally extends approximately 70-95% the length $L_S$ of the sole assembly 106. According to an illustrative example, for an average adult male shoe size, the second example distance $D_{B2}$ the second example reinforcement structure 111 may extend in the sole assembly 106 may range from approximately 225-255 mm.

Figure 9:
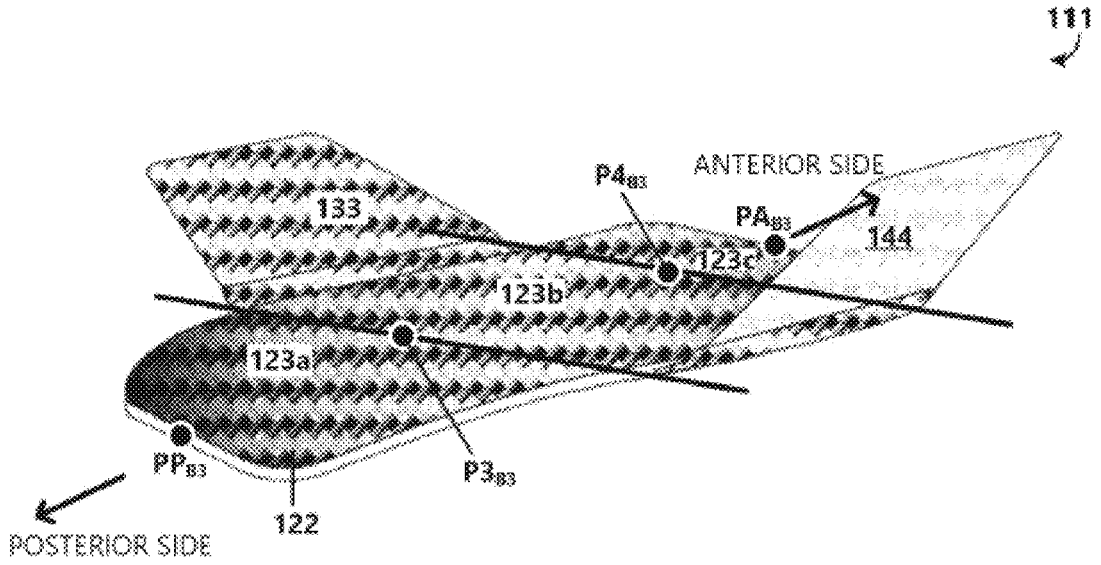
FIG. 9 depicts a perspective view of a reinforcement structure, where the bridge may be configured to extend a third example distance within the sole assembly according to an example.
Figure 10:
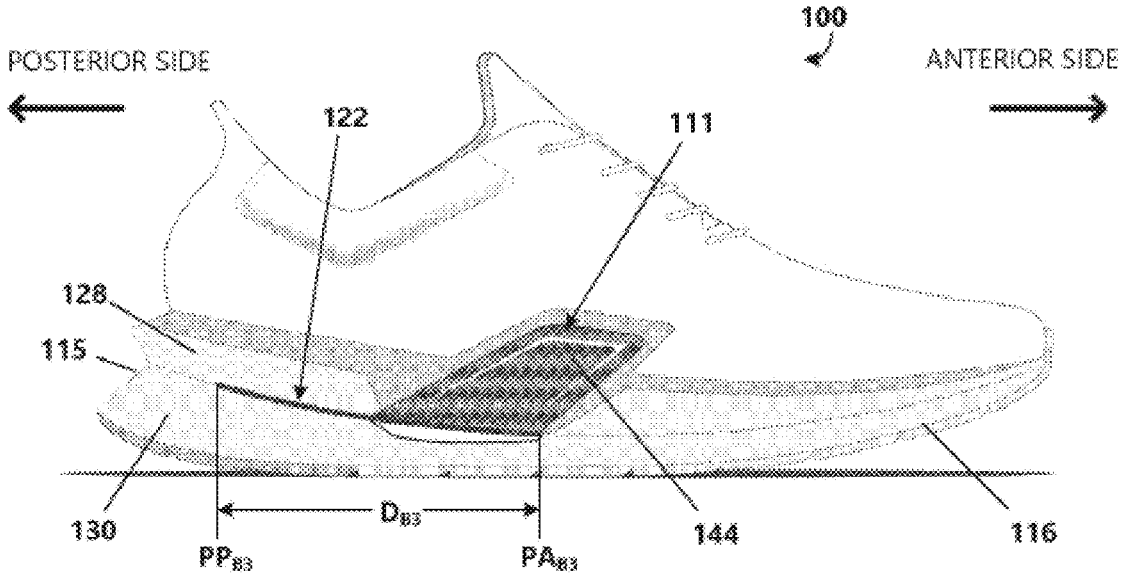
FIG. 10 depicts a lateral side view of an example shoe including the example reinforcement structure of FIG. 9.

With reference now to FIGS. 9 and 10, a third example reinforcement structure 111 is shown that may have a third example distance $D_{B3}$ the bridge 122 may extend within the sole assembly 106. The third example distance $D_{B3}$ may be greater than the first example distance $D_{B1}$ and less than the second example distance $D_{B2}$. In an example, the medial wing 133 and lateral wing 144 dimensions and positions may be generally the same as the first and second example reinforcement structure 111. For instance, the third example reinforcement structure 111 may be configured and positioned such that the medial midpoint $MP_M$ of the medial wing 133 may be located at an approximate range of 25-33% of the total sole assembly 106 length $L_S$ from the most-posterior point of the sole assembly 106 as measured along the longitudinal centerline $C_S$ 151 axis, and the lateral midpoint $MP_L$ of the lateral wing 144 may be located at an approximate range of 30-36% of the total sole assembly 106 length $L_S$ from the most-posterior point of the sole assembly 106 as measured along the longitudinal centerline $C_S$ 151 axis.

As shown in FIG. 9, the bridge 122 of the third example reinforcement structure 111 may include a posterior portion 123*a*, a middle portion 123*b*, and an anterior portion 123*c*, where, similar to the second example reinforcement structure 111, the middle portion 123*b* may be disposed between the medial and lateral wings and may have a similar or approximately the same profile as the bridge 122 of the first example reinforcement structure 111. The posterior portion 123*a* may extend from the posterior side of the middle portion 123*b* toward the posterior side of the sole assembly 106 to a back-most point $PP_{B3}$ along the posterior side of the posterior portion 123*a*, and the anterior portion 123*c* may extend from an anterior side of the middle portion 123*b* to a front-most point $PA_{B3}$ along the anterior side of the anterior portion 123*c*.

The third example distance $D_{B3}$ may include the first example distance $D_{B1}$, a first extended distance $ED_{P3}$ (not shown), and a second extended distance $ED_{A3}$ (not shown). The first extended distance $ED_{P3}$ may include a distance that a posterior portion 123*a* of the bridge 122 may extend in the posterior direction. According to an example, the first extended distance $ED_{P3}$ may be measured along the longitudinal centerline $C_S$ 151 axis from the back-most point of the middle portion 123*b* of the bridge 122 (e.g., the intersecting point $P_{PM}$ of the posterior side of the medial wing 133 and the medial side of the bridge 122) to the back-most point $PP_{B3}$ of the bridge 122. The second extended distance $ED_{A3}$ may include a distance that an anterior portion 123*c* of the bridge 122 may extend in the anterior direction. According to an example, the second extended distance $ED_{A3}$ may be measured along the longitudinal centerline $C_S$ 151 axis from the front-most point of the middle portion 123*b* of the bridge 122 (e.g., the intersecting point $P_{AL}$ of the anterior side of the lateral wing 144 and the lateral side of the bridge 122) to the front-most point $PA_{B3}$ of the bridge 122. That is, the third example distance $D_{B3}$ may be the distance from the back-most point $PP_{B3}$ of the bridge 122 to the front-most point $PA_{B3}$ of the bridge 122 measured along the longitudinal centerline $C_S$ 151 axis. According to one example, the third example bridge 122 may be positioned so that it generally extends approximately 25-70% the length $L_S$ of the sole assembly 106. According to an illustrative example, for an average adult male shoe size, the third example distance $D_{B3}$ the third example reinforcement structure 111 may extend in the sole assembly 106 may range from approximately 60-125 mm.

According to an aspect, rigidity and torsional stability versus forefoot flex of the midsole 115 may be inversely affected relative to the distance $D_B$ the reinforcement structure bridge 122 may extend within the sole assembly 106. For example, the first example bridge 122, such as in the examples shown in FIGS. 1A-1C, 2A-2C, 3A-3C, and 5A, may provide a first rigidity level, a first torsional stability level, and a first forefoot flex level. The second example bridge 122, such as in the examples shown in FIGS. 7 and 8, may extend farther within the sole assembly 106, and thus, may have a higher rigidity level and torsional stability level, but a lower forefoot flex level than the first example bridge 122.

In some examples, the varying levels of rigidity, torsional stability, and forefoot flex that can be achieved through variation of the dimensions of the bridge 122 of the reinforcement structure 111 may be considered when determining placement of the reinforcement structure 111 in the shoe 100, or vice versa. For example, as described above, positioning the reinforcement structure 111 between the midsole 115 and outsole 116, which is farther away from the golfer's foot than if the reinforcement structure 111 were disposed between the upper layer 128 and the lower layer 130 of the midsole 115, may increase rigidity and torsional stability. Alternatively, disposing the reinforcement structure 111 between the upper layer 128 and lower layer 130 of the midsole 115 may increase forefoot flex, but decrease rigidity and torsional stability. Accordingly, in some examples, different sizes of bridges 122 may be used based on placement of the reinforcement structure 111 in the shoe 100 to achieve one or a combination of a desired rigidity level, torsional stability level, and forefoot flex.

According to an aspect, along with traction, the sole assembly 106 of the golf shoe 100 may provide stability and comfort for the wearer's foot. For instance, many golf courses offer golfers the choice of driving an electric-powered cart over or walking the course. Some golfers prefer to walk the entire course. Even golfers, who prefer to drive carts, will walk a considerable distance during their round of play. Depending upon the length of the course, speed of play, and other factors, a golfer may walk a few miles in a round. Thus, a golf shoe 100 needs to be comfortable to wear and allow a golfer to walk naturally and freely. That is, the shoe 100 needs to support the foot and yet it also needs to be flexible. The golfer must be able to address the ball, make a swing, walk comfortably on the course, and do other golf-specific actions such as crouching down to line-up a putt.

Two directions of foot movement that may be considered in relation to various golf movement: include dorsiflexion and plantar flexion. In general, dorsiflexion is the action of raising the foot upwards toward the shin. That is, the foot is flexing in the dorsal or upward direction. The muscles and tendons located in the front of the foot and leg that are passed into the ankle joint are used to move the foot in the dorsiflexion direction. In general, the foot moves upwards in the range of about 10 to about 30 degrees. On the other hand, plantar flexion is the action of moving the foot in a downward direction towards the ground. The muscles and tendons located in the back and inside of the foot and leg that are passed into the ankle joint are used to move the foot in the plantar flexion direction. In general, the foot moves upwards in the range of about 20 to about 50 degrees.

According to an example, a walking cycle may include various stages that each foot may undergo. A first stage, which may be referred to as a heel strike phase, may begin when the heel first touches the ground generating a transient 1-1.5 times body weight impact force, and may last until the whole foot is on the ground. For example, the golfer may slightly dorsiflex the foot, and the heel may strike the ground surface first as the golfer starts their walking gait. Accordingly, as the golfer is walking, the heel area of the outsole 116 of the sole assembly 106, corresponding to the heel region of the golfer's foot as described above, may contact the ground.

A second stage of the walking cycle, which may be referred to as an early flatfoot stage, may begin when the person's whole foot is on the ground as the golfer transfers their weight from the heel to the toes. For example, the golfer's arch may be flattened and the foot may serve as a shock absorber, helping to cushion the force of the golfer's body weight as the foot presses downwardly. As described above, the midsole 115 may comprise an upper layer 128 and a lower layer 130, where the upper layer 128 may be made of a relatively soft and flexible material, and the lower layer 130 may be made of a relatively firm material. Accordingly, the midsole 115 of the shoe 100 may provide the golfer comfort serving as a shock absorber to help cushion the force of the golfer's body weight as the foot presses downwardly. The end of the early flatfoot stage may occur when the golfer's center of gravity passes over top of the foot.

A third stage of the walking cycle, which may be referred to as a late flatfoot stage, may begin when the golfer's center of gravity has passed the neutral position. The late flatfoot stage may end when the golfer's heel (e.g., and the heel area of the outsole 116) lifts off the ground. During the late flatfoot phase, the foot may shift from serving as a flexible shock absorber to acting as a rigid lever that can serve to propel the golfer forward. Accordingly, both a level of comfort and a level of rigidity in the sole assembly 106 of the shoe 100 may be desired.

In a fourth stage, which may be referred to as a heel rise stage, may begin when the golfer's heel (e.g., and the heel area of the outsole 116) begins to leave the ground. For example, the golfer's foot may plantarflex, and the golfer's foot may function as a rigid lever to move the body forward. During this phase of walking, the forces that go through the foot may be increased (e.g., 1-1.2 times the person's body weight) due to the foot creating a lever arm (centered on the ankle), which may magnify body weight forces. Accordingly, both a level of comfort, a level of rigidity, and additionally, a level of forefoot flex in the sole assembly 106 of the shoe 100 may be desired.

In a fifth and last stage of the stance phase may be referred to as a toe off stage. The toe off stage may begin as the golfer's toes, and thus the shoe 100, leaves the ground. For example, the foot may continue to plantarflex and push off the ground until the golfer's foot is in the air. According to an aspect, the sole assembly 106 of the golf shoe 100 of the present disclosure may have various benefits and advantageous features. In one example, the sole assembly 106 may provide good comfort and stability, and yet also provide good forefoot flexibility so the golfer can perform his/her natural walking actions easily and comfortably.

When walking and playing golf, there may be other numerous and varied forces acting on the foot and the different parts of the shoe 100. For example, downward and upward forces can act on the midsole 115 during a golf swing. For example, during normal golf play, a golfer may make shots with a wide variety of clubs. As the golfer swings a club when making a shot and transfers their weight, their foot and shoe 100 may absorb tremendous forces. For example, when a golfer is first planting their feet before beginning a club swinging motion (e.g., when addressing the ball), their weight may be evenly distributed between their lead and trail feet. As the golfer begins their backswing, their weight may shift primarily to their trail foot. Significant pressure may be applied to the trail foot at the beginning of the downswing as the golfer drives power off of the trail foot to generate increased swing speeds. As the golfer follows through with their swing and drives the ball, their weight may be transferred from the trail foot to the lead foot. During the swinging motion, there may be some pivoting at the trail and lead feet, but this pivoting motion may be controlled and not substantially move or slip when making the shot. Thus, it may be important that the shoes 100 provide good stability during the golf swing. The golfer may need a stable platform so that they can maintain their balance as they perform their swinging action. Good foot traction may also be important during the golf shot cycle.

Additionally, as the golfer makes their backswing, the trail foot presses down on the medial forefoot and heel regions, and, as the back knee remains tucked in, the trail foot creates torque with the ground to resist external foot rotation. Following through on a shot, the golfer's lead shoe rolls from the medial side (inside) of their lead foot toward the lateral side (outside) of the front foot. Meanwhile, their trail shoe may simultaneously flex to the forefoot and internally rotate as the heel lifts.

In some examples, the forces acting on the midsole 115 during a golf swing may increase relative to swing speed. Thus, some golfers, such as more experienced tour players, who may have golf wings that range in speed from 100-120 miles per hour, may need increased stability from a shoe midsole 115 to help support these additional forces.

One drawback with some athletic golf shoes is these shoes may help provide the golfer with good cushioning, forefoot flex, and other comfort characteristics; however, there may be a loss in rigidity of the midsole 115, which may not provide a stable platform for the golfer when he/she maker their swing. For example, a softer midsole 115 may decrease the amount of support to prevent collapse of the shoe's suspension during a golf swing. Thus, the sole assembly 106 of the present disclosure includes aspects that can provide a high level of flexibility and yet also provide high stability. A sole assembly 106 comprising the reinforcement structure 111 mentioned above may help provide additional stability. For example, the reinforcement structure 111 may aid the shoe 100 in being able to hold and support the medial and lateral sides of the golfer's foot as they shift their weight while making a golf shot. Thus, the golfer can stay balanced as the follow through the complete swinging motion of the club. According to an example, the reinforcement structure 111 may further provide greater bending stiffness in the midfoot area 142 of the sole assembly 106. In an example, the reinforcement structure 111 may help provide the shoe 100 with additional mechanical strength and structural integrity and does not allow excessive twisting or turning of the shoe. Thus, the shoe 100 may provide improved torsional stability. At the same time, the shoe 100 may have retain forefoot flexibility so the golfer is able to walk and play the course and engage in other golf activities comfortably.

In some examples, the asymmetry of the reinforcement structure's U-shape (i.e., the lateral wing 144 angled ($A_L$) toward the midfoot area 142 and the medial wing 133 angled ($A_M$) toward the rearfoot area 140) may further help to naturally align the golfer's swing, and which may help to promote a natural transition to the golfer's driving foot during push off and follow through. In another example, the reinforcement structure 111 may be designed to deform when the golfer shifts their weight, such as onto and off of the driving foot. In some examples, after the downswing and follow through, the elastic potential energy that may be stored as a result of applying force to deform the reinforcement structure 111 may be released as the golfer pushes off the driving foot and the reinforcement structure 111 may spring back to its original shape.

Figure 10A:
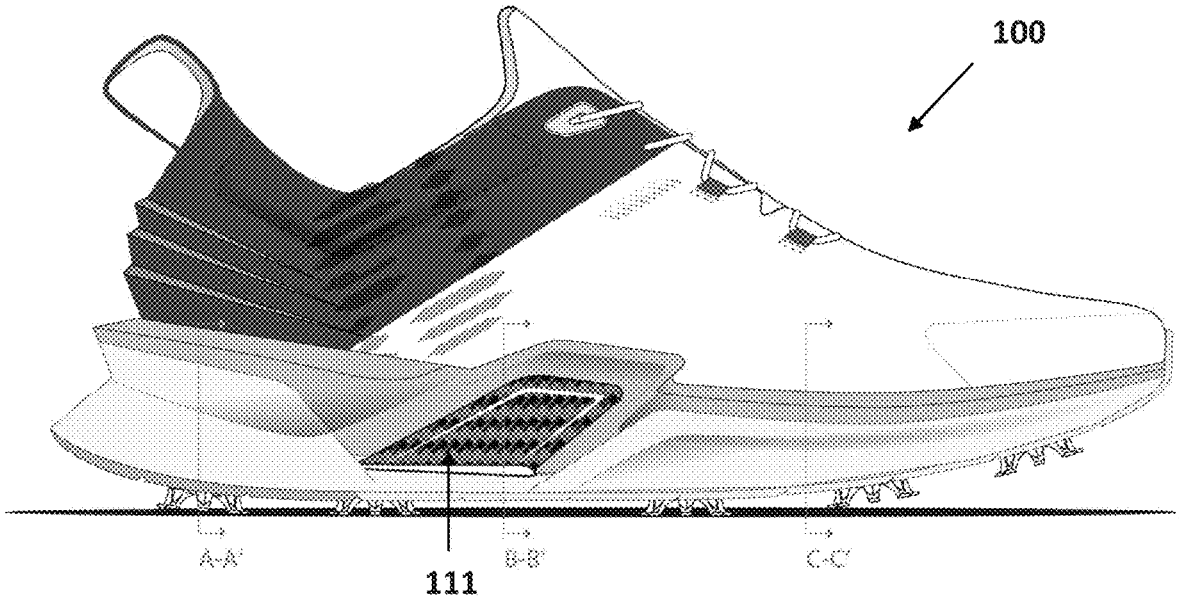
FIG. 10A depicts a lateral side view of another example shoe incorporating a reinforcement structure, in accordance with some embodiments.
Figure 10B:
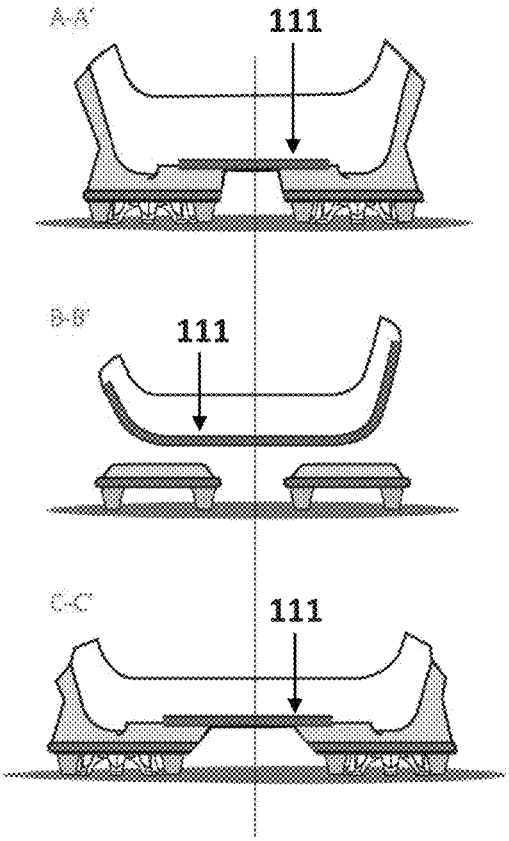
FIGS. 10B and 10C depict various cross sectional views of a reinforcement structure that can be integrated with a shoe, in accordance with some embodiments.

Referring to FIG. 10A, in some embodiments, the golf shoe 100 may comprise a reinforcement structure 111 extending from a rearfoot or heel region of the shoe through a midfoot region of the shoe to a forefoot region of the shoe. As shown in FIG. 10B, in some cases, the reinforcement structure 111 may have a cross-sectional shape or profile that changes or varies along a length of the reinforcement structure 111. In some embodiments, the reinforcement structure 111 may have a first cross-sectional shape or profile in the rearfoot or heel region of the shoe, a second cross-sectional shape or profile in the midfoot region of the shoe, and a third cross-sectional shape or profile in the forefoot region of the shoe.

In some cases, the first cross-sectional shape or profile may comprise a substantially flat or planar shape or profile. In other cases, the first cross-sectional shape or profile may comprise a curved or non-planar shape or profile. In some cases, the first cross-sectional shape or profile may have a same or similar shape or profile as the second and/or third cross-sectional shape or profile. In other cases, the first cross-sectional shape or profile may have a different shape or profile than that of the second and/or third cross-sectional shape or profile.

In some cases, the second cross-sectional shape or profile may comprise a substantially flat or planar shape or profile. In other cases, the second cross-sectional shape or profile may comprise a curved or non-planar shape or profile. In some cases, the second cross-sectional shape or profile may have a same or similar shape or profile as the first and/or third cross-sectional shape or profile. In other cases, the second cross-sectional shape or profile may have a different shape or profile than that of the first and/or third cross-sectional shape or profile.

In some cases, the third cross-sectional shape or profile may comprise a substantially flat or planar shape or profile. In other cases, the third cross-sectional shape or profile may comprise a curved or non-planar shape or profile. In some cases, the third cross-sectional shape or profile may have a same or similar shape or profile as the first and/or second cross-sectional shape or profile. In other cases, the third cross-sectional shape or profile may have a different shape or profile than that of the first and/or second cross-sectional shape or profile.

In some cases, one or more cross-sections of the reinforcement structure may comprise a symmetric shape or profile. In other cases, one or more cross-sections of the reinforcement structure may comprise an asymmetric shape or profile. In some alternative cases, the reinforcement structure may comprise a cross-section with an asymmetric shape or profile and another cross-section with a symmetric shape or profile.

Figure 10C:
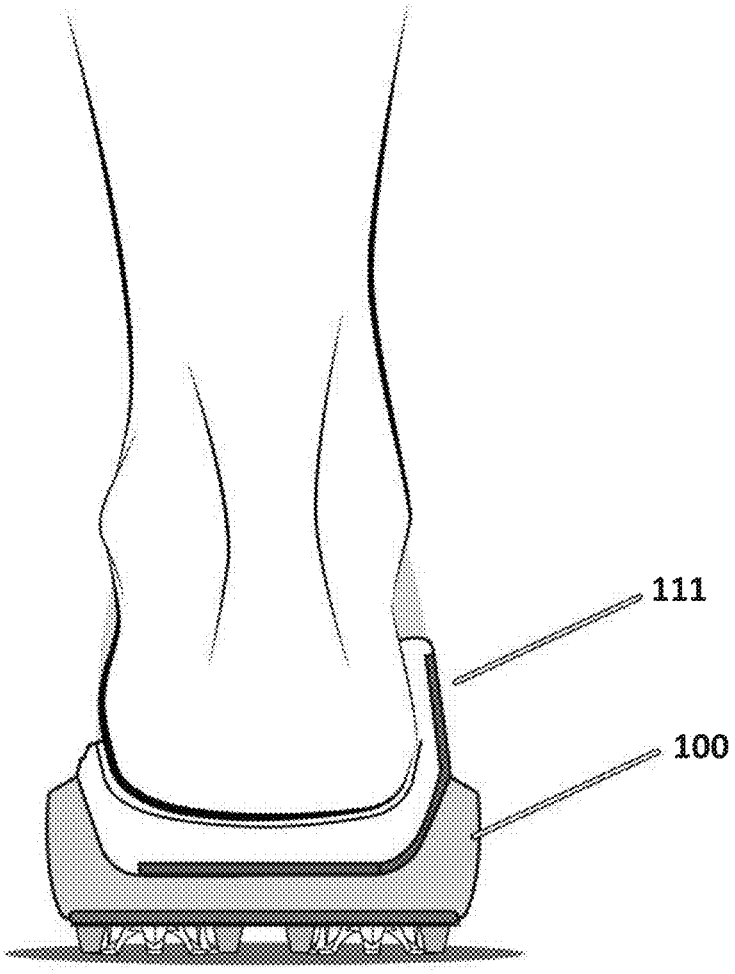

FIG. 10C illustrates another exemplary cross-sectional shape or profile for a reinforcement structure 111 that can be integrated with any of the shoes 100 of the present disclosure. In some embodiments, the cross-sectional shape or profile may correspond to a vertical cross-section of any portion of the reinforcement structure 111. In some embodiments, the cross-sectional shape or profile may correspond to a vertical cross-section of the reinforcement structure 111 in a heel or rearfoot region, a midfoot region, and/or a forefoot region of the reinforcement structure 111.

In some embodiments, the cross-sectional shape or profile of the reinforcement structure 111 may be uniform across one or more sections, portions, or regions of the reinforcement structure. In other embodiments, the cross-sectional shape or profile of the reinforcement structure 111 may vary or change along or across different sections, portions, or regions of the reinforcement structure.

In some embodiments, the cross-sectional shape or profile of the reinforcement structure 111 may be asymmetrical. In some embodiments, the cross-sectional shape or profile of the reinforcement structure 111 may include one or more side portions that are asymmetric about a line or a plane bisecting the medial and lateral sides of the reinforcement structure.

In some embodiments, the reinforcement structure 111 may have an asymmetric configuration. In some cases, the asymmetric configuration may include a configuration in which the reinforcement structure 111 includes one of a lateral support or a medial support. In some cases, the asymmetric configuration may include a configuration in which the reinforcement structure 111 includes a lateral support but no medial support. In some cases, the asymmetric configuration may include a configuration in which the reinforcement structure 111 includes a medial support but no lateral support.

In some embodiments, the reinforcement structure 111 may include a lateral support and a medial support arranged in an asymmetrical configuration. In some cases, the asymmetrical configuration may include a configuration in which the lateral and medial supports have a different size, shape, or cross-sectional profile. In some cases, the asymmetrical configuration may include a configuration in which the lateral and medial supports have a different orientation or support different regions along the lateral and medial sides of the subject's foot.

In some cases, a first side of the reinforcement structure may extend upwards along one of the medial or lateral side of the shoe by a first length, and a second side of the reinforcement structure may extend upwards along the other of the medial or lateral side of the shoe by a second length that is different than the first length. In some cases, the first side of the reinforcement structure may extend in a first direction along one of the medial or lateral side of the shoe, and the second side of the reinforcement structure may extend along the other of the medial or lateral side of the shoe in a second direction that is different than the first direction.

Figure 10D:
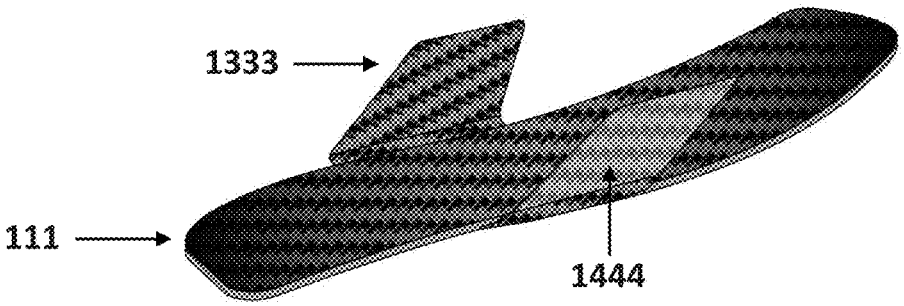
FIGS. 10D-10F schematically illustrate different examples of reinforcement structures that can be integrated with a shoe, in accordance with some embodiments.
Figure 10E:
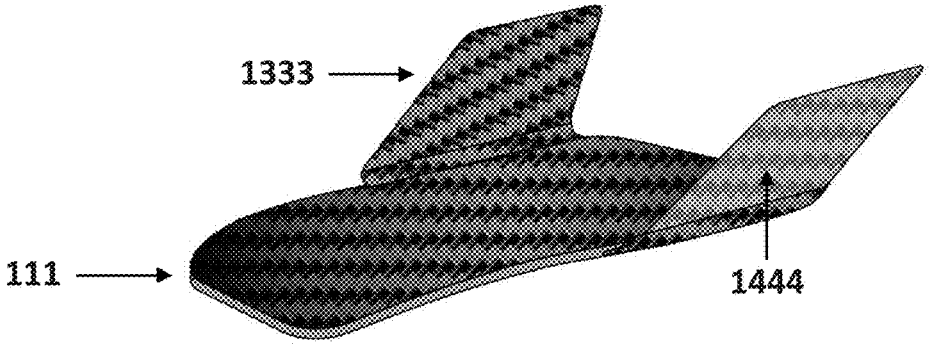
Figure 10F:
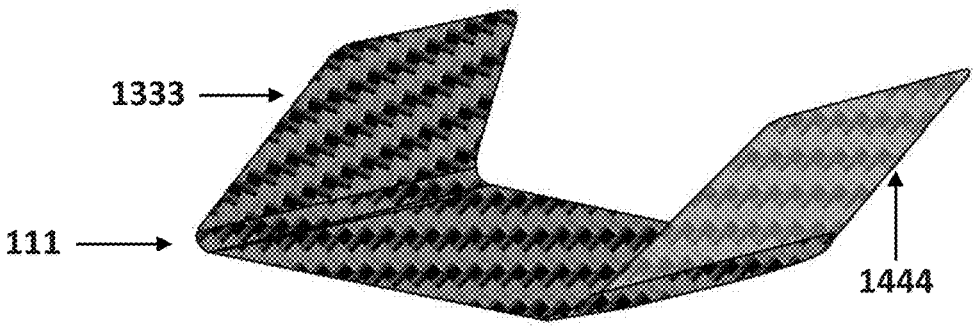

In some alternative embodiments, the cross-sectional shape or profile of the reinforcement structure 111 may be symmetrical. In some embodiments, the cross-sectional shape or profile of the reinforcement structure 111 may include one or more side portions that are symmetric about a line or a plane bisecting the medial and lateral sides of the reinforcement structure. In some embodiments, the reinforcement structure 111 may include a medial support 1333 and a lateral support 1444 arranged in a symmetrical configuration (e.g., as shown in FIGS. 10D-10F). In some cases, the symmetrical configuration may include a configuration in which the lateral and medial supports have a same or similar size, shape, or cross-sectional profile. In some cases, the symmetrical configuration may include a configuration in which the lateral and medial supports have a same or similar orientation or support a same or similar region along the lateral and medial sides of the subject's foot. In some cases, the same or similar region may include, for example, a heel or rearfoot region, a midfoot region, and/or a forefoot region of the subject's foot.

In some embodiments, the reinforcement structure may include a middle portion. In some cases, the middle portion may correspond to a portion of the reinforcement structure that extends transversely between a medial side and a lateral side of the shoe. In some cases, the middle portion may extend longitudinally between a heel region and a midfoot region and/or a forefoot region of the shoe. In some cases, the middle portion may extend between a first end and a second end of the medial or lateral support. In some cases, the middle portion may extend beyond the first end and/or the second end of the medial or lateral support.

In some embodiments, the middle portion may comprise a planar or substantially flat surface or profile. In some embodiments, the middle portion may comprise a non-planar or curved surface or profile. In some embodiments, the middle portion may comprise a concave curvature. In some embodiments, the middle portion may comprise a convex curvature. In some embodiments, a first region of the middle portion may comprise a first curvature or contour, and a second region of the middle portion may comprise a second curvature or contour that is different than the first curvature or contour. In some embodiments, the middle portion may have a curvature or contour corresponding to a shape or a profile of a bottom surface or arch section of a subject's foot. In other embodiments, the middle portion may not or need not have a curvature or contour corresponding to the shape or profile of the bottom surface or arch section of the subject's foot.

In some embodiments, the reinforcement structure may include one or more side portions extending from the middle portion of the reinforcement structure. In some embodiments, the one or more side portions may correspond to a medial support and/or a lateral support of the reinforcement structure. In some embodiments, the one or more side portions may be configured to extend along a lateral side and/or a medial side of the shoe. In some embodiments, the one or more side portions may be configured to extend to or towards a rearfoot region, a midfoot region, and/or a forefoot region of the shoe.

In some non-limiting embodiments, the one or more side portions of the reinforcement structure may comprise a planar or substantially flat surface or profile. In other non-limiting embodiments, the one or more side portions of the reinforcement structure may comprise a non-planar or curved surface or profile.

In some embodiments, the one or more side portions may comprise a concave curvature. In other embodiments, the one or more side portions may comprise a convex curvature. In some embodiments, a first region of the one or more side portions may comprise a first curvature or contour, and a second region of the one or more side portions may comprise a second curvature or contour that is different than the first curvature or contour. In some embodiments, the one or more side portions may have a curvature or contour corresponding to a shape or a profile of a lateral or medial side of a subject's foot. In other embodiments, the one or more side portions may not or need not have a curvature or contour corresponding to the shape or profile of the lateral or medial side of the subject's foot. In some embodiments, the one or more side portions may have a curvature or contour corresponding to a shape or a profile of an arch region of a subject's foot. In other embodiments, the one or more side portions may not or need not have a curvature or contour corresponding to the shape or profile of the arch region of the subject's foot.

Figure 11:
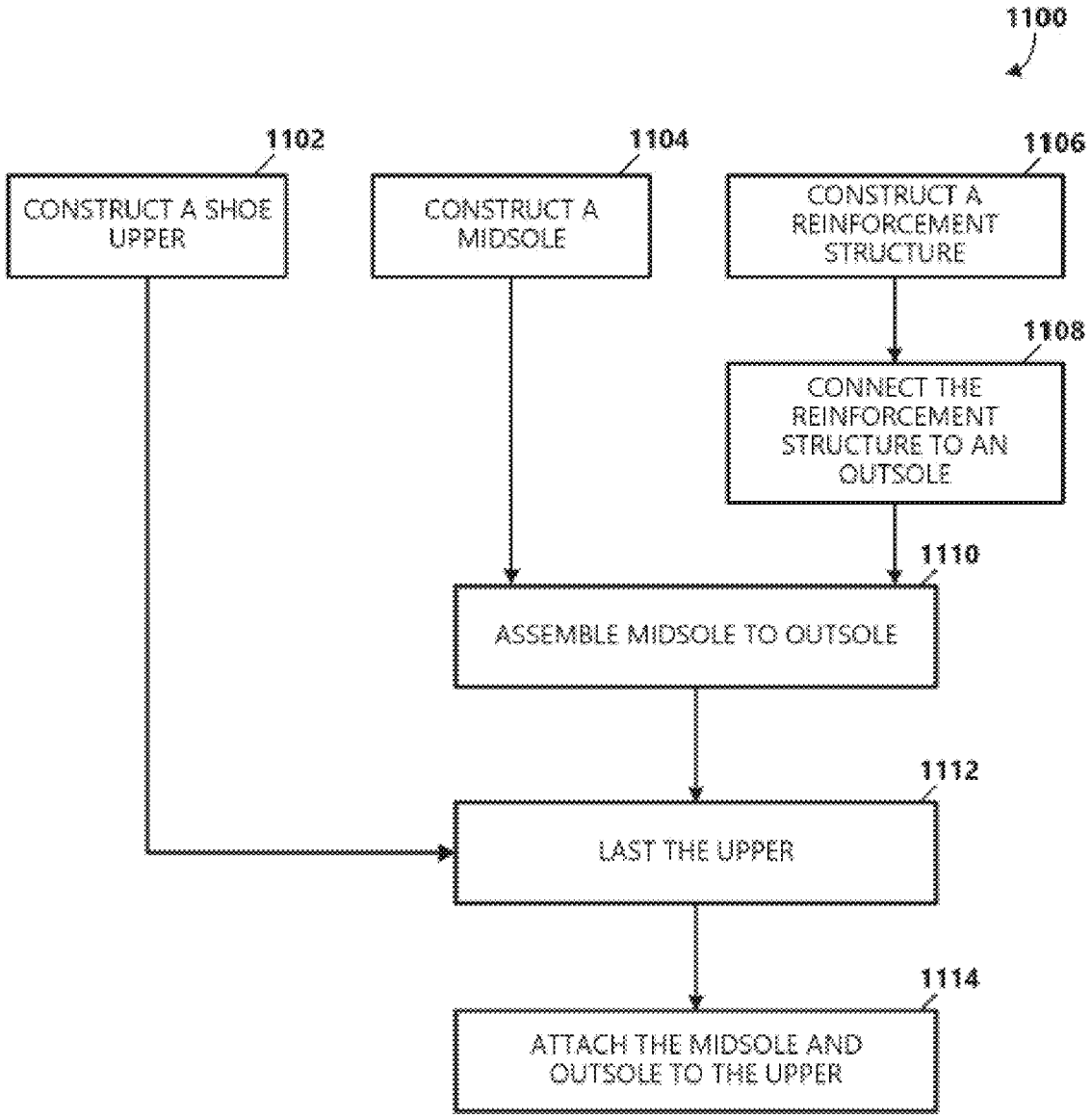
FIG. 11 depicts example operations of a method of making a golf shoe comprising a reinforcement structure according to an embodiment.

FIG. 11 depicts a flow chart having example operations of a method 1100 of making a golf shoe 100 comprising a reinforcement structure 111 according to an embodiment. At OPERATION 1102, an upper 104 may be constructed. As described above, the upper 104 may generally comprise a vamp 108 connected to a quarter 102. In some examples, the upper 104 may further comprise an instep region 117 including a tongue member and, in some examples, an eye stay. In some examples, the quarter 102 may include a heel cup 103. Further, a collar 118 may be defined around an opening 114 for inserting a foot. In some examples, the various parts of the upper 104 may be stitched, glued, or otherwise attached together.

At OPERATION 1104, a midsole may be constructed. According to an example, the midsole 115 may comprise an upper layer 128 and a lower layer 130 formed of different materials or of materials with different densities. In one example, a first material may be placed inside a first mold (e.g., EVA mold) and molded into the upper layer 128, which may then be molded together with a second material in a second (EVA) mold to form a dual-density midsole 115. In other examples, the midsole 115 may be comprised of a single layer of EVA foam.

At OPERATION 1106, a reinforcement structure 111 may be constructed. For example, the reinforcement structure 111 may be constructed of any suitable reinforcing material such as a carbon composite material, fiberglass composite material, TPU composite material, or other material that may provide additional structural rigidity to the shoe 100. The material may be cut into a desired shape (e.g., parallel shape, parallel shape with an extended bridge 122) and molded into a general U shape to form the reinforcement structure 111. An example method for integrating the reinforcement structure 111 with the outsole 116 is described below with reference to the left-hand path illustrated in FIG. 13.

At OPERATION 1108, the reinforcement structure 111 may be connected to an outsole 116. According to an example, the reinforcement structure 111 may be placed inside a third mold (e.g., a TPU mold), where resin (TPU) may flow around the reinforcement structure 111 to create a more rigid structure and connect the reinforcement structure 111 to the outsole 116.

At OPERATION 1110, this reinforcement structure 111 and outsole 116 assembly may be assembled to the midsole 115 that was constructed at OPERATION 1104. For example, the bottom surface of the lower layer 130 of the midsole 115 may be bonded to the top surface of the outsole 116 using adhesives or other attachment techniques.

At OPERATION 1112, the upper 104 constructed at OPERATION 1102 may be lasted, and at OPERATION 1114, the sole assembly 106 may be attached to the upper 104. For example, the board may be bonded to the top surface of the upper layer 128 of the midsole 115, and in some examples, an insole may be inserted into the shoe 100. In some examples, additional steps may be performed at one or more of the above operations to waterproof the shoe 100, inspect the shoe 100, and/or perform other shoe assembly tasks.

Figure 12:
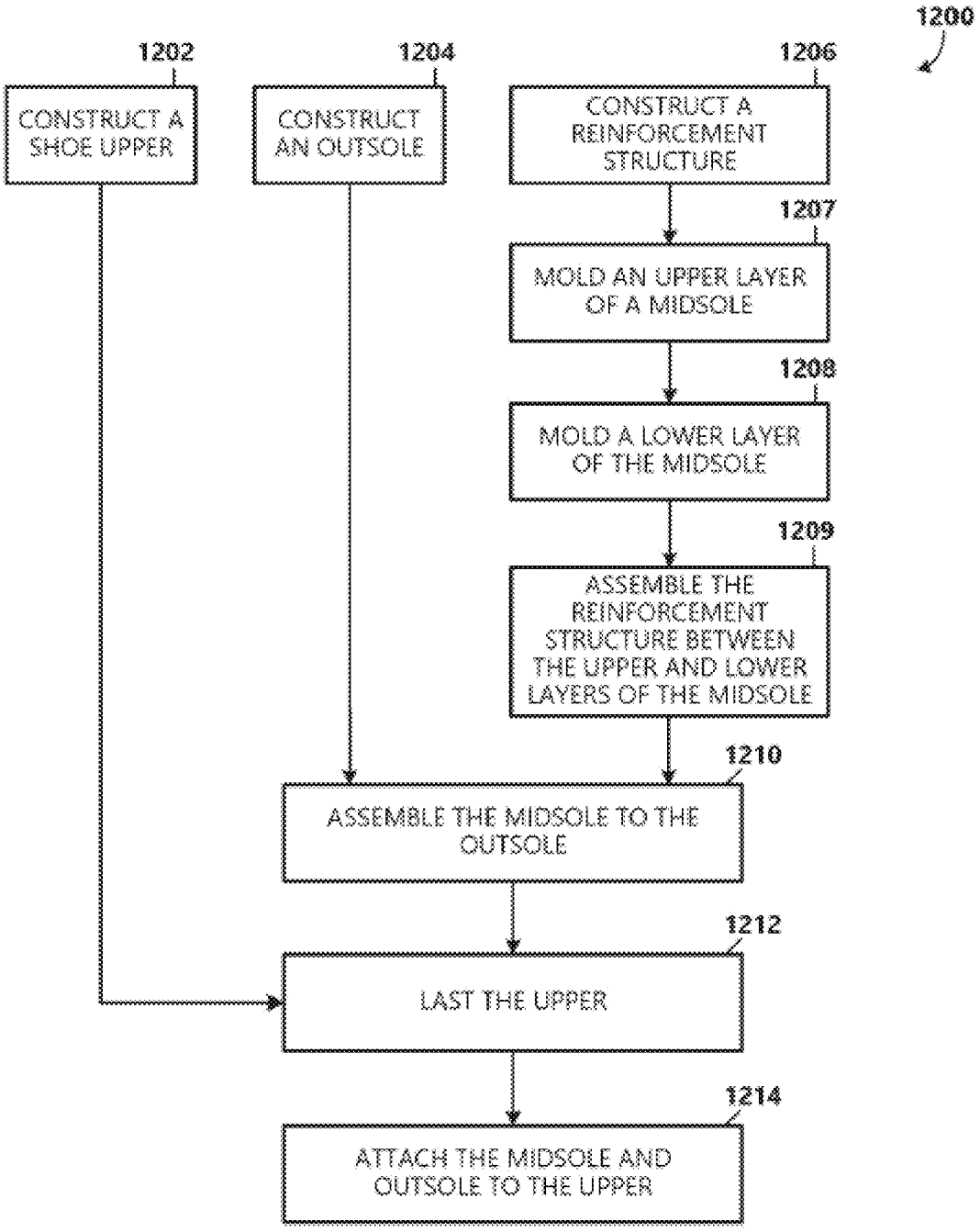
FIG. 12 depicts example operations of a method of making a golf shoe comprising a reinforcement structure according to another embodiment.

With reference now to FIG. 12, a flow chart is illustrated having example operations of a method 1200 of making a golf shoe 100 comprising a reinforcement structure 111 according to another embodiment. For example, the method 1100 described above with reference to FIG. 11 describes a method of making a shoe 100 including a reinforcement structure 111 connected to the outsole 116. The method 1200 described now with reference to FIG. 12 describes a method of making a shoe 100 including a reinforcement structure 111 molded inside the midsole 115.

At OPERATION 1202, an upper 104 may be constructed. OPERATION 1202 may be performed similarly to OPERATION 1102 described in FIG. 11. In some examples, the various parts of the upper 104 may be stitched, glued, or otherwise attached together.

At OPERATION 1204, an outsole 116 may be constructed. For example, a TPU mold may be used to form the outsole 116.

At OPERATION 1206, the reinforcement structure 111 may be constructed. For example, the reinforcement structure 111 may be constructed of any suitable reinforcing material such as a carbon composite material, fiberglass composite material, TPU composite material, or other material that may provide additional structural rigidity to the shoe 100. The material may be cut into a desired shape and molded into a general U shape to form the reinforcement structure 111. An example method for molding the reinforcement structure 111 inside the midsole 115 is described below with reference to the right-hand path illustrated in FIG. 13.

At OPERATION 1207, a first layer of a dual-density midsole 115 may be formed. According to an example, the midsole 115 may comprise an upper layer 128 and a lower layer 130 formed of different materials or of materials with different densities. At OPERATION 1207, a first material may be placed inside a first mold (e.g., EVA mold) and molded into the upper layer 128. In an example, a bottom side of the upper layer 128 may be formed to include a nesting area for the reinforcement structure 111.

At OPERATION 1208, the second layer of the dual-density midsole 115 may be formed. For example, a second material, or the first material having a higher density than the first material used in the first layer, may be placed inside a second (EVA) mold to form the lower layer 130. In an example, a top side of the bottom layer 130 may be formed to include a nesting area for the reinforcement structure 111.

At OPERATION 1209, the reinforcement structure 111 may be assembled between the upper layer 128 and the lower layer 130 of the midsole 115. In some examples, one or more buffing, gluing/cementing and ultraviolet (UV)/heat glue activations may be included in assembling the reinforcement structure 111 between the upper layer 128 and the lower layer 130 of the midsole 115. Additionally, in some examples, a jig or press may be used to force the final assembly together for bonding and cooling.

At OPERATION 1210, the dual-density midsole 115 with the reinforcement structure 111 may be attached to the outsole 116 constructed at OPERATION 1204. For example, the bottom surface of the lower layer 130 of the midsole 115 may be bonded to the top surface of the outsole 116 using adhesives or other attachment techniques.

At OPERATION 1212, the upper 104 constructed at OPERATION 1202 may be lasted.

At OPERATION 1214, the sole assembly 106 may be attached to the upper 104. For example, the board may be bonded to the top surface of the upper layer 128 of the midsole 115, and in some examples, an insole may be inserted into the shoe 100. In some examples, additional steps may be performed at one or more of the above operations to waterproof the shoe 100, inspect the shoe 100, and/or perform other shoe assembly tasks.

Figure 13:
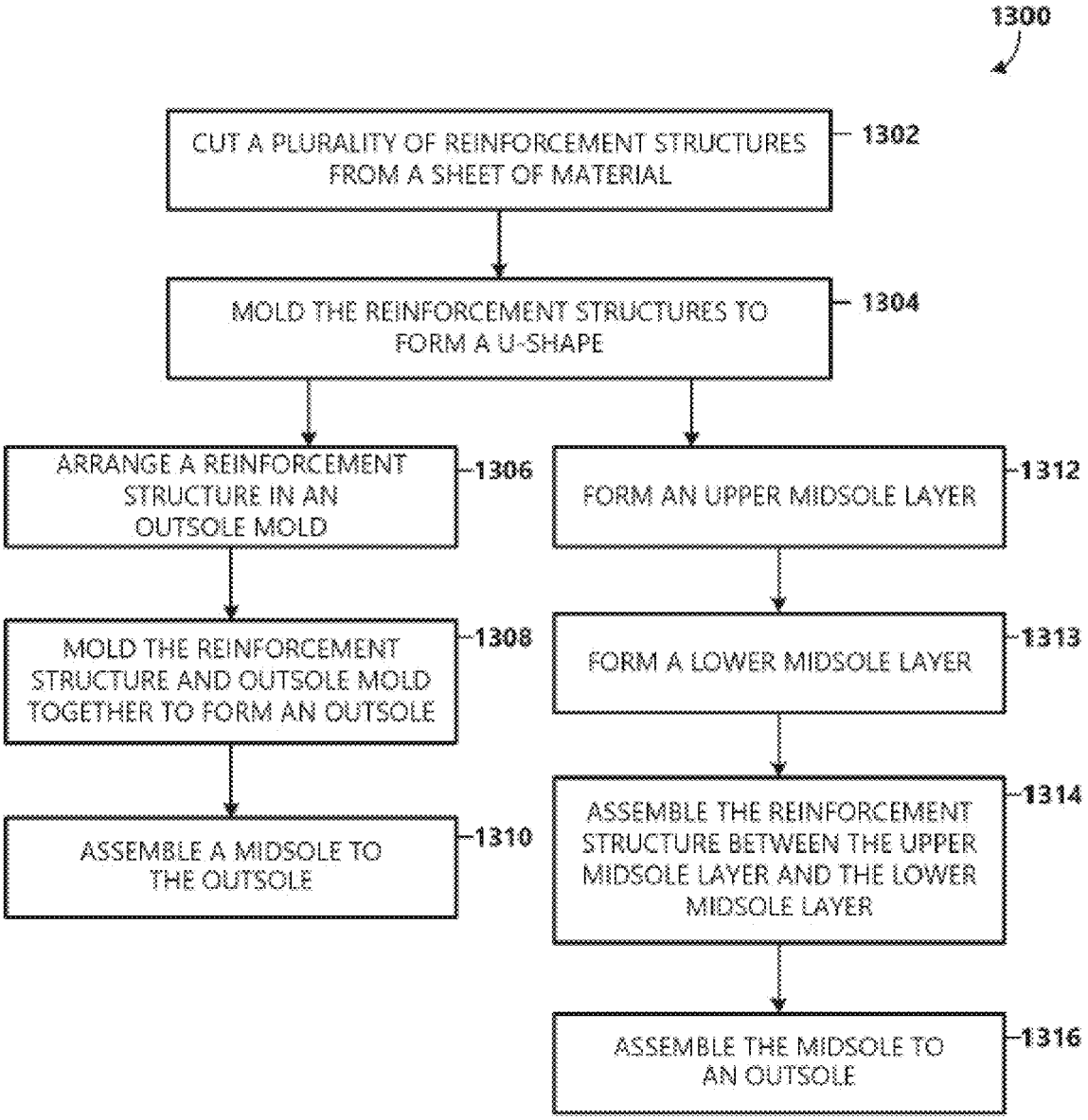
FIG. 13 depicts example operations of a method of constructing a sole comprising a reinforcement structure according to an embodiment.

With reference now to FIG. 13, an example method 1300 is provided for assembling a sole assembly 106 according to an embodiment. At OPERATION 1302, a plurality of reinforcement structures 111 may be cut from a sheet 164 of material, such as was illustrated in FIG. 6. For example, the material may be a carbon composite material, fiberglass composite material, TPU composite material, or other material that may provide additional structural rigidity to the shoe 100. The material may be cut into a desired shape using standard manufacturing cutting methods, such as a water jet, laser jet, die cut, etc. The size of the shape may be dependent on different shoe sizes and/or different reinforcement structure configurations. According to an example, the desired shape may include a parallelogram shape for creating a reinforcement structure 111 that has a bridge 122 that may extend a first example distance $D_{B1}$ within the sole assembly 106. In other examples, the desired shape may include the parallelogram shape in addition to an anterior bridge portion 123*c* and a posterior bridge portion 123*a*, where the bridge 122 may extend a second or third example distance $D_{B2}$,$D_{B3}$ within the sole assembly 106.

At OPERATION 1304, the shapes may be molded into general U shapes having one of various bridge longitudinal widths and/or transverse widths to form a plurality of reinforcement structures 111. The method 1300 may take a left-hand path to OPERATION 1306 for molding the reinforcement structure 111 with the outsole 116, or alternatively, the method 1300 may take a right-hand path to OPERATION 1312 for molding the reinforcement structure 111 inside the midsole.

Following the left-hand path, at OPERATION 1306, in some examples, the reinforcement structure 111 may be placed inside a mold (e.g., a TPU mold), and at OPERATION 1308, resin (TPU) may be injected inside the mold, where the resin may flow around the reinforcement structure 111 to form a more rigid structure and connect the reinforcement structure 111 to the outsole 116. In other examples, the reinforcement structure 111 may be attached to or otherwise integrated with the outsole 116. For instance, the reinforcement structure 111 may be attached to a top surface of the outsole 116, formed into the outsole 116, or attached to a bottom surface of the outsole 116. As described herein, placement of the reinforcement structure 111 may be based on a desired level of bending stiffness, torsion stiffness, and/or cushioning of the shoe 100.

At OPERATION 1310, the bottom surface 131 of the lower layer 130 of the midsole 115 may be bonded to the top surface of the outsole 116 to form a sole assembly 106 comprising the reinforcement structure 111. For example, the midsole 115 and outsole 116 may be bonded together using adhesives or other attachment techniques.

Following the right-hand path from OPERATION 1304, at OPERATION 1312, the upper layer 128 of the midsole 115 may be formed from a relatively soft first EVA foam composition having a first hardness level (durometer). At OPERATION 1313, the lower layer 130 of the midsole 115 may be formed from a relatively firm material, such as a second EVA foam composition having a second hardness level (durometer).

At OPERATION 1314, the reinforcement structure 111 may be assembled between the upper layer 128 and the lower layer 130 of the midsole 115. In some examples, one or more buffing, gluing/cementing and ultraviolet (UV)/heat glue activations may be included in assembling the reinforcement structure 111 between the upper layer 128 and the lower layer 130 of the midsole 115. Additionally, in some examples, a jig or press may be used to force the final assembly together for bonding and cooling.

At OPERATION 1316, the dual-density midsole 115 with the reinforcement structure 111 may be attached to an outsole 116. For example, the bottom surface of the lower layer 130 of the midsole 115 may be bonded to the top surface of the outsole 116 using adhesives or other attachment techniques, and a sole assembly 106 comprising the reinforcement structure 111 may be constructed. The resulting sole assembly 106 may have an optimum combination of structural rigidity and flexibility. For example, a shoe 100 with a sole assembly 106 comprising the reinforcement structure 111 may be able to hold and support the medial and lateral sides of the golfer's foot as they shift their weight while making a golf shot. The shoes 100 help provide the golfer with a stable platform that does not collapse under loads that may be created from the golfer's swing. The shoes 100 may provide high structural support to the golfer, and yet they do not sacrifice flexibility, and other golf-performance properties. Thus, the golfer can walk and play the course and engage in other golf activities comfortably.

The various embodiments of the golf shoe 100 of the present disclosure provide a high level of stability (e.g., bending and longitudinal torsion stiffness) and cushioning. As discussed above, during the game of golf, the player's foot undergoes several different types of movement, which imparts forces on the footwear of the player. For instance, midfoot bending and longitudinal torsion both cause forces to be applied on the footwear. For midfoot bending, bending of the footwear at the plantar surface causes relative motion of the foot with respect to the shoe, creating a potential lack of support, discomfort, and/or instability. For longitudinal torsion, twisting along the length of the shoe with respect to the natural torsion axis of the foot can be adjusted to affect walking comfort and swing stability. In both cases, the area moments of inertia of the reinforcement structure 111 may be utilized in constructing and placing the reinforcement structure to provide benefits for midfoot bending and longitudinal torsion.

As discussed further below, to take advantage of the area moment of inertia parallel axis theorem, the bridge 122 of the reinforcement structure 111 may be moved further away from the bite line or rotational axis to provide additional stability. Moving the bridge 122 further towards the bottom of the shoe 100 increases stiffness and thereby reduces bending at the midfoot. In addition, by moving the plate further downward (e.g., bottom-loading the plate), also allows for the midsole foam to be placed nearer to the foot plantar surface. Such positioning allows for the foam to more closely deform to the shape of the midfoot, which results in lower tissue stress and enhanced comfort. In addition, the medial and lateral wings, which serve as substantially vertical outriggers from the bridge 122, help control the magnitude and rate of the medio-lateral rolling effect that results from the midsole-midfoot edge compression. Because the medial and lateral wings are positioned on the sidewalls, the medial and lateral wings reduce edge compression while allowing for center compression to maintain cushioning impact attenuation and comfort under the calcaneus and along the calcaneal plantar aponeurosis.

The parallel axis theorem further provides insights into engineering the reinforcement structure 111 to enhance longitudinal torsion. The parallel axis theorem states that the moment of inertia for an area about an axis is equal to its moment of inertia about a parallel axis passing through the area's centroid plus the product of the area and the square of the perpendicular distance between the axes. Thus, the greater the distance from the bending and torsion axes the area centroids are located, the greater the effect on bending and torsional stiffness a given structure will have on the footwear. Accordingly, moving the reinforcement structure 111 downward provides further enhancements for longitudinal torsion as well.

By utilizing the principles and concepts discussed herein, the reinforcement structure 111 can be engineered to control midfoot bending and longitudinal torsion stiffness with the smallest structure and requiring the least amount of material (resulting in less weight and cost) while minimally affecting cushioning/compression of the shoe 100.

As additional detail, the area moment of inertia of the reinforcement structure 111 may be considered for determining a shape and position of the medial and lateral wings and the bridge 122 of the reinforcement structure 111. For instance, the area moment of inertia is a geometrical property which reflects how the area's points are distributed with regard to a particular axis and directly influences the mechanical behavior of the midsole. The area moment of inertia may be calculated with respect to a reference axis such as X or Y, that is normally a centroid or neutral axis. For example, for a standard shape, such as a rectangle, the area moment of inertia of the shape can be calculated by the formula:

$$I = \frac{1}{12}bh^3,$$

where:

I=area moment of inertia at the centroid of the rectangle;
b=base width of the shape (e.g., along the x-axis); and
h=height of the shape (e.g., along the y-axis).

The above equation can be applied to the reinforcement structure 111 by dividing the structure into three distinct rectangular cross-sectional substructures: a medial wing, a lateral wing and a bridge. Each of these substructures has its own base and height that determine its contribution to the overall reinforcement structure area moment of inertia. The parallel axis theorem is applied to add these three area moments of inertia to calculate the total area moment of inertia of the reinforcement structure with respect to bending axis 109.

Figure 14:
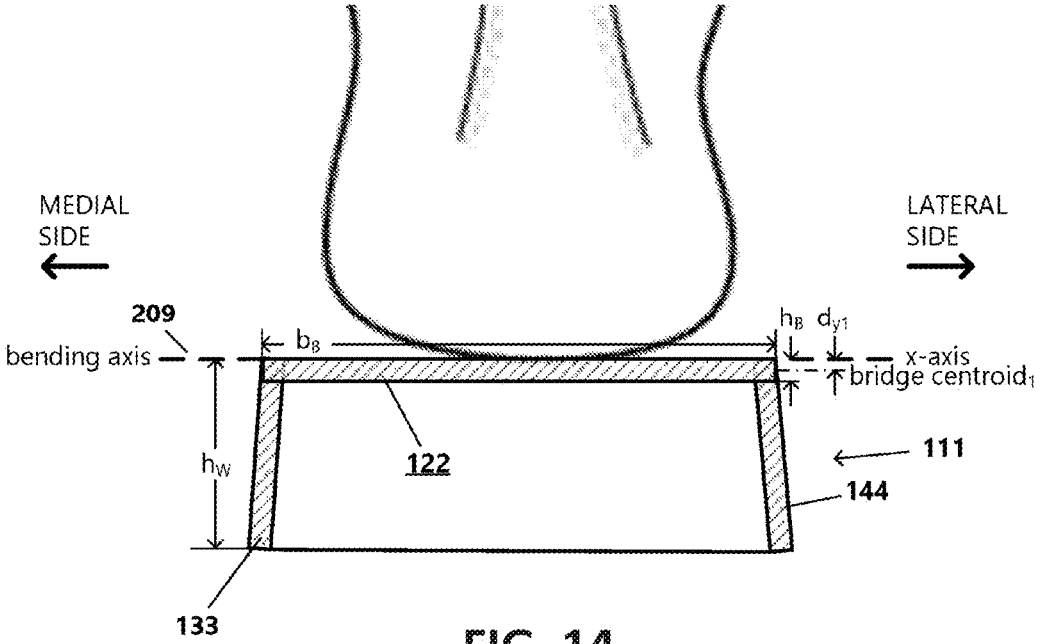
FIG. 14 depicts a schematic diagram of a reinforcement structure cross-section of a first example configuration showing how moment of inertia for the reinforcement structure can be calculated.
Figure 15:
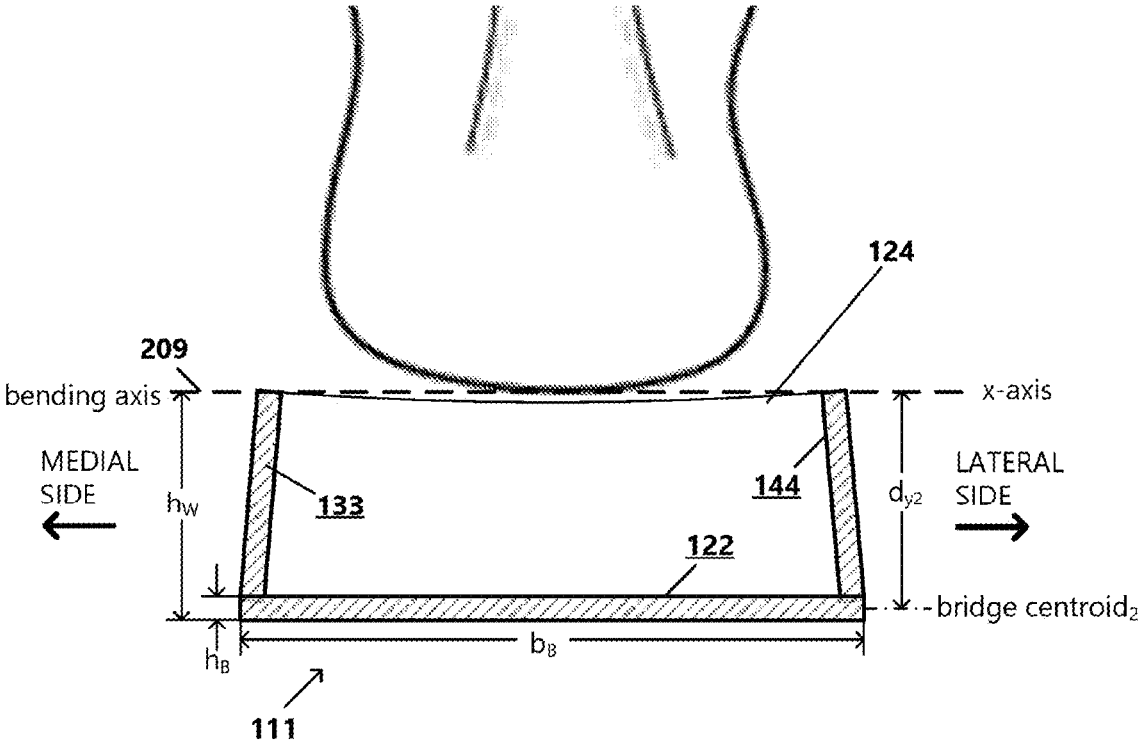
FIG. 15 depicts a schematic diagram of a reinforcement structure cross-section of a second example configuration showing how the moment of inertia for reinforcement structure can be calculated.

With reference now to FIGS. 14 and 15, a generally U-shaped reinforcement structure 111 is shown in a first example configuration in FIG. 14 and in a second example configuration in FIG. 15. Similar to the I-Beam, the reinforcement structure configurations may be divided into multiple cross-sectional areas (e.g., the medial wing 133, the lateral wing 144, and the bridge 122), whose area moments of inertia may be calculated about bending axis 209 using the parallel-axis theorem and summated to determine the total area moment of inertia of the reinforcement structure 111 about bending axis 209. Based on the above formula, the area moment of inertia of each cross-sectional area about its centroid is $\frac{1}{12}bh^3$. Accordingly, heights of the medial wing 133 and the lateral wing 144 have a large effect (e.g., to the third power) on the area moment of inertia of the medial and lateral wings, and therefore, the bending stiffness of the reinforcement structure 111.

The parallel-axis theorem may be used to determine the area moment of inertia of the reinforcement structure 111 about another axis that is parallel to the centroidal axis by adding, to the area moment of inertia with respect to the centroidal axis, the product of the area and the square of the distance between the two axes. The parallel axis theorem may be further used to adjust the shape and location of the reinforcement structure 111 of the shoe 100 to increase bending stiffness. For instance, and with continued reference to FIGS. 14 and 15, the area moments of inertia of the example reinforcement structure 111 configurations about a bending axis 209 that is parallel to the centroidal axis may be determined using the formula:

$$I_x = \bar{I}_x + Ad_y^2, \text{ where}$$

$I_x$=area moment of inertia about the x-axis/bending axis 209;
$\bar{I}_x$=area moment of inertia acting about its centroidal x'-axis;
A=cross-sectional area; and
$d_y$=distance from the centroid to the axis/bending axis 209.

As the parallel axis theorem indicates, as the distance of an area from the bending axis 209 increases, its contribution to the magnitude of the area moment of inertia also increases. Thus, positioning the reinforcement structure 111 in the sole assembly 106 at a location that is farther from the natural foot bending axis 209 of the wearer's foot can further greatly increase the effect the reinforcement structure 111 has on bending stiffness of the shoe 100. For instance, when reinforcement structure 111 is top-loaded (e.g., as depicted in FIG. 14), the distance from the centroid of the wings 133, 144 and bridge 122 to the bending axis 209 may be less than when the reinforcement structure 111 is bottom-loaded (e.g., as depicted in FIG. 15). Accordingly, the bottom-loaded configuration depicted in FIG. 15 may provide increased bending stiffness over the top-loaded configuration depicted in FIG. 14, where:

$$\frac{1}{12}b_B\left(\frac{h_B}{2}\right)^3 + A\left(\frac{h_B}{2}\right)^2 < \frac{1}{12}b_B\left(\frac{h_B}{2}\right)^3 + A\left(\left(\frac{h_B}{2}\right) + h_W\right)^2,$$

where:

$$d_{y1} = \frac{h_B}{2} \text{ and } d_{y2} = \left(\frac{h_B}{2}\right) + h_w.$$

For example, because the bridge 122 is farther away from the bending axis 209 in the bottom-loaded reinforcement structure 111 depicted in FIG. 14, $d_{y1} << d_{y2}$. As can be appreciated, distances of the medial wing 133, lateral wing 144, and bridge 122 from the bending axis 209 can have a large effect (e.g., squared or to the second power) on the area moment of inertia of the reinforcement structure 111. Thus, the bending stiffness of the bottom-loaded reinforcement structure 111 depicted in FIG. 15 is higher than the top-loaded reinforcement structure 111.

Figure 16:
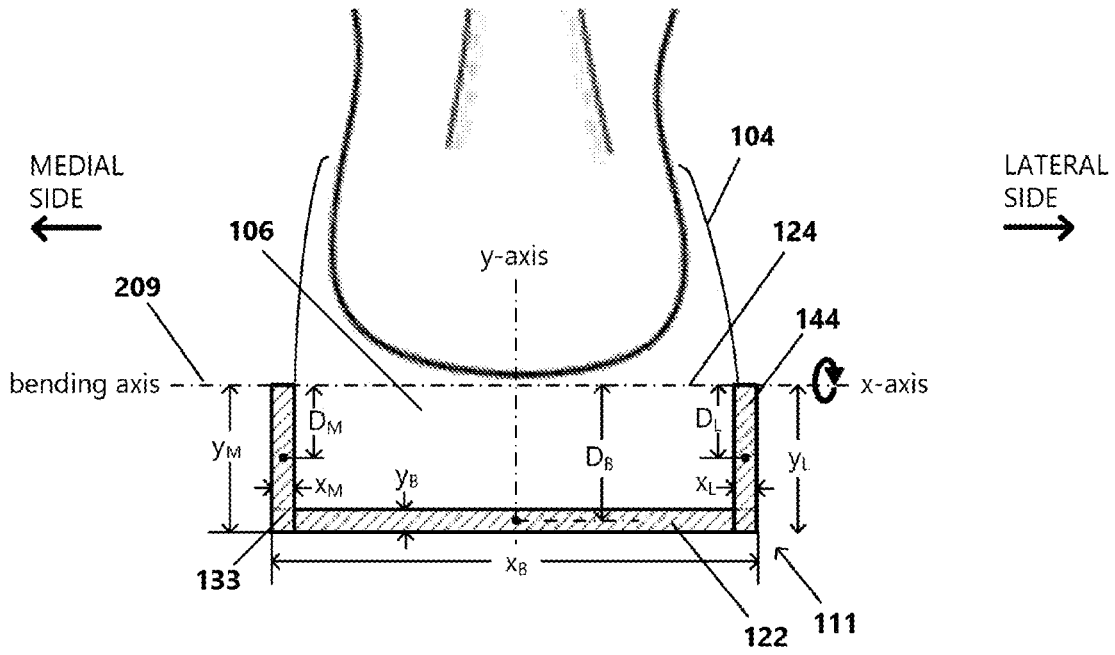
FIG. 16 depicts a schematic diagram of a reinforcement structure cross-section showing how the parallel axis theorem can be applied to increase bending stiffness according to an embodiment.

With reference now to FIG. 16, an example of how the parallel axis theorem can be applied to increase bending stiffness is depicted according to an embodiment. For instance, the parallel axis theorem may be used to calculate the individual area moments of inertia for the bridge 122, medial wing 133, and lateral wing 144 of an example reinforcement structure 111 about a bending axis 209. According to an example and as shown, the bending axis 209 may be located at an interface between the sole assembly 106 and a golfer's foot (e.g., at approximately the bite line 124). Using the parallel-axis theorem, the moment of inertia for the example reinforcement structure 111 about the bending axis 209 can be calculated by the formula:

$$I_x = (\bar{I}_B + A_B D_{BC}^2) + (\bar{I}_M + A_M D_M^2) + (\bar{I}_L + A_L D_L^2) \text{ or}$$

$$I_x = \left[\left(\frac{1}{12} x_B y_B^3\right) + (x_B y_B D_{BC}^2)\right] + \left[\left(\frac{1}{12} x_M y_M^3\right) + (x_M y_M D_M^2)\right] + \left[\left(\frac{1}{12} x_L y_L^3\right) + (x_L y_L D_L^2)\right],$$

where:

$x_B$=transverse width of the bridge 122;

$y_B$=height/thickness of the bridge 122;

$D_{BC}$=distance from the centroid of the bridge 122 to the bending axis 209;

$x_M$=width/thickness of the medial wing 133;

$y_M$=height of the medial wing 133;

$D_M$=distance from the centroid of the medial wing 133 to the bending axis 209;

$x_L$=width/thickness of the lateral wing 144;

$y_L$=height of the lateral wing 144; and $D_L$=distance from the centroid of the lateral wing 144 to the bending axis 209.

As can be seen in the example depicted in FIG. 16 and from the above formula, the area moment of inertia, and therefore, the bending stiffness of the reinforcement structure 111, may be most affected by the height of the medial wing 133, the height of the lateral wing 144, and the distance of the bridge 122 from the bending axis 209 (e.g., at the bite line 124 or approximately the bite line 124). Consider, for example, three example reinforcement structures (A, B, and C) that have an increasing distance between the centroid of the bridge 122 and the bending axis 209 by 5 mm. For instance, the bridge 122 of reinforcement structure B may be 5 mm farther from the bending axis 209 than the bridge 122 of reinforcement structure A, and the bridge 122 of reinforcement structure C may be 5 mm farther from the bending axis 209 than the bridge 122 of reinforcement structure B. In such examples, the increase in the area moment of inertia between structure A and structure B is greater than the increase in the area moment of inertia between structure B and C.

Nevertheless, moving the bridge 122 downwards and increasing the wing height causes a concurrent increase in multiple variables, including the distance from the centroid of the bridge 122 to the bending axis 209 ($D_{BC}$), $y_M$=height of the medial wing 133 ($y_M$), the distance from the centroid of the medial wing 133 to the bending axis 209 ($D_M$), the height of the lateral wing 144 ($y_L$), and the distance from the centroid of the lateral wing 144 to the bending axis 209 ($D_L$). As a result, the moment of inertia is greatly increased, and as should be appreciated, moving the bridge 122 of the reinforcement structure 111 farther from the natural bending axis of the foot and increasing the heights of the medial wing 133 and the lateral wing 144 cause the reinforcement structure 111 to increase bending stiffness of the shoe 100 and, thereby, resist dorsal flexion to a greater extent. The reinforcement structure 111 may have similar dimensions as discussed above.

As an example, example dimensions of the three example reinforcement structures (A, B, and C) are shown in the table below, where structure A may represent a reinforcement structure 111 where the bridge 122 is positioned proximally, structure B may represent a reinforcement structure 111 where the bridge 122 is positioned distally, and structure C may represent a reinforcement structure 111 where the bridge 122 is positioned in the in the middle of the midsole 115. For instance, of the three example reinforcement structures, the proximal location of structure A may provide a most flexible configuration, the distal position of structure B may provide the most rigid configuration, and the middle position of structure C may provide flexibility and rigidity more than structure A but less than structure B. As shown in the table below, using the parallel-axis theorem and the above formula, the area moments of inertia for the structures A, B, and C may be determined to be approximately: 6,139 $mm^4$, 98,933 $mm^4$, and 21,477 $mm^4$, respectively. For example, the vertical position of the bridge 122 with respect to the bending axis 209 may have the greatest influence on the area moment of inertia and the height of the wings 133, 144 have a strong secondary effect. As should be appreciated, various other configurations may be used to meet specific requirements to balance midfoot flexion, longitudinal torsion, edge compression stiffness, and central compression stiffness.

SHOE REINFORCEMENT STRUCTURE PARAMETERS

| | Values | | |
|---|---|---|---|
| Variable | Structure A (proximal position, low profile) | Structure B (distal position, high profile) | Structure C (mid-position, half-height profile) |
| $x_B$ (mm) | 60.00 | 100.00 | 80.00 |
| $y_B$ (mm) | 0.60 | 2.00 | 1.00 |
| $D_{BC}$ (mm) | 12.30 | 21.00 | 15.50 |
| $I_B$ ($mm^4$) | 1.08 | 66.67 | 6.67 |
| $A_B$ ($mm^2$) | 36.00 | 200.00 | 80.00 |
| $A_B D_{BC}^2$ ($mm^4$) | 5446.44 | 88200.00 | 19220.00 |
| $I_{BX}$ ($mm^4$) | 5448 | 88267 | 19227 |
| $x_M$ (mm) | 0.60 | 2.00 | 1.00 |
| $y_M$ (mm) | 12.00 | 20.00 | 15.00 |
| $D_M$ (mm) | 6.00 | 10.00 | 7.50 |
| $I_M$ ($mm^4$) | 86.40 | 1333.33 | 281.25 |
| $A_M$ ($mm^2$) | 7.20 | 40.00 | 15.00 |
| $A_M D_M^2$ ($mm^4$) | 259.20 | 40000.00 | 843.75 |
| $I_{MX}$ ($mm^4$) | 346 | 5333 | 1125 |
| $x_L$ (mm) | 0.60 | 2.00 | 1.00 |
| $y_L$ (mm) | 12.00 | 20.00 | 15.00 |
| $D_L$ (mm) | 6.00 | 10.00 | 7.50 |
| $I_L$ ($mm^4$) | 86.40 | 1333.33 | 281.25 |
| $A_L$ ($mm^2$) | 7.20 | 40.00 | 15.00 |
| $A_L D_L^2$ ($mm^4$) | 259.20 | 40000.00 | 843.75 |
| $I_{LX}$ ($mm^4$) | 346 | 5333 | 1125 |
| $I_X$ ($mm^4$) | 6139 | 98933 | 21477 |

Accordingly, based on the position of the reinforcement structure 111 in the shoe 100, different heights and configurations for the reinforcement structure are available and can allow for area moment of inertia values ($I_X$) between about 5,000 $mm^4$ to about 100,000 $mm^4$. In some examples when the reinforcement structure 111 is positioned at the midfoot, as discussed above, the area moment of inertia values ($I_X$) may be between about 15,000 $mm^4$ to 30,000 $mm^4$, 18,000 $mm^4$ to 25,000 $mm^4$, or 20,000 to 22,000. The specific distances and measurements within the table above are also provided as specific examples, and different configurations may be used for the reinforcement structure 111. For instance, examples of the reinforcement structure may have measurements within about plus or minus 10%, 20%, or 30% of the values in the above table. For example, the $D_{BC}$ values may be between about 10 mm to 20 mm, and the $D_M$ $D_L$ values may be between about 5 mm and 10 mm.

Figure 17:
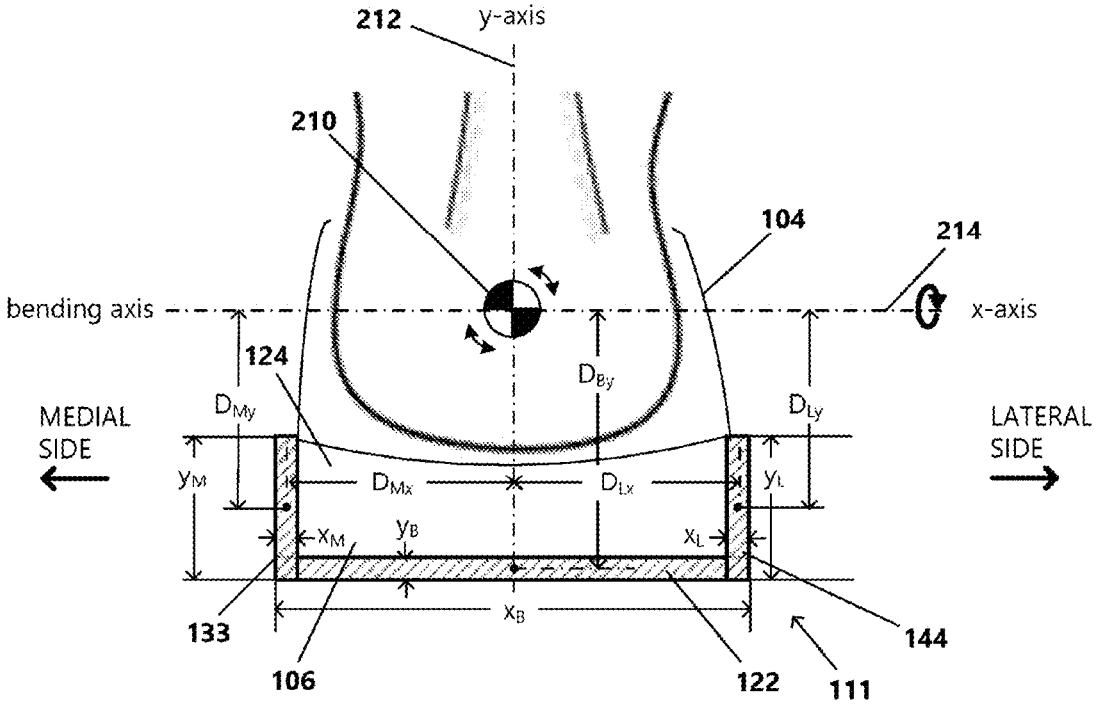
FIG. 17 depicts a schematic diagram of a reinforcement structure cross-section showing how the parallel axis theorem can be applied to increase torsion stiffness according to an embodiment.
Figure 18:
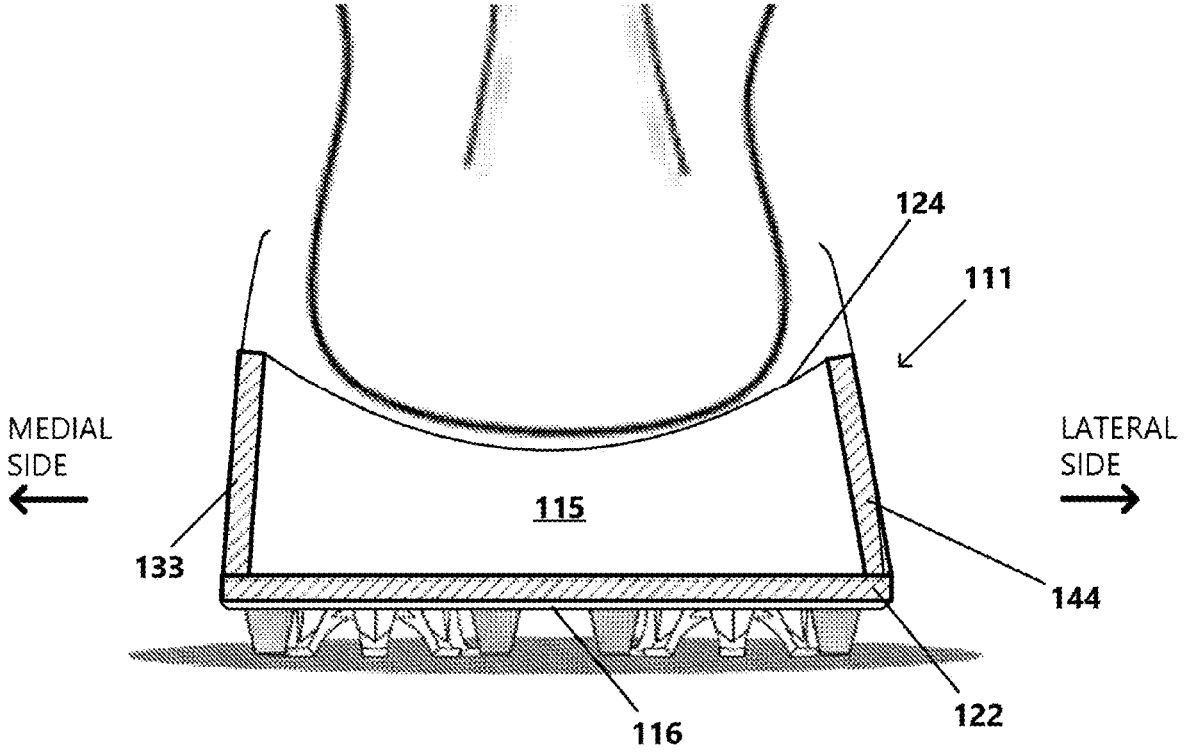
FIG. 18 depicts a cross-sectional view of a sole assembly, where the reinforcement structure is below or at least partially embedded within an outsole according to an example.
Figure 19A:
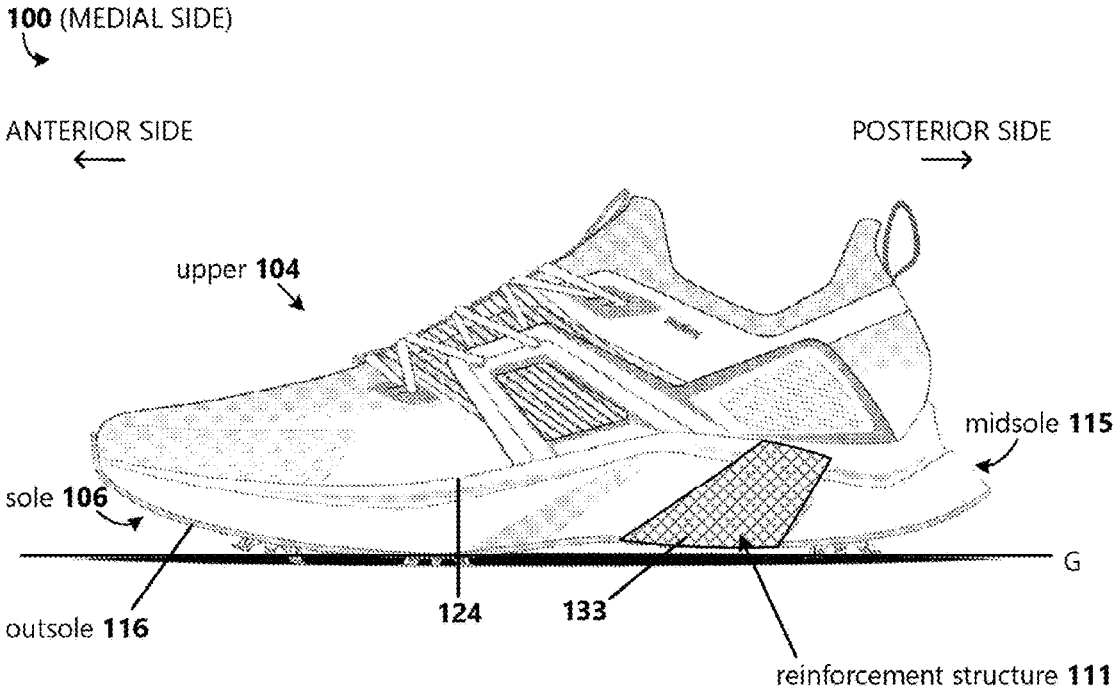
FIG. 19A depicts a medial side view of a golf shoe including a reinforcement structure according to another example.
Figure 19B:
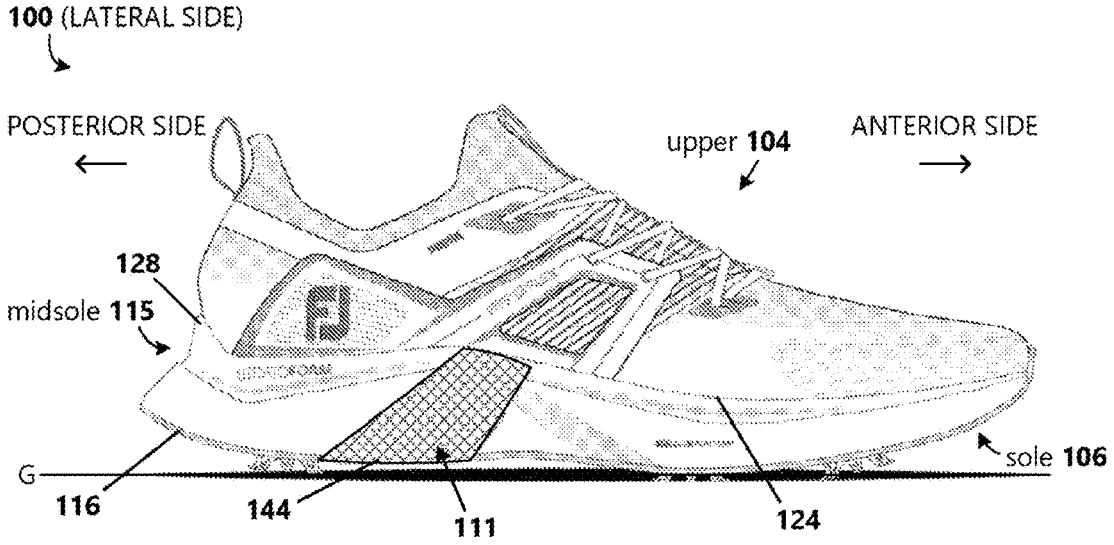
FIG. 19B depicts a lateral side view of the golf shoe of FIG. 19A according to an example.
Figure 19C:
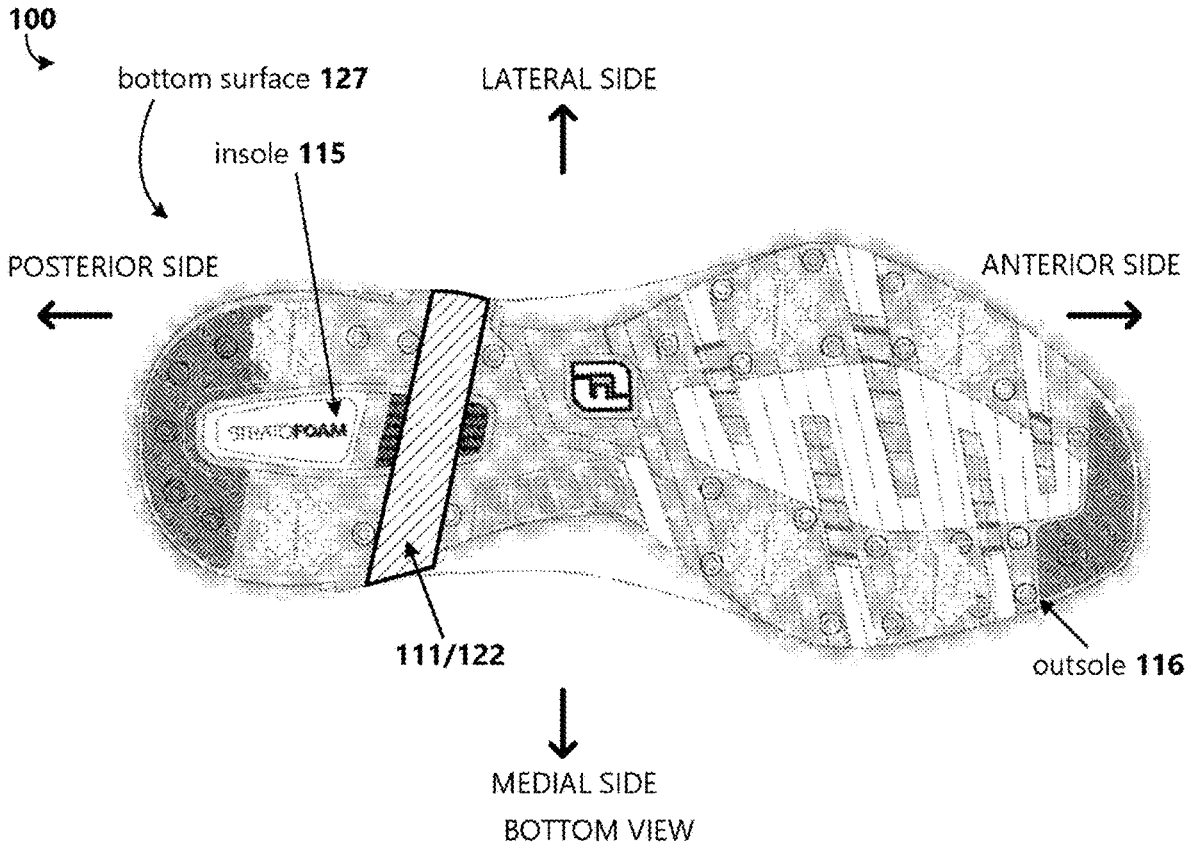
FIG. 19C depicts a bottom view of the golf shoe of FIG. 19A according to an example.

Twisting along the length of the shoe 100 with respect to a natural torsion axis of the wearer's foot can also be adjusted to affect walking comfort and swing stability. The parallel axis theorem may further be applied to adjust the shape and location of the reinforcement structure 111 of the shoe 100 to increase torsion stiffness. For instance, and with reference now to FIG. 17, the parallel axis theorem may be used to calculate the individual polar moments of inertia for the bridge 122, medial wing 133, and lateral wing 144 of an example reinforcement structure 111 about a torsion axis 210 (e.g., about an x-axis 214 with respect to a y-axis 212 and about the y-axis 212 with respect to an x-axis 214). According to an example, the torsion axis 210 may be located approximately 10 mm below the golfer's calcaneal tuberosity during a large portion of a golf swing. This may provide a reference for optimally positioning the reinforcement structure 111 to provide a desired amount of torsion stiffness. Using the parallel-axis theorem, the rotational moment of inertia for the example reinforcement structure 111 about the torsion axis 210 can be calculated by the formula:

$$J=\Sigma(I_x+I_y)=I_{x_{MO}}+I_{x_{LO}}+I_{x_B}+I_{y_{MO}}+I_{y_{LO}}+I_{y_B}, \text{ where:}$$

$$I_x=\left[\left(\frac{1}{12}x_By_B^3\right)+\left(x_By_BD_{B_y}^2\right)\right]+\left[\left(\frac{1}{12}x_My_M^3\right)+\left(x_My_MD_{M_y}^2\right)\right]+\left[\left(\frac{1}{12}x_Ly_L^3\right)+\left(x_Ly_LD_{L_y}^2\right)\right]; \text{ and}$$

$$I_y=\left[\left(\frac{1}{12}y_Bx_B^3\right)+\left(y_Bx_BD_{B_x}^2\right)\right]+\left[\left(\frac{1}{12}y_Mx_M^3\right)+\left(y_Mx_MD_{M_x}^2\right)\right]+\left[\left(\frac{1}{12}y_Lx_L^3\right)+\left(y_Lx_LD_{L_x}^2\right)\right];$$

and $x_B$=transverse width of the bridge 122;

$y_B$=height/thickness of the bridge 122;

$D_{By}$=−y distance from the centroid of the bridge 122 to the x-axis 214;

$D_{Bx}$=−x distance from the centroid of the bridge 122 to the y-axis 212;

$x_M$=width/thickness of the medial wing 133;

$y_M$=height of the medial wing 133;

$D_{My}$=−y distance from the centroid of the medial wing 133 to the x-axis 214;

$D_{Mx}$=−x distance from the centroid of the medial wing 133 to the y-axis 212;

$x_L$=width/thickness of the lateral wing 144;

$y_L$=height of the lateral wing 144;

$D_y$=−y distance from the centroid of the lateral wing 144 to the x-axis 214; and $D_{Mx}$=−x distance from the centroid of the medial wing 133 to the y-axis 212.

As can be determined from the above formula, the rotational moment of inertia, and therefore, the torsion stiffness of the reinforcement structure 111, may be highly affected by the heights of the medial and lateral wings, the −y distance from the centroid of the bridge 122 to the x-axis 214, the −y distances from the centroid(s) of the medial and lateral wings to the x-axis 214, the transverse width of the bridge 122 (e.g., measured from the medial side of the bridge 122 to the lateral side of the bridge 122), and the −x distances from the centroid(s) of the medial and lateral wings to the y-axis 212. For example, based on the above formula, longitudinal torsion may be most affected by the transverse width of the bridge 122 and the distances of the medial and lateral wings from the shoe centerline (e.g., y-axis 212).

Several of the dimensions of the reinforcement structure 111 have greater effects on the stiffness for midfoot bending and/or longitudinal torsion. For instance, the height of the medial wing 133 ($y_M$) and height of the lateral wing 144 ($y_L$) both have cubed contributions to the moment of inertia calculations for both the midfoot bending and longitudinal torsion. The respective distances from the centroids of the bridge to the axes also have squared contributions to the moment of inertia for midfoot bending and/or longitudinal torsion. The transverse width of the bridge 122 ($x_B$) also has a cubed contribution to the moment of inertia calculation for the longitudinal torsion. As such, by controlling or increasing these particular variables, the increase to the respective stiffness can be most effectively increased while still utilizing the smallest structure and requiring the least amount of material (resulting in less weight and cost).

Adjusting the shape and location of the reinforcement structure 111 of the shoe 100 may additionally affect a level of cushioning and stability provided by the shoe 100. For instance, when cushioning is enhanced, the foam of the midsole 115 may be more able to deflect and conform to the wearer's foot. This can reduce peak plantar pressure and enhance a comfort sensation to the wearer. Thus, it may be desirable to move the reinforcement structure 111 farther from the wearer's foot so that additional depth of foam material of the midsole 115 may be exposed to the wearer. According to examples, the medial and lateral wings may extend vertically, or substantially vertically, along the periphery of the sole assembly 106. For instance, the medial and lateral wings may be positioned to the medial and lateral edges of the sole assembly 106 (e.g., out from under the wearer's calcaneus and plantar aponeurosis), which may reduce edge compression while allowing center compression to maintain cushioning impact attenuation and comfort under the wearer's calcaneus and along the calcaneal plantar aponeurosis. Moreover, medial and lateral edge locations for the medial and lateral wings may further enhance resistance to midsole edge deformation and midsole sidewall compression. According to an example, support from the medial and lateral wings positioned along the medial and lateral edges of the sole assembly 106 may provide support for the foam material of the midsole 115 and help prevent the foam material from deforming outwardly. Accordingly, mediolateral rocking of the shoe 100 may be decreased, which increases stability of the shoe 100 and promotes stability against ankle rolling.

In some examples and as depicted in FIGS. 18 and 19A-19C, the reinforcement structure 111 may be positioned below, integrated into, or at least partially embedded within the outsole 116. By integrating the reinforcement structure 111 into the reinforcement structure 111, the bridge 122 of the reinforcement structure 111 may be maximally distanced from the wearer's foot (e.g., the bite line 124 of the shoe 100). Moreover, the medial and lateral wings may extend vertically from the maximally distanced position of the bridge 122. In this manner, the bending stiffness, longitudinal torsion stiffness, and cushioning of the shoe 100 may be increased based on an increase of the −y distance from the centroid of the bridge 122 to the x-axis 214, the −y distances from the centroid of the medial and lateral wings to the x-axis 214, the transverse width of the bridge 122, and the −x distances from the centroid of the medial and lateral wings to the y-axis 212. Thus, the reinforcement structure 111 helps provide the golfer with a stable platform and structural support so that the golfer can keep their balance when performing a swing without sacrificing cushioning, forefoot flex, and other and other golf-performance properties and characteristics.

In some non-limiting aspects, the present disclosure provides various examples of golf shoes comprising an upper, a sole assembly, and a reinforcement structure integrated with the sole assembly. The reinforcement structure may comprise any of the support structures described herein and/or shown in the accompanying figures, and functional equivalents thereof.

Figure 20A:
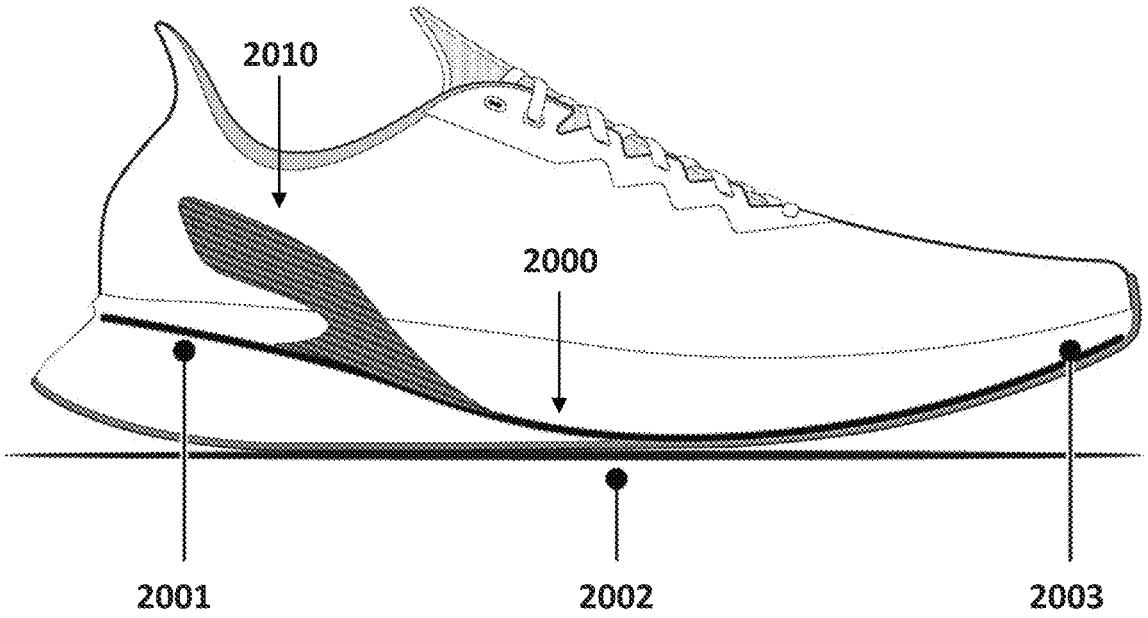
FIGS. 20A-20C depict one example of a golf shoe comprising a reinforcement structure, in accordance with some embodiments of the present disclosure.
Figure 20B:
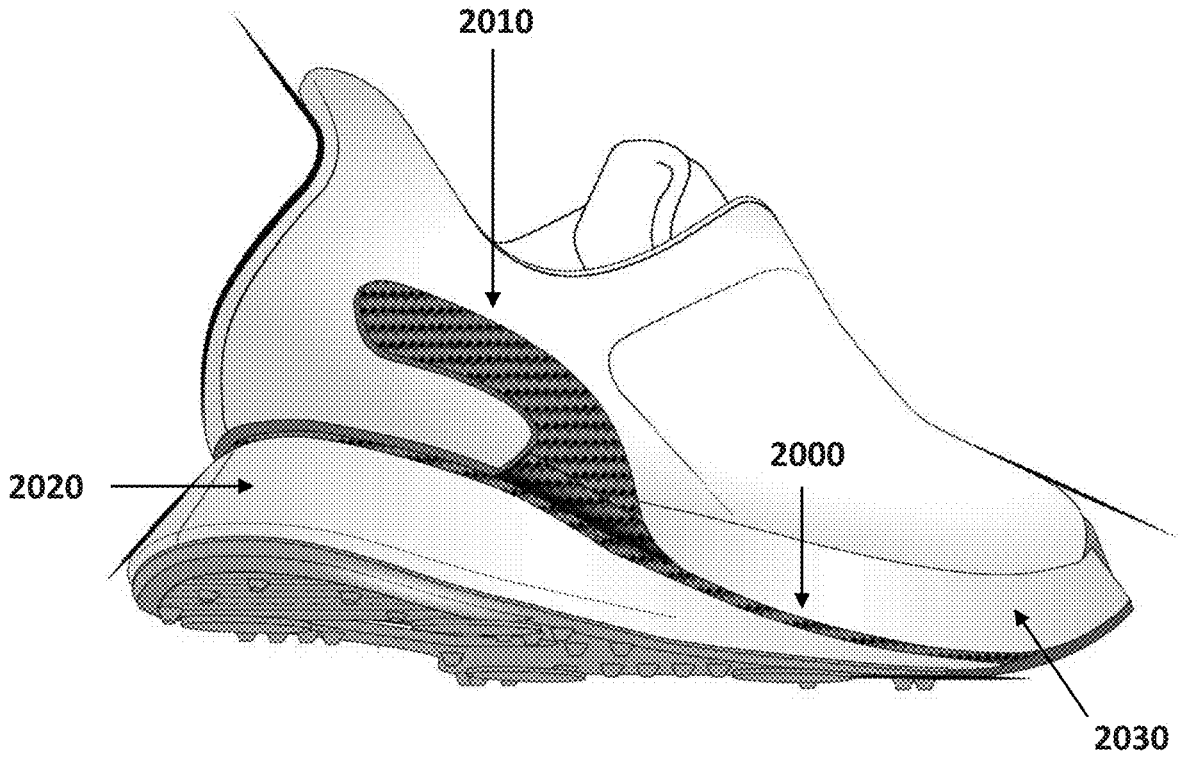
Figure 20C:
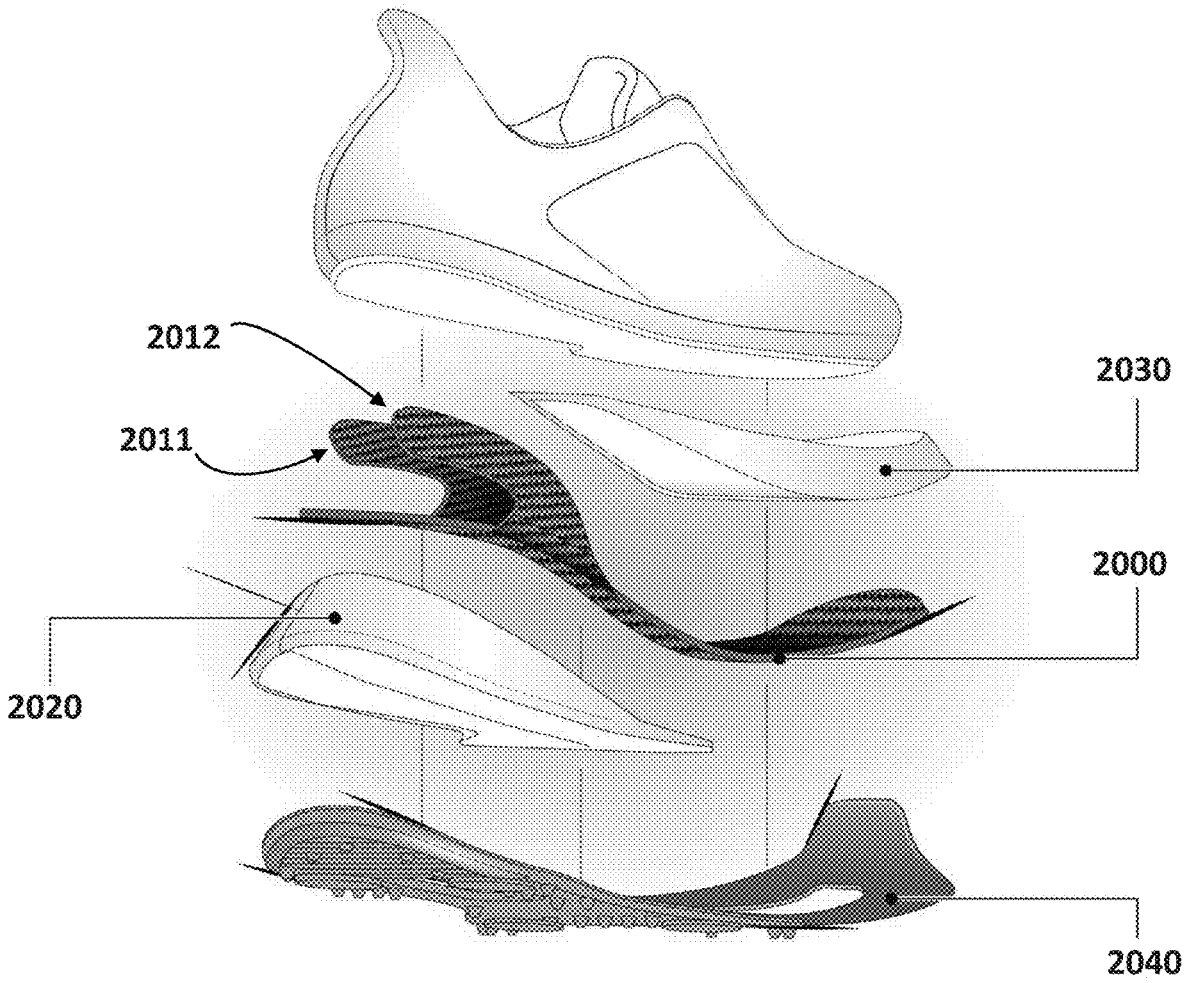

Referring now to FIGS. 20A-20C, in some embodiments, the golf shoe may comprise a reinforcement structure 2000 extending from the heel region 2001 across the midfoot region 2002 towards the forefoot region 2003 of the golf shoe. In some embodiments, the reinforcement structure 2000 may be integrated with a sole assembly of the golf shoe.

In some embodiments, the sole assembly may comprise a midsole and an outsole. As shown in FIGS. 20B and 20C, in some cases, the midsole may comprise (i) a first midsole component 2020 extending from a heel region of the sole assembly to a midfoot region of the sole assembly and (ii) a second midsole component 2030 extending from a forefoot region of the sole assembly to the midfoot region of the sole assembly. In some cases, the first midsole component 2020 and the second midsole component 2030 may have a variable thickness that tapers towards the midfoot region of the sole assembly.

In some embodiments, the first midsole component 2020 may have a first thickness at the heel region and a second thickness at the midfoot region. In some embodiments, the second thickness may be less than the first thickness. In some embodiments, the second midsole component 2030 may have a first thickness at the forefoot region and a second thickness at the midfoot region. In some embodiments, the second thickness may be less than the first thickness.

In some embodiments, the first midsole component 2020 and the second midsole component 2030 may have different hardness or softness profiles. In some cases, the first and/or second midsole components may have a hardness or softness profile that is uniform or substantially uniform. In other cases, the first and/or second midsole components may have a variable hardness or softness profile. For example, in some cases, the hardness or softness profiles of the first and/or second midsole components may change or vary across the midsole components or any portions thereof. In some non-limiting embodiments, the hardness or softness of the first and/or second midsole component(s) may change or vary over a select area, portion, or region of the midsole or the sole assembly. In some non-limiting embodiments, the hardness or softness of the first and/or second midsole component(s) may change or vary along one or more dimensions of the midsole or the sole assembly.

In some embodiments, the first midsole component 2020 may have a first hardness or softness profile and the second midsole component 2030 may have a second hardness or softness profile that is different than the first hardness or softness profile. In some embodiments, the hardness or softness of the first midsole component 2020 may change or vary over a first area, portion, or region of the sole assembly, and the hardness or softness of the second midsole component 2030 may change or vary over a second area, portion, or region of the sole assembly that is different than the first area, portion, or region. In some embodiments, the hardness or softness of the first midsole component 2020 may change or vary along a first dimension or section of the sole assembly, and the hardness or softness of the second midsole component 2030 may change or vary along a second dimension or section of the sole assembly that is different than the first dimension or section. In some embodiments, the hardness or softness of the first midsole component 2020 may change or vary according to a first spatial function, and the hardness or softness of the second midsole component 2030 may change or vary according to a second spatial function that is different than the first spatial function.

In some embodiments, the different hardness or softness profiles of the first midsole component 2020 and the second midsole component 2030 may collectively provide the sole assembly with a variable hardness or stiffness profile between the forefoot region and the heel region of the sole assembly. In some embodiments, the variable hardness or stiffness profile may be a function of the varying thickness profiles of the first midsole component 2020 and/or the second midsole component 2030. In some embodiments, the variable hardness or stiffness profile may be a function of a ratio between (i) the thickness of the first midsole component 2020 at a select location within the sole assembly and (ii) the thickness of the second midsole component 2030 at the select location within the sole assembly.

In some embodiments, the first midsole component 2020 and/or the second midsole component 2030 may have a hardness or softness profile that provides the sole assembly with a relatively soft heel or crash pad region for all day walking comfort. In some embodiments, the first midsole component 2020 and/or the second midsole component 2030 may have a hardness or softness profile that provides the sole assembly with a relatively stiff forefoot region for enhanced control and/or stability during golf-related actions or movements. In some embodiments, the combination of the different hardness or softness profiles of the first midsole component 2020 and the second midsole component 2030 may provide an optimal balance between comfort and performance.

In some embodiments, the first midsole component 2020 may extend to a first location in the midfoot region. In some embodiments, the second midsole component 2030 may extend to a second location in the midfoot region. In some embodiments, the first location and the second location may be offset relative to each other. In some embodiments, the first midsole component 2020 and the second midsole component 2030 may overlap each other. In other embodiments, the first midsole component 2020 and the second midsole component 2030 may not or need not overlap each other. In some embodiments, the first midsole component 2020 and the second midsole component 2030 may extend to or towards (i) a same location or (ii) two or more locations that are directly adjacent or proximal to each other.

In some embodiments, the first midsole component 2020 may comprise a first end disposed in the heel region and a second end disposed in the midfoot region. In some embodiments, the second midsole component 2030 may comprise a first end disposed in the forefoot region and a second end disposed in the midfoot region. In some embodiments, the second end of the first midsole component 2020 may be positioned closer to the forefoot region of the sole assembly than the second end of the second midsole component 2030. In some embodiments, the second end of the second midsole component 2030 may be positioned closer to the heel region of the sole assembly than the second end of the first midsole component 2020.

In some embodiments, the first midsole component 2020 may have a top surface that contacts a bottom surface of the reinforcement structure. In some embodiments, the second midsole component 2030 may have a bottom surface that contacts a top surface of the reinforcement structure. In some embodiments, the top surface of the first midsole component 2020 may be configured to slope downwards as the first midsole component extends from the heel region towards the midfoot region. In some embodiments, a curvature of the top surface of the first midsole component 2020 may correspond to a curvature of the bottom surface of the reinforcement structure. In some embodiments, the bottom surface of the second midsole component 2030 may be configured to slope upwards as the second midsole component extends from the forefoot region towards the midfoot region. In some embodiments, a curvature of the bottom surface of the second midsole component 2030 may correspond to a curvature of the top surface of the reinforcement structure.

Reinforcement Structure

In some embodiments, a reinforcement structure 2000 may be integrated with a midsole of the shoes disclosed herein. In some embodiments, the reinforcement structure 2000 may be positioned between the first midsole component 2020 and the second midsole component 2030 of the midsole.

In some embodiments, the reinforcement structure 2000 may comprise a medial support 2011 (e.g., a medial side wing) that extends upward along a medial side of the sole assembly and crosses over a medial side of the upper. In some embodiments, the reinforcement structure 2000 may comprise a lateral support 2012 (e.g., a lateral side wing) that extends upward along a lateral side of the sole assembly and crosses over a lateral side of the upper. In some embodiments, the reinforcement structure may comprise a bridge section or a central support that extends between the lateral side wing and the medial side wing.

In some embodiments, the lateral side wing and/or the medial side wing may include a curved upper edge and a curved lower edge. In some embodiments, the curved upper edge and the curved lower edge may converge to form a curved or curvilinear distal end of the medial side wing or the lateral side wing.

In some non-limiting embodiments, the reinforcement structure may comprise a symmetric wing configuration. In other non-limiting embodiments, the reinforcement structure may comprise an asymmetric wing configuration.

In some embodiments, the lateral side wing and/or the medial side wing may extend forward to or towards the forefoot region of the sole assembly. In other embodiments, the lateral side wing and/or the medial side wing may extend rearward to or towards the heel region of the sole assembly. In some alternative embodiments, the lateral side wing may extend forward to or towards the forefoot region of the sole assembly, and the medial side wing may extend rearward to or towards the heel region of the sole assembly. In other alternative embodiments, the medial side wing may extend forward to or towards the forefoot region of the sole assembly, and the lateral side wing may extend rearward to or towards the heel region of the sole assembly.

Referring still to FIGS. 20A-20C, in some embodiments, the golf shoe may comprise a reinforcement structure 2000. In some cases, the reinforcement structure 2000 may include a central support extending from the heel region 2001 across the midfoot region 2002 towards the forefoot region 2003 of the golf shoe. In some cases, the rear portion of the central support may be positioned adjacent to a subject's heel. In some cases, the middle portion of the central support may extend or slope downwards so that the middle portion is positioned closer to the ground surface than the rear portion of the central support. In some cases, the front portion of the central support may extend or slope upwards so that the front portion is positioned adjacent to the subject's toes. In some cases, the front portion of the central support may be positioned further away from the ground surface than the middle portion of the central support.

In some embodiments, the reinforcement structure 2000 may comprise one or more medial or lateral supports 2010 positioned along a medial side and/or a lateral side of the sole assembly. In some embodiments, the one or more medial or lateral supports 2010 may comprise a medial support 2011 and a lateral support 2012. In some embodiments, the central support may extend between the medial support 2011 and the lateral support 2012. In some embodiments, the medial support 2011 and the lateral support 2012 may be positioned on different or opposite sides of the central support. In some embodiments, the medial support 2011 and the lateral support 2012 may extend upwards from the central support. In some embodiments, the medial support 2011 and the lateral support 2012 may extend across or over a sole component or an upper portion of the golf shoe.

As shown in FIGS. 20B and 20C, in some embodiments, the reinforcement structure 2000 may be integrated with a midsole of the golf shoe. In some embodiments, the midsole may comprise a first midsole component 2020 and a second midsole component 2030. In some cases, the first midsole component 2020 may extend from a heel region of the sole assembly to a midfoot region of the sole assembly. In some cases, the second midsole component 2030 may extend from a forefoot region of the sole assembly to the midfoot region of the sole assembly.

In some embodiments, the first midsole component 2020 may extend to a first location in the midfoot region. In some embodiments, the second midsole component 2030 may extend to a second location in the midfoot region. In some embodiments, the first location and the second location may be offset relative to each other. In some embodiments, the first midsole component and the second midsole component may overlap each other. In other embodiments, the first midsole component 2020 and the second midsole component 2030 may not or need not overlap each other. In some embodiments, the first midsole component 2020 and the second midsole component 2030 may extend to or towards (i) a same location or (ii) two or more locations that are adjacent or proximal to each other.

In some embodiments, the first midsole component 2020 may have a first thickness at the heel region and a second thickness at the midfoot region. In some embodiments, the second thickness may be less than the first thickness. In some embodiments, the second midsole component 2030 may have a first thickness at the forefoot region and a second thickness at the midfoot region. In some embodiments, the second thickness may be less than the first thickness.

In some embodiments, the first midsole component 2020 may comprise a first end disposed in the heel region and a second end disposed in the midfoot region. In some embodiments, the second midsole component 2030 may comprise a first end disposed in the forefoot region and a second end disposed in the midfoot region. In some embodiments, the second end of the first midsole component 2020 may be positioned closer to the forefoot region of the sole assembly than the second end of the second midsole component 2030. In other embodiments, the second end of the second midsole component 2030 may be positioned closer to the forefoot region of the sole assembly than the second end of the first midsole component 2020. In some embodiments, the second end of the second midsole component 2030 may be positioned closer to the heel region of the sole assembly than the second end of the first midsole component 2020. In other embodiments, the second end of the first midsole component 2020 may be positioned closer to the heel region of the sole assembly than the second end of the second midsole component 2030.

In some embodiments, the first midsole component 2020 may have a top surface that contacts a bottom surface of the reinforcement structure. In some embodiments, the second midsole component 2030 may have a bottom surface that contacts a top surface of the reinforcement structure. In some embodiments, the top surface of the first midsole component 2020 may be configured to slope downwards as the first midsole component extends from the heel region towards the midfoot region. In some embodiments, a curvature of the top surface of the first midsole component 2020 may correspond to a curvature of the bottom surface of the reinforcement structure. In some embodiments, the bottom surface of the second midsole component 2030 may be configured to slope upwards as the second midsole component extends from the forefoot region towards the midfoot region. In some embodiments, a curvature of the bottom surface of the second midsole component 2030 may correspond to a curvature of the top surface of the reinforcement structure.

FIG. 20C schematically illustrates an exemplary golf shoe comprising a reinforcement structure 2000. In some embodiments, the reinforcement structure 2000 may comprise a central support and one or more medial or lateral supports extending from different or opposite sides of the central support. In some embodiments, the one or more medial or lateral supports may comprise a medial support 2011 extending from a medial side of the reinforcement structure towards a heel region of the shoe and a lateral support 2012 extending from a lateral side of the reinforcement structure towards the heel region of the shoe. In such embodiments, the medial support 2011 and the lateral support 2012 may be configured to stiffen and support the medial and/or lateral sides of the heel region of the shoe (e.g., during golf-related actions or movements).

In some embodiments, the reinforcement structure 2000 may be positioned between a first midsole component 2020 and a second midsole component 2030 as described elsewhere herein. In some embodiments, the first midsole component 2020 may be positioned between an outsole 2040 of the shoe and a bottom or lower surface of the reinforcement structure 2000. In some embodiments, the second midsole component 2030 may be positioned between an upper surface of the reinforcement structure 2000 and a bottom or lower surface of an insole component, a lasting board, a footbed, or an upper of the shoe.

In some embodiments, a forefoot end of the reinforcement structure 2000 may be positioned between the outsole 2040 of the shoe and a bottom or lower surface of the second midsole component 2030. In some embodiments, a midfoot portion of the reinforcement structure 2000 may be positioned between an upper surface of the first midsole component 2020 and the bottom or lower surface of the second midsole component 2030. In some embodiments, a rearfoot end of the reinforcement structure 2000 may be positioned between the upper surface of the first midsole component 2020 and a bottom or lower surface of the insole component, the lasting board, the footbed, or the upper of the shoe.

Figure 21A:
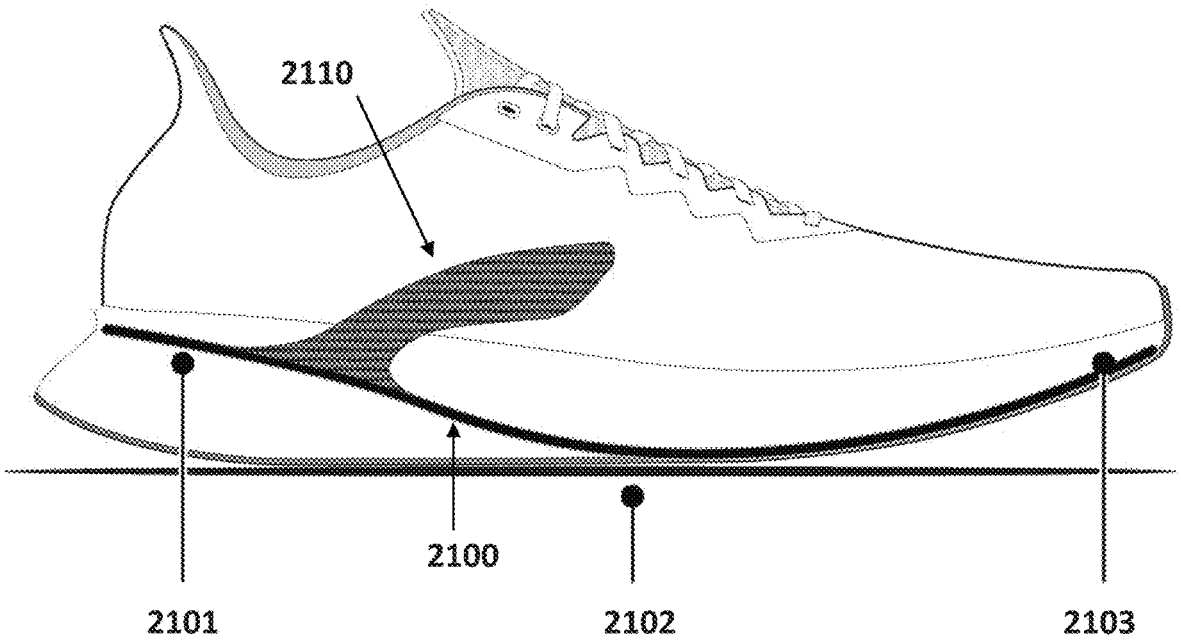
FIGS. 21A-21C depict another example of a golf shoe comprising a reinforcement structure, in accordance with other embodiments of the present disclosure.
Figure 21B:
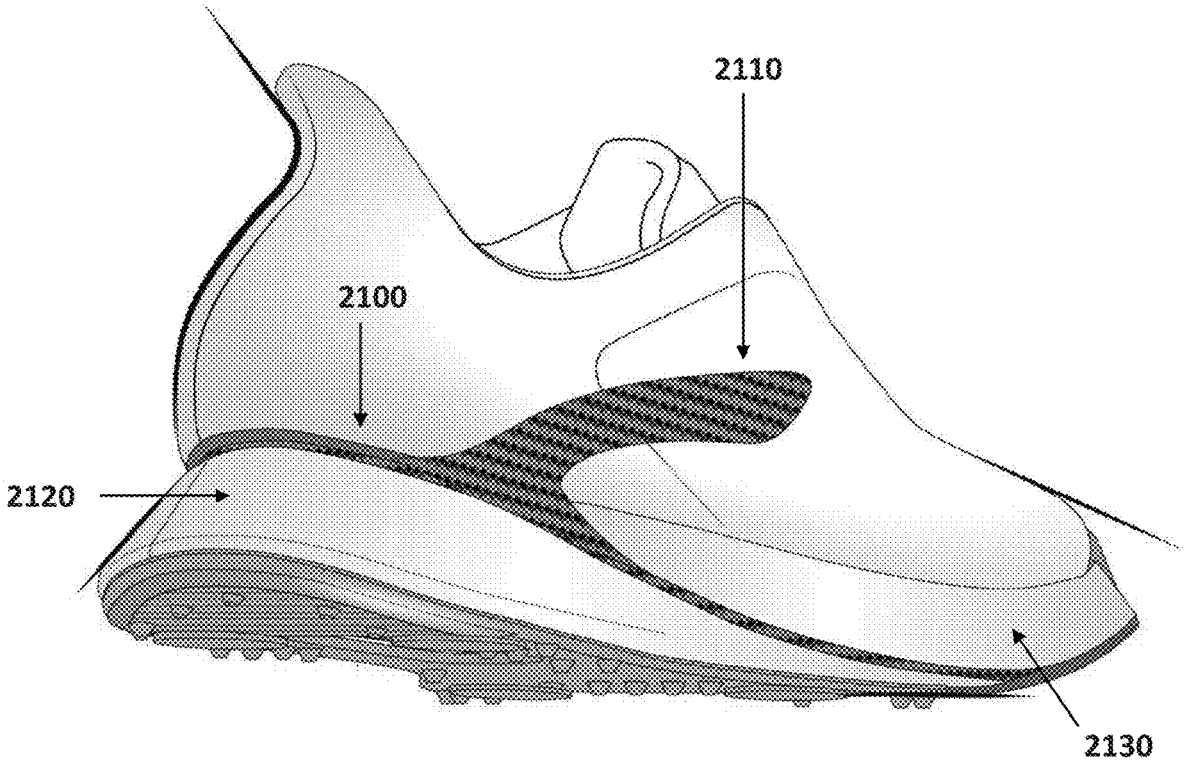
Figure 21C:
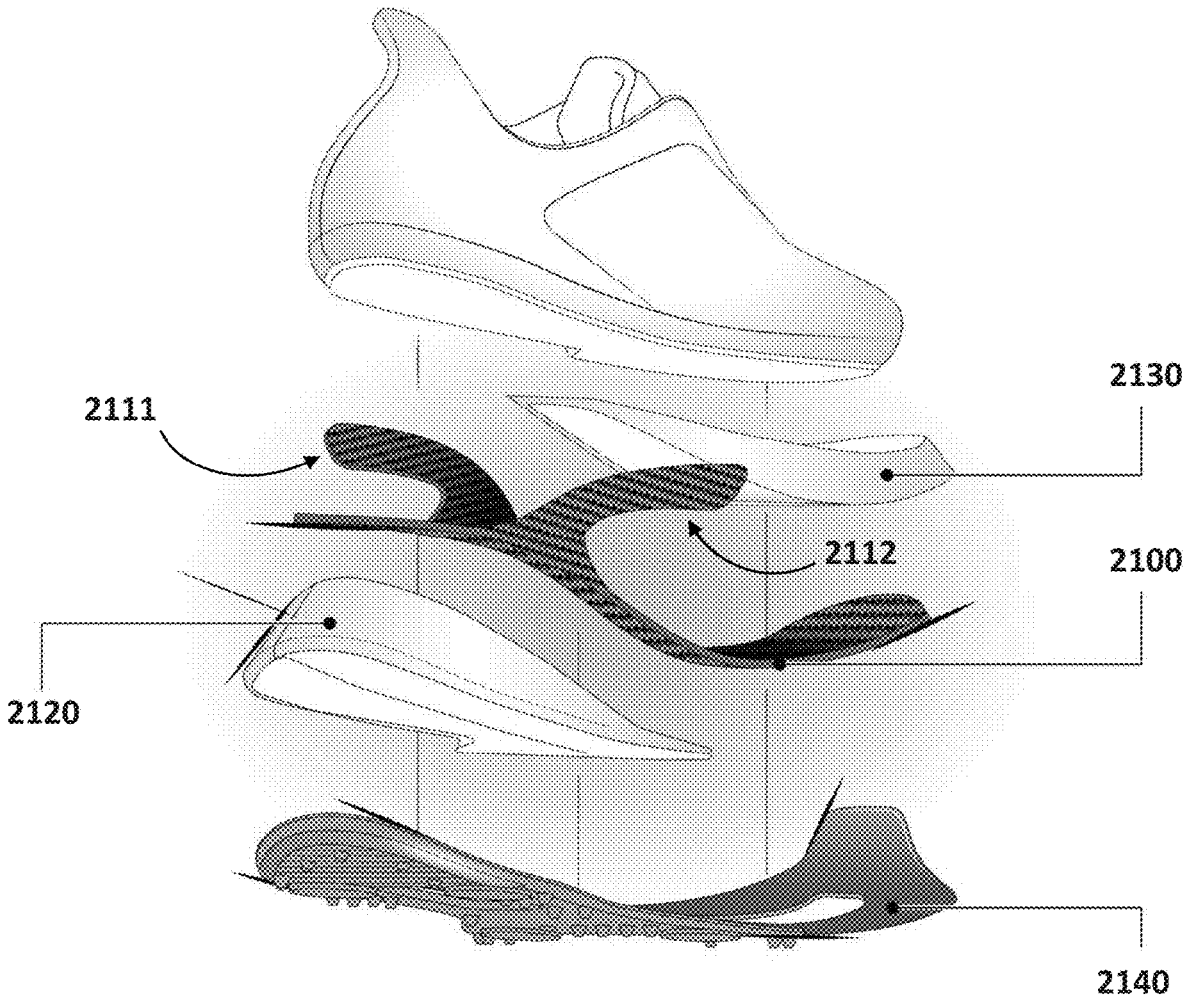

FIGS. 21A-21C schematically illustrate various alternative embodiments of a golf shoe comprising a reinforcement structure 2100. In some embodiments, the reinforcement structure 2100 may comprise an asymmetric reinforcement structure with one or more medial or lateral supports 2110.

In some embodiments, the reinforcement structure 2100 may include a central support extending from the heel region 2101 across the midfoot region 2102 towards the forefoot region 2103 of the golf shoe. In some cases, the rear portion of the central support may be positioned adjacent to a subject's heel. In some cases, the middle portion of the central support may extend or slope downwards so that the middle portion is positioned closer to the ground surface than the rear portion of the central support. In some cases, the front portion of the central support may extend or slope upwards so that the front portion is positioned adjacent to the subject's toes. In some cases, the front portion of the central support may be positioned further away from the ground surface than the middle portion of the central support.

As shown in FIGS. 21B and 21C, in some embodiments, the reinforcement structure 2100 may be integrated with a midsole of the golf shoe. In some embodiments, the midsole may comprise a first midsole component 2120 and a second midsole component 2130. In some cases, the first midsole component 2120 may extend from a heel region of the sole assembly to a midfoot region of the sole assembly. In some cases, the second midsole component 2130 may extend from a forefoot region of the sole assembly to the midfoot region of the sole assembly.

In some embodiments, the first midsole component 2120 may extend to a first location in the midfoot region. In some embodiments, the second midsole component 2130 may extend to a second location in the midfoot region. In some embodiments, the first location and the second location may be offset relative to each other. In some embodiments, the first midsole component and the second midsole component may overlap each other. In other embodiments, the first midsole component 2120 and the second midsole component 2130 may not or need not overlap each other. In some embodiments, the first midsole component 2120 and the second midsole component 2130 may extend to or towards (i) a same location or (ii) two or more locations that are directly adjacent or proximal to each other.

In some embodiments, the first midsole component 2120 may have a first thickness at the heel region and a second thickness at the midfoot region. In some embodiments, the second thickness may be less than the first thickness. In some embodiments, the second midsole component 2130 may have a first thickness at the forefoot region and a second thickness at the midfoot region. In some embodiments, the second thickness may be less than the first thickness.

In some embodiments, the first midsole component 2120 may comprise a first end disposed in the heel region and a second end disposed in the midfoot region. In some embodiments, the second midsole component 2130 may comprise a first end disposed in the forefoot region and a second end disposed in the midfoot region. In some embodiments, the second end of the first midsole component 2120 may be positioned closer to the forefoot region of the sole assembly than the second end of the second midsole component. In other embodiments, the second end of the second midsole component 2130 may be positioned closer to the forefoot region of the sole assembly than the second end of the first midsole component. In some embodiments, the second end of the second midsole component 2130 may be positioned closer to the heel region of the sole assembly than the second end of the first midsole component. In other embodiments, the second end of the first midsole component 2120 may be positioned closer to the heel region of the sole assembly than the second end of the second midsole component.

In some embodiments, the first midsole component 2120 may have a top surface that contacts a bottom surface of the reinforcement structure. In some embodiments, the second midsole component 2130 may have a bottom surface that contacts a top surface of the reinforcement structure. In some embodiments, the top surface of the first midsole component 2120 may be configured to slope downwards as the first midsole component extends from the heel region towards the midfoot region. In some embodiments, a curvature of the top surface of the first midsole component 2120 may correspond to a curvature of the bottom surface of the reinforcement structure. In some embodiments, the bottom surface of the second midsole component 2130 may be configured to slope upwards as the second midsole component extends from the forefoot region towards the midfoot region. In some embodiments, a curvature of the bottom surface of the second midsole component 2130 may correspond to a curvature of the top surface of the reinforcement structure.

FIG. 21C schematically illustrates an exemplary golf shoe comprising a reinforcement structure 2100. In some embodiments, the reinforcement structure 2100 may comprise a central support and one or more medial or lateral supports extending from different or opposite sides of the central support. In some embodiments, the one or more medial or lateral supports may comprise a medial support 2111 extending from a medial side of the reinforcement structure towards a heel region of the shoe and a lateral support 2112 extending from a lateral side of the reinforcement structure towards the midfoot or forefoot region of the shoe. In such embodiments, the medial support 2111 may be configured to stiffen and support the medial side of the heel region of the shoe, and the lateral support 2012 may be configured to stiffen and support the lateral side of the midfoot or forefoot region of the shoe (e.g., during various golf-related actions or movements).

In some embodiments, the reinforcement structure 2100 may be positioned between a first midsole component 2120 and a second midsole component 2130 as described elsewhere herein. In some embodiments, the first midsole component 2120 may be positioned between an outsole 2140 of the shoe and a bottom or lower surface of the reinforcement structure 2100. In some embodiments, the second midsole component 2130 may be positioned between an upper surface of the reinforcement structure 2100 and a bottom or lower surface of an insole component, a lasting board, a footbed, or an upper of the shoe.

In some embodiments, a forefoot end of the reinforcement structure 2100 may be positioned between the outsole 2140 of the shoe and a bottom or lower surface of the second midsole component 2130. In some embodiments, a midfoot portion of the reinforcement structure 2100 may be positioned between an upper surface of the first midsole component 2120 and the bottom or lower surface of the second midsole component 2130. In some embodiments, a rearfoot end of the reinforcement structure 2100 may be positioned between the upper surface of the first midsole component 2120 and a bottom or lower surface of the insole component, the lasting board, the footbed, or the upper of the shoe.

Figure 22A:
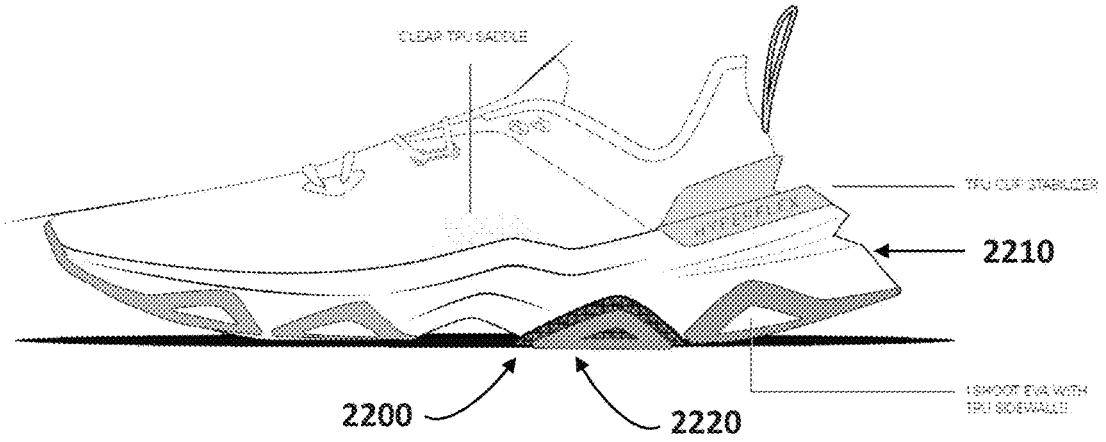
FIGS. 22A-22B and 23A-23B depict additional examples of a golf shoe comprising a reinforcement structure, in accordance with embodiments of the present disclosure.
Figure 22B:
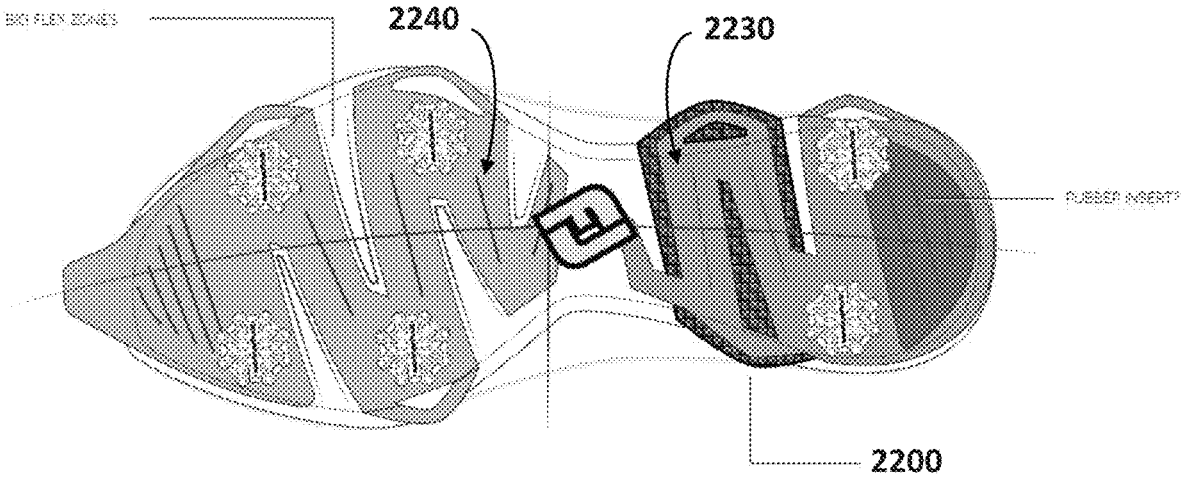

FIGS. 22A and 22B schematically illustrate another non-limiting example of a golf shoe according to various embodiments of the present disclosure. In some embodiments, the golf shoe may comprise an upper, a sole assembly, and a reinforcement structure 2200 integrated with the sole assembly.

In some cases, the sole assembly may comprise a midsole component 2210 and an outsole component 2220. In some embodiments, the outsole component 2220 of the golf shoe may comprise a first traction zone 2230 located in the rearfoot region or the midfoot region of the golf shoe and a second traction zone 2240 located in the midfoot region or the forefoot region of the golf shoe. In some embodiments, the first traction zone and/or the second traction zone may comprise one or more portions, sections, or regions that extend along a bottom surface of the outsole component in a wave-like configuration. In some cases, the wave-like configuration may be periodic and/or symmetrical. In some cases, the wave-like configuration may be aperiodic and/or asymmetrical. In some embodiments, the first traction zone and/or the second traction zone may comprise one or more portions, sections, or regions that extend upwards and/or along a lateral side or a medial side of the outsole component of the golf shoe in a wave-like configuration. In some cases, the wave-like configuration may be periodic and/or symmetrical. In some cases, the wave-like configuration may be aperiodic and/or asymmetrical.

In some embodiments, the golf shoe may comprise a reinforcement structure 2200. In some embodiments, the reinforcement structure 2200 may comprise a bottom loaded U-shaped support frame as described elsewhere herein. In some embodiments, the reinforcement structure 2200 may be embedded in or integrated with the midsole component 2210 and/or the outsole component 2220 of the golf shoe. In some embodiments, a portion of the reinforcement structure 2200 may be integrated with or disposed directly adjacent to one or more traction zones of the outsole component 2220 of the golf shoe. In some embodiments, a portion of the reinforcement structure 2200 may be positioned between the midsole component and the outsole component of the golf shoe.

In some embodiments, the reinforcement structure 2200 may include a central support extending between the medial side and the lateral side of the golf shoe. In some embodiments, a portion of the central support may be exposed through the midsole component or the outsole component of the golf shoe. In some embodiments, the reinforcement structure 2200 may include a medial support and/or a lateral support extending upwards and/or along the medial or lateral side of the outsole component 2220 or the midsole component 2210. In some embodiments, a portion of the medial support and/or a portion of the lateral support may be exposed or visible through the midsole component or the outsole component of the golf shoe.

In some embodiments, the outsole may comprise a plurality of flex zones extending across the outsole. The plurality of flex zones may not or need not include any traction members or traction elements. In some embodiments, the flex zones may be positioned and/or oriented to separate or divide different regions or subregions of the first traction zone 2230 and the second traction zone 2240 to yield an outsole with traction zones extending across the bottom surface of the outsole in a wave-like configuration. In some cases, the plurality of flex zones may extend between adjacent cleats or adjacent cleat receptacles provided on the outsole.

In some embodiments, the first traction zone 2230 may comprise a first material and the second traction zone 2240 may comprise a second material. In some cases, the first material may be the same as the second material. In other cases, the first material and the second material may be different. In some cases, the first material and/or the second material may comprise a TPU-based material and/or a rubber-based material. In some cases, the first material may comprise one of a TPU-based or a rubber-based material, and the second material may comprise the other of the TPU-based or rubber-based material.

In some embodiments, one or more additional materials may be embedded in or integrated with the midsole component and/or the outsole component. In some cases, the one or more additional materials may form a TPU insert, a rubber insert, or a composite insert that provides additional traction, grip, structural support, and/or stability.

In some non-limiting or optional embodiments, the upper may comprise a saddle construction. The saddle construction may include any of the internal or external saddles described in further detail elsewhere herein. In some cases, the saddle construction may comprise a TPU saddle construction.

In some non-limiting or optional embodiments, the golf shoe may comprise a sole construction with one or more supporting sidewalls. In some cases, the sole construction may comprise a one-shot or a multi-shot EVA construction with one or more supporting sidewalls. In some cases, the one or more supporting sidewalls may be attached, coupled to, or integrally formed with the sole construction (or any portion or component thereof). In some cases, the one or more supporting sidewalls may comprise one or more TPU sidewalls.

In some non-limiting or optional embodiments, the golf shoe may include a stabilizer provided in a heel region of the upper or the sole assembly. In some cases, the stabilizer may comprise a TPU clip stabilizer.

Figure 23A:
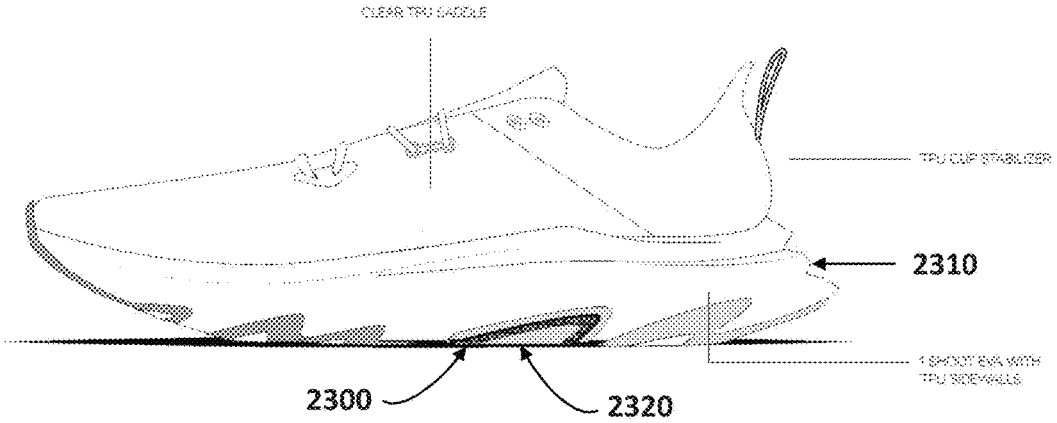
Figure 23B:
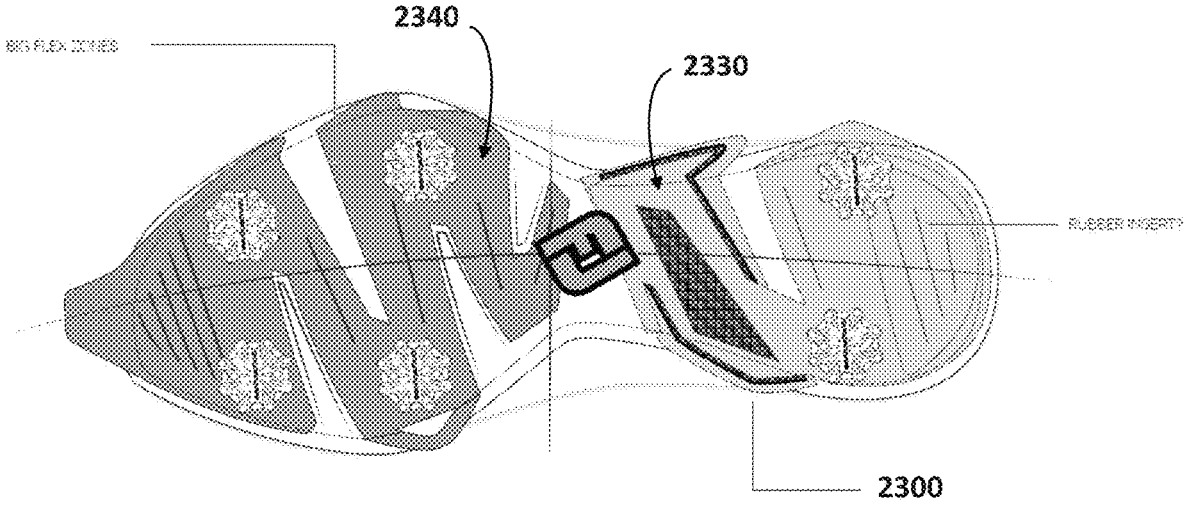

FIGS. 23A and 23B schematically illustrate another non-limiting embodiment of a golf shoe. In some embodiments, the golf shoe may comprise an upper, a sole assembly, and a reinforcement structure 2300 integrated with the sole assembly.

In some cases, the sole assembly may comprise a midsole component and an outsole component. In some embodiments, the outsole component 2220 of the golf shoe may comprise a first traction zone 2330 located in the rearfoot region or the midfoot region of the golf shoe and a second traction zone 2340 located in the midfoot region or the forefoot region of the golf shoe. In some embodiments, the first traction zone and/or the second traction zone may comprise one or more portions, sections, or regions that extend along a bottom surface of the outsole component in a wave-like configuration. In some cases, the wave-like configuration may be periodic and/or symmetrical. In some cases, the wave-like configuration may be aperiodic and/or asymmetrical. In some embodiments, the first traction zone and/or the second traction zone may comprise one or more portions, sections, or regions that extend upwards and/or along a lateral side or a medial side of the outsole component of the golf shoe in a wave-like configuration. In some cases, the wave-like configuration may be periodic and/or symmetrical. In some cases, the wave-like configuration may be aperiodic and/or asymmetrical.

In some embodiments, the golf shoe may comprise a reinforcement structure 2300. In some embodiments, the reinforcement structure 2300 may comprise a bottom loaded U-shaped support frame as described elsewhere herein. In some embodiments, the reinforcement structure may be embedded in or integrated with the midsole component 2310 and/or the outsole component 2320 of the golf shoe. In some embodiments, a portion of the reinforcement structure 2300 may be integrated with or disposed directly adjacent to one or more traction zones of the outsole component 2220 of the golf shoe. In some embodiments, a portion of the reinforcement structure 2300 may be positioned between the midsole component and the outsole component of the golf shoe.

In some embodiments, the reinforcement structure 2300 may include a central support extending between the medial side and the lateral side of the golf shoe. In some embodiments, one or more portions or sections of the central support may be exposed through the midsole component or the outsole component of the golf shoe. In some embodiments, the reinforcement structure 2300 may include a medial support and/or a lateral support extending upwards and/or along the medial or lateral side of the outsole component 2320 or the midsole component 2310. In some embodiments, one or more portions or sections of the medial support and/or the lateral support may be exposed or visible through the midsole component or the outsole component of the golf shoe.

In some embodiments, the outsole may comprise a plurality of flex zones extending across the outsole. The plurality of flex zones may not or need not include any traction members or traction elements. In some embodiments, the flex zones may be positioned and/or oriented to separate or divide different regions or subregions of the first traction zone 2330 and the second traction zone 2340 to yield an outsole with traction zones extending across the bottom surface of the outsole in a wave-like configuration. In some cases, the plurality of flex zones may extend between adjacent cleats or adjacent cleat receptacles provided on the outsole.

In some embodiments, the first traction zone 2330 may comprise a first material and the second traction zone 2340 may comprise a second material. In some cases, the first material may be the same as the second material. In other cases, the first material and the second material may be different. In some cases, the first material and/or the second material may comprise a TPU-based material and/or a rubber-based material. In some cases, the first material may comprise one of a TPU-based or a rubber-based material, and the second material may comprise the other of the TPU-based or rubber-based material.

In some embodiments, one or more additional materials may be embedded in or integrated with the midsole component and/or the outsole component. In some cases, the one or more additional materials may form a TPU insert, a rubber insert, or a composite insert that provides additional traction, grip, structural support, and/or stability.

Suspension

In some non-limiting aspects, the present disclosure provides various examples of golf shoes comprising a three-dimensional shank. In some embodiments, the three-dimensional shank may comprise a suspension system and a plurality of supports extending on different sides of the suspension system to support a lateral side and a medial side of the sole assembly.

In some embodiments, the suspension system may comprise (i) a body portion that is integrally formed with the plurality of supports and (ii) a spring portion that extends underneath the body portion from a first end of the body portion to a second end of the body portion. In some embodiments, the spring portion and the body portion may be configured to move vertically relative to each other based on an amount of force exerted on the sole assembly during a golf-related action or movement.

3D Shank

Figure 24A:
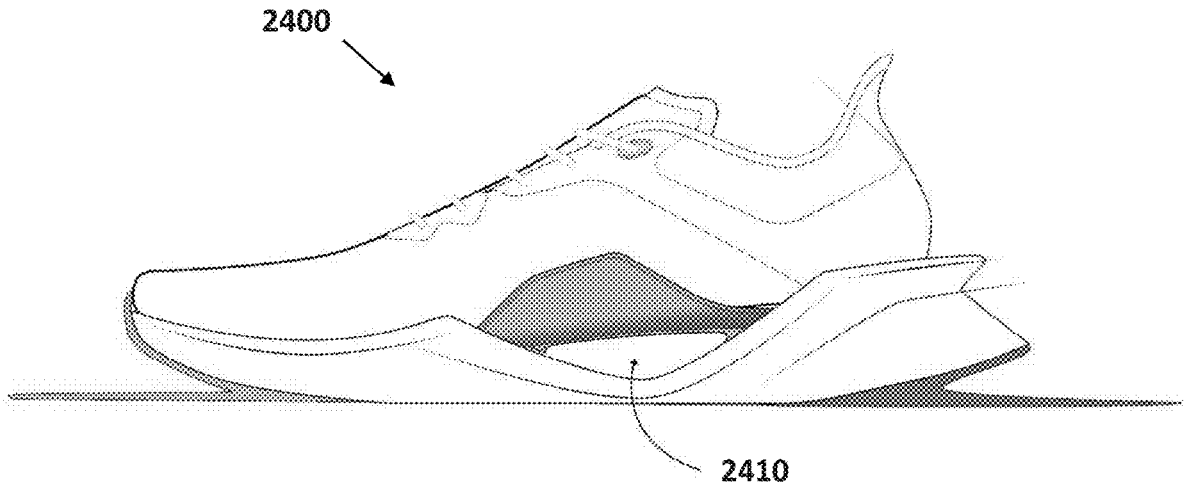
FIGS. 24A-24B schematically illustrate a golf shoe comprising a three-dimensional shank with an integrated suspension system, in accordance with some embodiments.
Figure 24B:
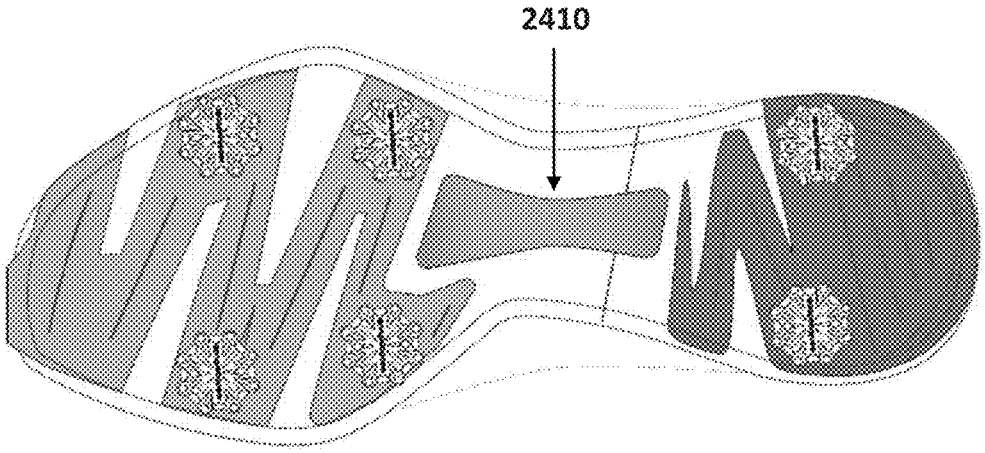

Referring now to FIGS. 24A and 24B, in one aspect, the present disclosure provides various examples and embodiments of a golf shoe 2400 comprising a three-dimensional (3D) shank 2410. In some embodiments, the 3D shank 2410 may be configured as a suspension component for the golf shoe.

In some embodiments, the 3D shank 2410 may comprise a spring structure that is configured to provide a suspension effect in response to forces or loads exerted on the golf shoe (e.g., during a golf-related action or movement). In some cases, a portion of the spring structure may be exposed or visible through a bottom surface of the outsole of the shoe.

In some embodiments, a spring portion of the suspension system may be visible on or through a bottom surface of the outsole. In some embodiments, the spring portion of the suspension system may be exposed via one or more apertures or windows provided within a select portion, section, or region of the outsole.

Figure 25:
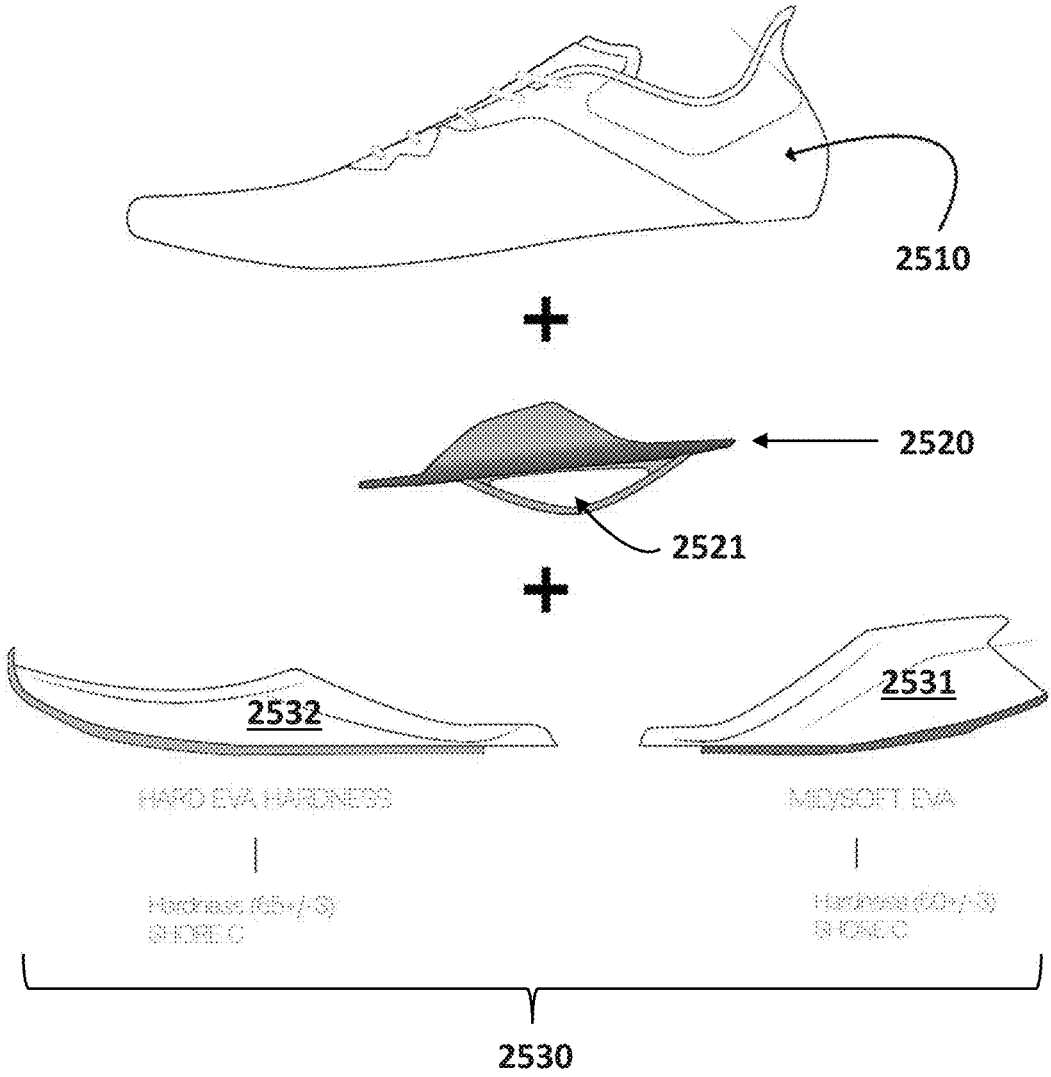
FIG. 25 schematically illustrates an exemplary sole construction for a golf shoe comprising an integrated suspension system.

FIG. 25 schematically illustrates an exemplary construction for the golf shoes shown in FIGS. 24A and 24B. In some embodiments, the golf shoes may comprise an upper 2510, a sole assembly 2530, and a suspension system 2520 integrated between the upper 2510 and the sole assembly 2530.

In some embodiments, the suspension system 2520 may comprise a three-dimensional shank structure that is configured to support the sole assembly or multiple components or subcomponents of the sole assembly and to prevent select portions or regions of the sole assembly from collapsing. In some embodiments, the three-dimensional shank may incorporate a functional opening 2521 with an adjustable size and shape depending on the amount of force exerted on the shank. In some embodiments, the three-dimensional shank may be integrated with various different midsole constructions (e.g., a split bottom midsole construction or a midsole construction with one or more recessed midfoot/arch regions having a shape or profile corresponding to the shape or profile of the 3D shank) to achieve a see-through or partially see-through sole construction that reduces the overall weight of the sole assembly without compromising cushioning or suspension performance. The three-dimensional shank may be structurally and functionally configured to ensure that the see-through or partially see-through sole construction does not compromise the structural support needed in the midfoot region of the midsole component of the golf shoe (e.g., when a subject wearing the shoe is standing, walking, running, or executing a golf-related action or movement).

In some embodiments, the sole assembly 2530 may comprise a midsole with a varying material property. In some embodiments, the midsole may comprise a first midsole region with a first hardness and a second midsole region with a second hardness. In some embodiments, the first midsole region may extend between a midfoot region and a rearfoot region of the sole assembly. In some embodiments, the second midsole region may extend between the midfoot region and a forefoot region of the sole assembly. In some embodiments, the first hardness of the first midsole region may be less than the second hardness of the second midsole region. In some embodiments, the first hardness may range from about 45 Shore C Hardness to about 55 Shore C Hardness. In some embodiments, the second hardness may range from about 60 Shore C Hardness to about 70 Shore C Hardness.

In some embodiments, the sole assembly 2530 may comprise a first midsole portion 2531 having a first hardness and a second midsole portion 2532 having a second hardness that is different than the first hardness. In some cases, the first hardness may be less than or equal to the second hardness. In some cases, the second hardness may be greater than or equal to the first hardness. In some cases, the first midsole portion 2531 may have a hardness of about 50±3 Shore C hardness. In some cases, the second midsole portion 2532 may have a hardness of about 65±3 Shore C hardness.

Figure 26A:
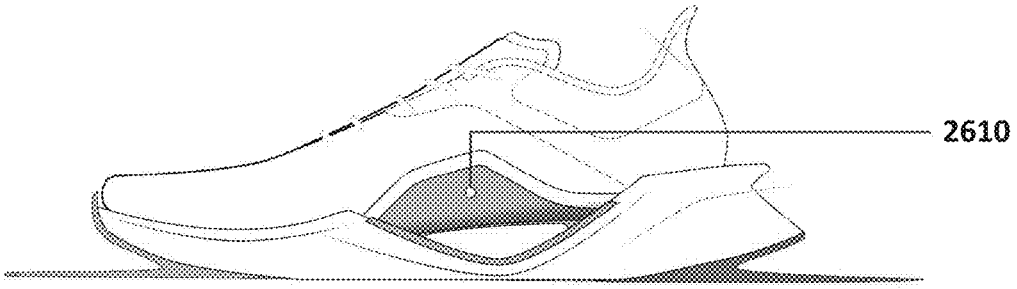
FIGS. 26A-26B schematically illustrate various examples of golf shoes comprising an integrated suspension system, in accordance with some embodiments.
Figure 26B:
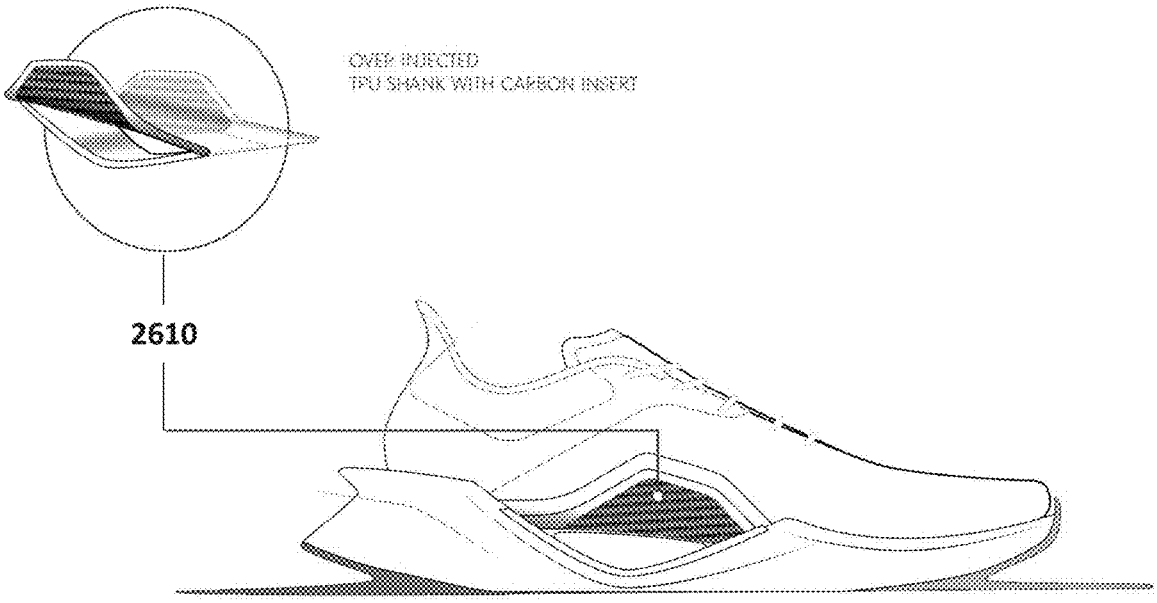

As shown in FIG. 26A, in some embodiments, the reinforcement structure 2610 may comprise a molded TPU reinforcement structure. In some optional embodiments (e.g., as shown in FIG. 26B), the reinforcement structure 2610 may comprise a shank with a composite insert. In some embodiments, the composite insert may comprise one or more strands or layers of composite material. In some embodiments, the reinforcement structure 2610 may comprise an over injected TPU shank with a composite insert.

Figure 27:
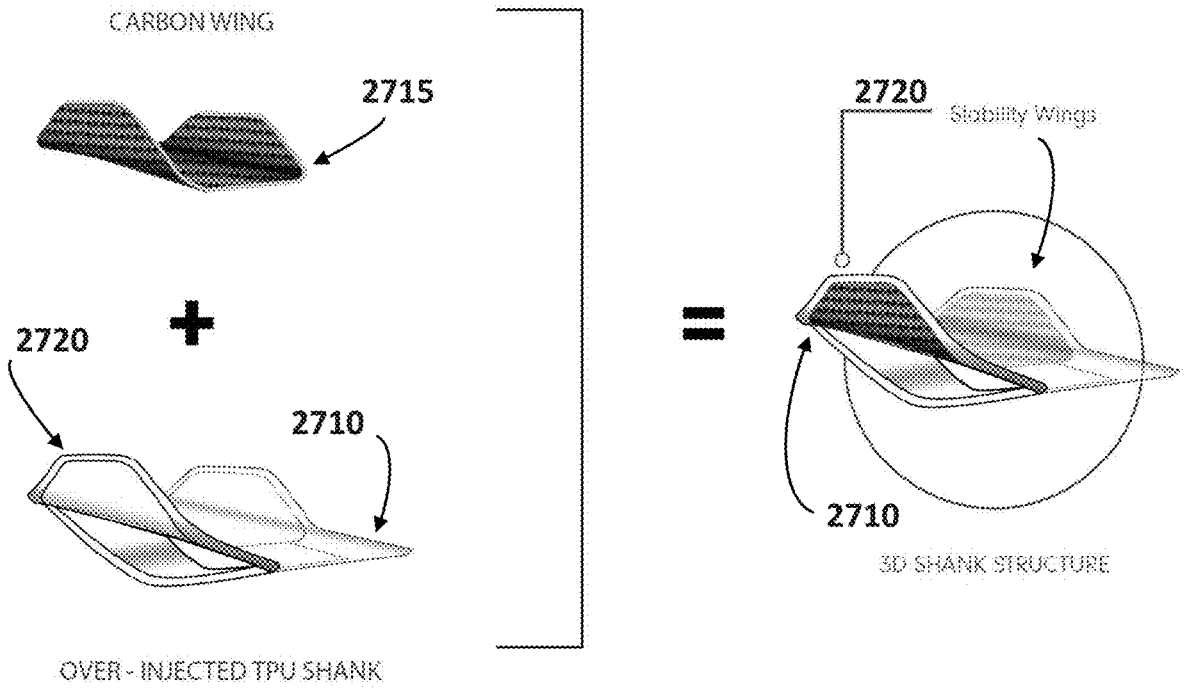
FIGS. 27, 28, 28A, and 28B schematically illustrate various non-limiting examples of a three-dimensional shank structure that can be integrated with any of the golf shoes disclosed herein, in accordance with some embodiments.
Figure 28:
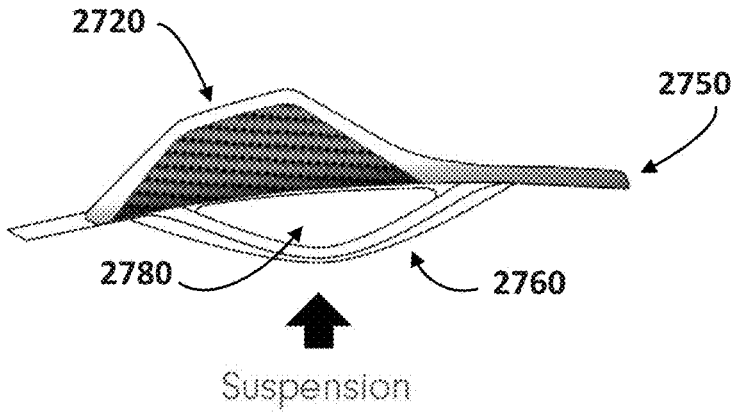

FIGS. 27 and 28 illustrate an exemplary construction for a 3D shank structure 2710 for a golf shoe. In some embodiments, the 3D shank structure 2710 may be configured as a shank structure that structurally supports a midsole component or multiple midsole components of the golf shoe to prevent the midsole component(s) from collapsing under a load or a weight of a subject. In some embodiments, the shank structure 2710 may comprise a body portion 2750 and a spring portion 2760 extending below the body portion 2750. In some embodiments, the spring portion 2760 may comprise an extension that curves or bends underneath the body portion 2750 from a first end of the body portion to a second end of the body portion. In some cases, the extension may comprise a curved or bent segment that is configured to flex or bend in response to a force or load exerted on the 3D shank structure.

In some embodiments, the body portion and the spring portion may form an opening 2780. In some embodiments, the opening 2780 may extend underneath the body portion of the 3D shank structure and between a medial side and a lateral side of the 3D shank structure. In some embodiments, the size and/or shape of the opening 2780 may change or vary based on an amount of force exerted on the 3D shank structure.

In some embodiments, the suspension system may comprise an opening 2780 disposed between the spring portion 2760 and the body portion 2750. In some embodiments, the opening 2780 may extend transversely between the medial and lateral sides of the suspension system. In some embodiments, the spring portion 2760 and the body portion 2750 may be configured to move towards each other to decrease a size of the opening 2780 when a force exceeding a pre-determined threshold is exerted on the sole assembly. In some embodiments, the spring portion 2760 and the body portion 2750 may be configured to move away from each other to increase the size of the opening 2780 when said force is released or reduced.

In some embodiments, the 3D shank structure 2710 may comprise one or more medial or lateral supports 2720 extending from or along a medial or lateral side of the body portion of the shank structure. In some embodiments, the one or more medial or lateral supports 2720 may be integrally formed with the body portion of the shank structure. In some embodiments, the one or more supports may be configured to extend upwards and/or along the sole assembly or the upper of the golf shoe. In some embodiments, the one or more supports may comprise a medial support and/or a lateral support as described elsewhere herein.

In some embodiments, the 3D shank structure 2710 may comprise a composite wing 2715 configured to enhance the structural support and stiffness provided by the 3D shank structure. In some embodiments, the composite wing 2715 may comprise one or more layers or strands of composite material that extend through the opening 2780 formed between the body portion 2750 and the spring portion 2760 of the 3D shank structure. In some embodiments, the composite wing 2715 may extend along an underside of the body portion 2750 of the 3D shank structure and/or along the outward facing sides of the medial and lateral supports 2720.

In some embodiments, the suspension system may comprise a composite layer extending between the plurality of supports. The composite layer may form a composite support structure such as a composite wing. In some embodiments, the composite wing may be configured to extend under the body portion and through an opening disposed between the spring portion and the body portion of the suspension system to further stiffen the suspension system.

Figure 28A:
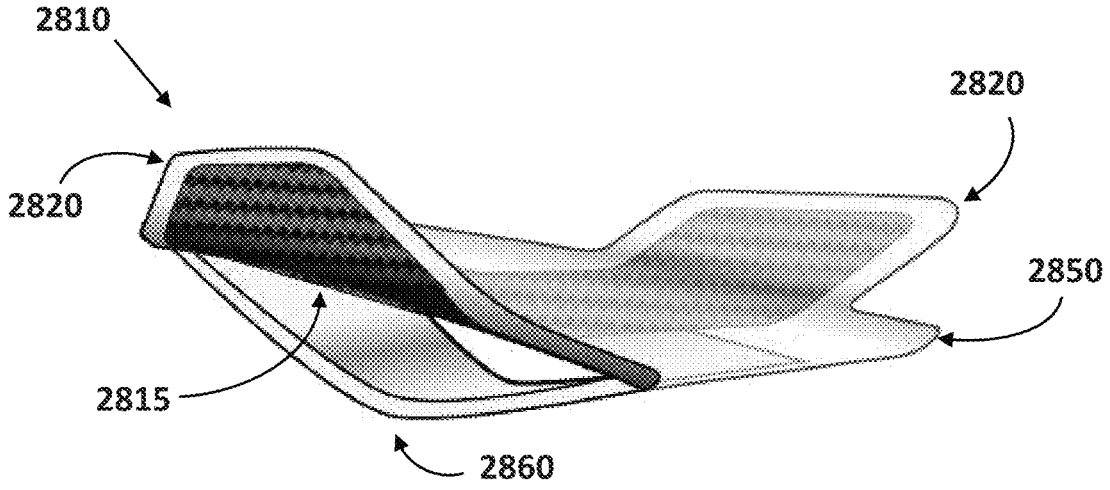
Figure 28B:
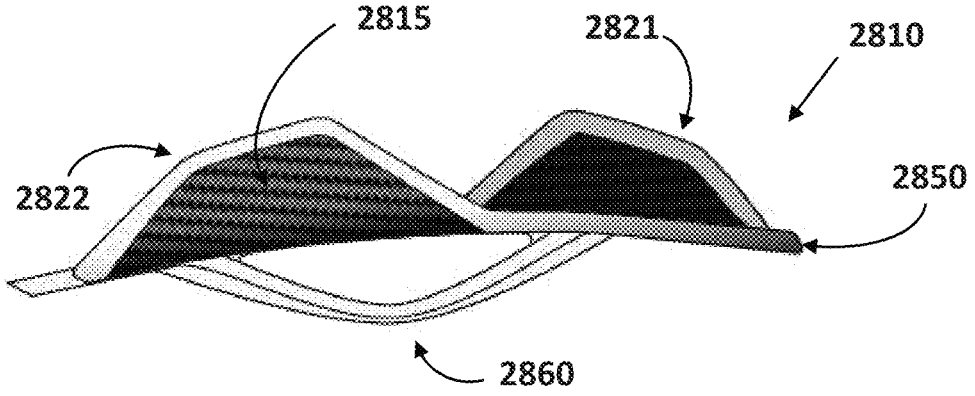

FIGS. 28A and 28B illustrate another example of a 3D shank structure 2810 that can be incorporated into or integrated with any of the shoes or sole assemblies disclosed herein. In some embodiments, the 3D shank structure 2810 may include a body portion 2850 and a spring portion 2860 extending below the body portion 2850. In some embodiments, the 3D shank structure 2810 may include one or more medial or lateral supports 2820 extending from a medial side and/or a lateral side of the body portion 2850 of the 3D shank structure 2810.

In some embodiments, the one or more medial or lateral supports 2820 may comprise a plurality of supports including a medial support 2821 and a lateral support 2822. In some embodiments, the medial support 2821 and the lateral support 2822 may be arranged in an asymmetrical configuration about a reference line bisecting the medial and lateral sides of the 3D shank structure. In some cases, the medial support 2821 and the lateral support 2822 may be positioned along different portions or sections of the medial and lateral sides of the shoe. In some cases, the medial support 2821 and the lateral support 2822 may be configured to extend along and/or support different portions or sections of the medial and lateral sides of the shoe. In some cases, the medial support 2821 and the lateral support 2822 may be oriented in different directions. In some cases, the medial support 2821 may be a different size and/or a different shape than the lateral support 2822.

In some embodiments, the 3D shank structure 2810 may comprise a composite layer 2815 configured to enhance the structural support and stiffness provided by the 3D shank structure. In some embodiments, the composite layer 2815 may comprise one or more layers or strands of composite material that extend along an underside of the body portion 2850 of the 3D shank structure and along the outward facing sides of the medial and lateral supports. In some embodiments, the one or more layers or strands of composite material may form a composite support layer that is configured to extend through an opening formed between the body portion 2850 and the spring portion 2860 of the 3D shank structure. In some embodiments, the composite support layer may be configured to extend between the medial support 2821 and the lateral support 2822 of the 3D shank structure.

Saddle System

In some embodiments, the golf shoes disclosed herein may comprise a saddle system. In some embodiments, the saddle system may be configured to wrap around or over the lateral and/or medial sides of a subject's foot. In some embodiments, the saddle system may be configured to engage a lace or a cable of the golf shoes disclosed herein. In some embodiments, the saddle system may comprise an external saddle system. In other embodiments, the saddle system may comprise an internal saddle system.

External Saddle

In some embodiments, the saddle system may comprise an external saddle system. In some embodiments, the external saddle system may be configured to extend across or over an outermost layer of the upper of the shoe. The outermost layer of the upper may comprise a layer of the upper that is directly exposed to an external environment. In some cases, the outermost layer of the upper may extend under the external saddle and/or underneath a shank structure or a medial or lateral support of the shoe.

Figure 29A:
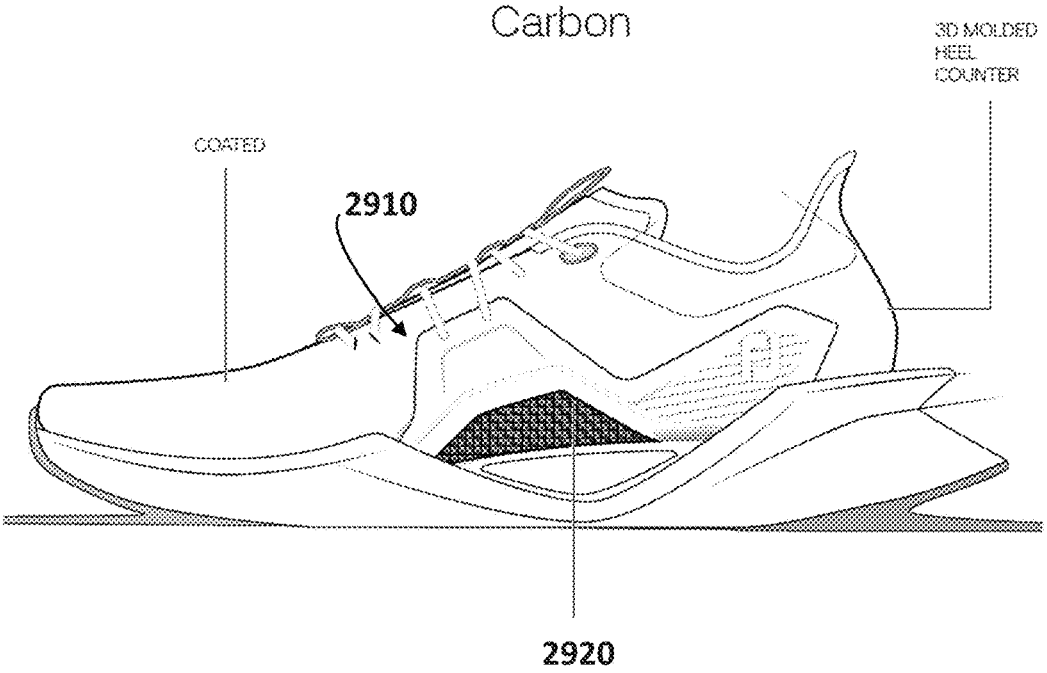
FIGS. 29A-29B, 30, 31, and 32 schematically illustrate various examples of golf shoes incorporating an external saddle configuration, in accordance with some embodiments.
Figure 29B:
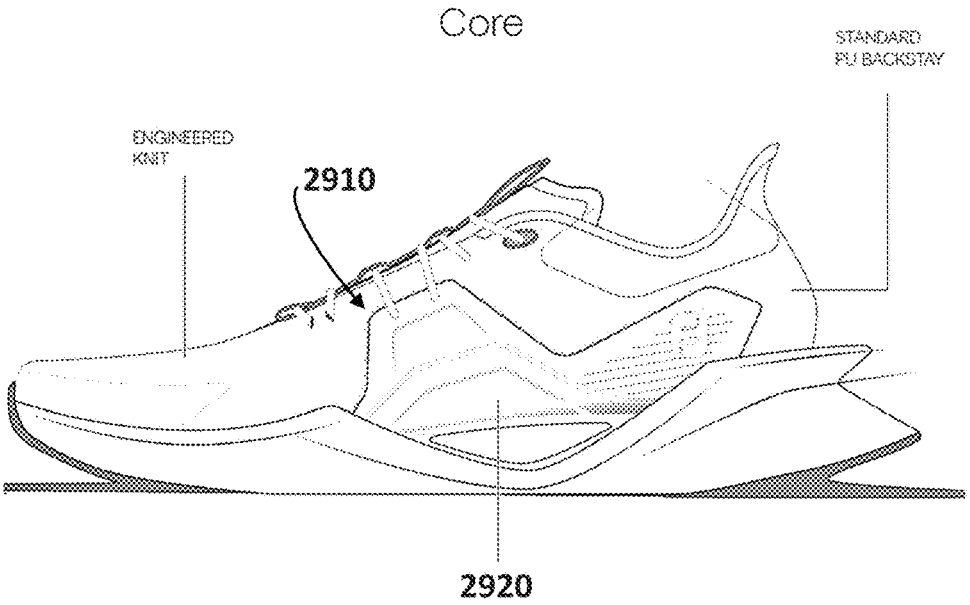

FIGS. 29A and 29B schematically illustrate an example of a golf shoe comprising an external saddle 2910. The external saddle 2910 may be configured to engage or interface with one or more cables or laces of the golf shoe. In some embodiments, the external saddle 2910 may be integrated with or attached to one or more medial or lateral support structures of the shoe. In some embodiments, the external saddle 2910 may extend from one or more medial or lateral supports of the golf shoe. The one or more medial or lateral supports may be integrally formed with a shank structure 2920 of the golf shoe as described elsewhere herein. In some embodiments, the shank structure 2920 may comprise a composite shank structure. In other embodiments, the shank structure 2920 may comprise a TPU shank structure. In some embodiments, the shank structure 2920 may be configured as a suspension system as described elsewhere herein. In other non-limiting embodiments, the shank structure 2920 may not or need not be configured as a suspension system.

In some embodiments, the golf shoe may comprise an upper material extending underneath the external saddle. In some embodiments, the upper material may comprise a synthetic material or a coated mesh material. In other embodiments, the upper material may comprise a knit material.

In some embodiments, the golf shoe may comprise a heel support. In some cases, the heel support may comprise an external heel counter. In some cases, the heel support may comprise a molded heel counter. In some cases, the heel support may comprise a polyurethane (PU) backstay.

Figure 30:
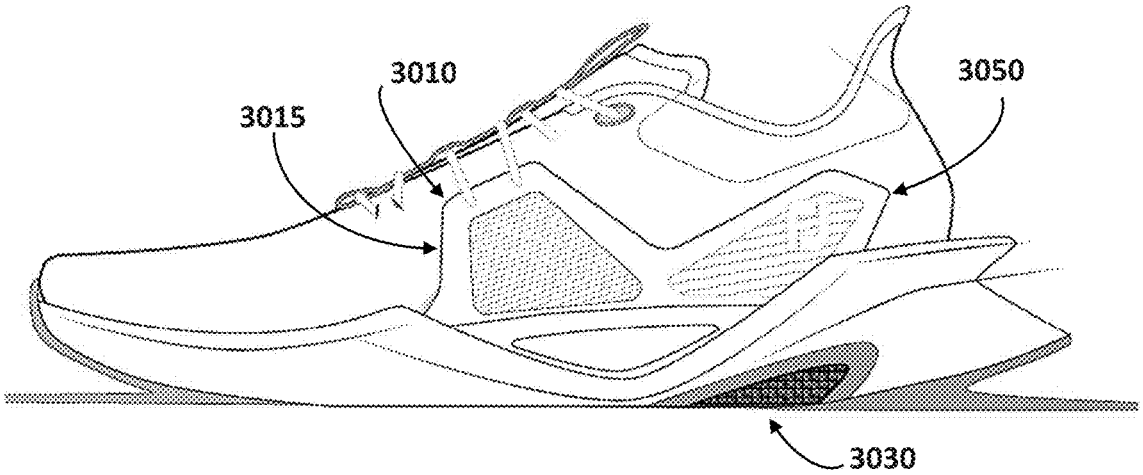
Figure 31:
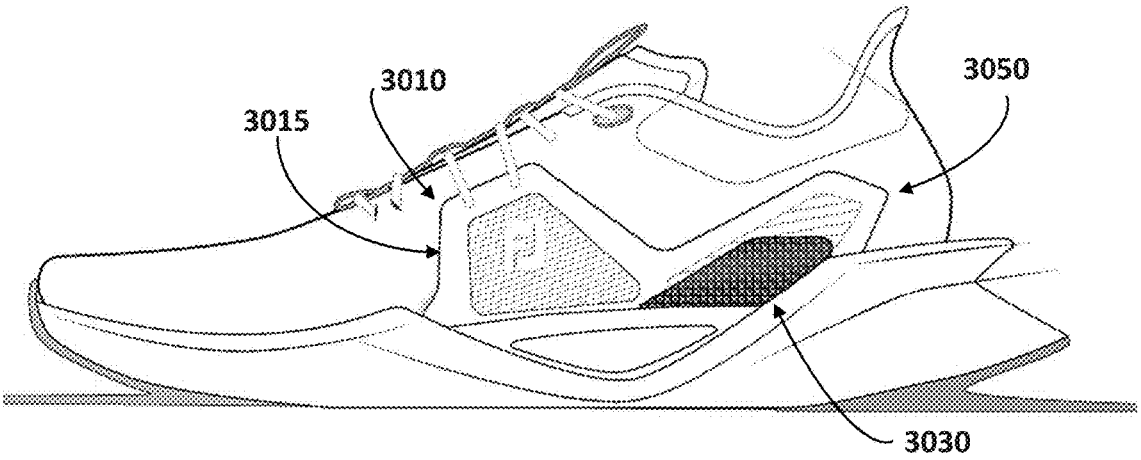

FIGS. 30 and 31 illustrate additional examples of a golf shoe comprising an external saddle 3010. In some embodiments, the external saddle 3010 may comprise a medial extension and/or a lateral extension 3015 configured to engage or interface with one or more cables or laces of the golf shoe. In some embodiments, the medial and/or lateral extension 3015 of the external saddle may be configured to provide lateral or medial support in a first region or a first set of regions of the shoe. In some embodiments, the medial or lateral extension 3015 may be attached or coupled to a shank structure of the golf shoe. In other embodiments, the medial or lateral extension 3015 may not or need not be attached or coupled to the shank structure of the golf shoe.

In some embodiments, the golf shoe may comprise a medial or lateral support 3030. In some cases, the medial or lateral support 3030 may be integrally formed with a shank structure of the golf shoe as described elsewhere herein. In other cases, the medial or lateral support 3030 may not or need not be integrally formed with a shank structure of the golf shoe.

In some cases, the medial or lateral support 3030 may be integrated with or attached to a midsole component or an outsole component of the golf shoe. In other cases, the medial or lateral support 3030 may not or need not be integrated with or attached to the midsole component or the outsole component of the golf shoe.

In some cases, the medial or lateral support 3030 may not or need not be integrated with or attached to a portion of the external saddle 3010 (e.g., as shown in FIG. 30). In other cases, the medial or lateral support may be integrated with or attached to a portion of the external saddle. In some cases, the medial or lateral support may be integrated with or attached to a medial extension and/or a lateral extension 3015 of the external saddle. In some cases, the medial or lateral support may be integrated with or attached to one or more extended portions 3050 of the external saddle as described in further detail below.

In some cases, the medial or lateral support 3030 may be integrated with or attached to one or more extended portions 3050 of the external saddle (e.g., as shown in FIG. 31). The one or more extended portions 3050 may not or need not engage or interface with any cables or laces of the golf shoe. In some cases, the one or more extended portions 3050 may be positioned and oriented along a different portion or section of the upper than the medial and/or a lateral extension 3015 of the external saddle. In some cases, the one or more extended portions 3050 may be configured to provide additional lateral and/or medial support in a second region or a second set of regions that is different than the first region or the first set of regions supported by the medial and/or lateral extension 3015 of the external saddle.

Figure 32:
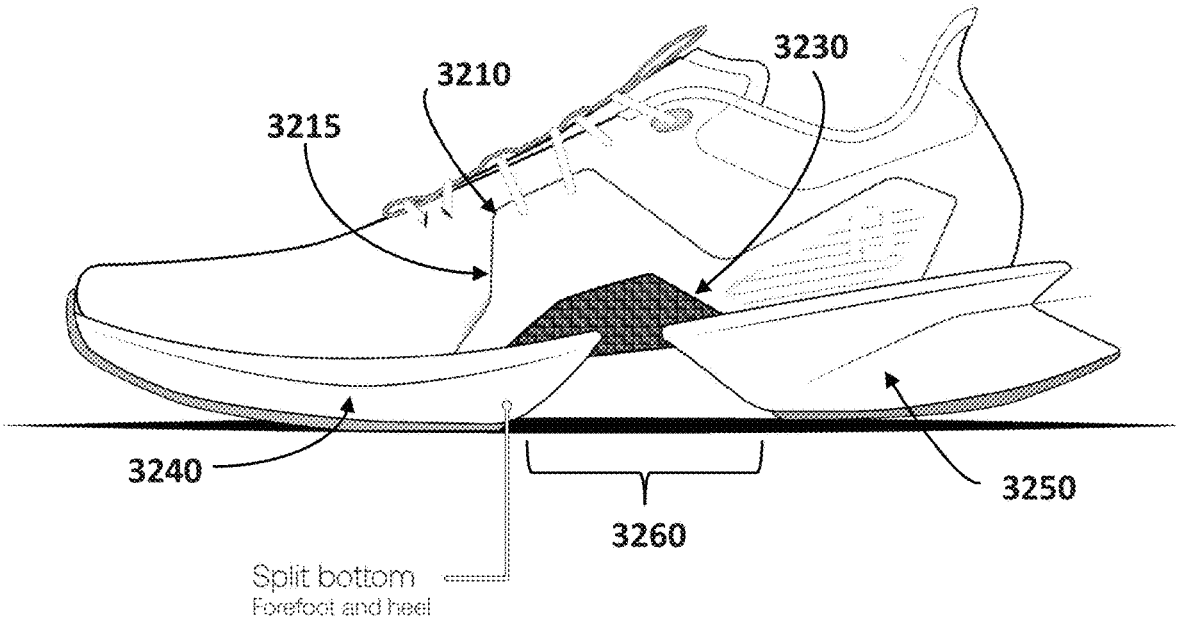

FIG. 32 illustrates another example of a golf shoe comprising an external saddle 3210. In some embodiments, the external saddle 3210 may comprise a medial extension and/or a lateral extension 3215. In some embodiments, a medial or lateral support 3230 may be integrated with the medial or lateral extension 3215 of the external saddle 3210 to support and/or stiffen a select portion of the medial or lateral extension 3215.

In some embodiments, the golf shoe may comprise a sole assembly with a split bottom construction. In some embodiments, the split bottom construction may not or need not comprise a midsole material (e.g., a midsole foam material) in the midfoot region or under the shank region of the shoe. In some cases, the split bottom construction may comprise a pedestal midsole construction with a forefoot midsole component in the forefoot region and a rearfoot midsole component in the heel region.

In some embodiments, the sole assembly may comprise a first sole portion 3240 and a second sole portion 3250 that is spaced apart from the first sole portion. In some cases, the first sole portion 3240 may extend between a forefoot region and midfoot region of the shoe. In some cases, the second sole portion 3250 may extend between the midfoot region and the rearfoot or heel region of the shoe. The first sole portion 3240 may be configured to support a load or a weight of a subject when said load or weight is directed towards the forefoot region of sole assembly, and the second sole portion 3250 may be configured to support a load or a weight of the subject when said load or weight is directed towards the rearfoot region of sole assembly. The weight or load managed by the first sole portion 3240 and the second sole portion 3250 may change or vary (e.g., spatially and/or temporally) as the subject is walking, running, crouching, or executing a golf-related action or movement.

In some embodiments, the first sole portion and the second sole portion may be spaced apart to form a gap 3260 between the first and second sole portions. In some embodiments, the gap 3260 may extend between a medial side and a lateral side of the sole assembly. In some embodiments, the gap 3260 may extend across an entire width of the sole assembly. In some embodiments, the gap 3260 may be positioned in or near a midfoot region of the shoe. In some cases, the gap 3260 between the first and second sole portions may expose or reveal a portion of the sole assembly and/or a portion of the external saddle 3210 of the shoe. In some cases, the gap 3260 between the first and second sole portions may expose or reveal a portion of the medial or lateral extension of the external saddle. In some cases, the gap 3260 between the first and second sole portions may expose or reveal a portion of the medial or lateral support 3230 of the golf shoe. In some cases, the gap 3260 between the first and second sole portions may expose or reveal a portion of the reinforcement structure of the golf shoe.

In some optional embodiments, the shoe may comprise a split bottom construction with a shank (e.g., a metal, plastic, or composite shank) or a board (e.g., an ABS board) in the shoe construction to reinforce the midsection of the midsole. In some embodiments, the shank or board may be configured to extend between the forefoot end and the rearfoot end of the split bottom construction. In some embodiments, the shank or board may be configured to prevent the midsole from collapsing under a load or a weight of a subject wearing the shoe. In some non-limiting embodiments, the split bottom construction may be configured to expose or reveal at least a portion of the shank or board supporting the sole assembly.

Internal Saddle

In some embodiments, the golf shoe may comprise an internal saddle. In some embodiments, the internal saddle may be configured to extend under an outermost layer of the upper. The outermost layer of the upper may comprise a layer of the upper that is directly exposed to an external environment. In some cases, the outermost layer of the upper may extend between the internal saddle and a shank structure or a medial or lateral support of the shoe.

Figure 33A:
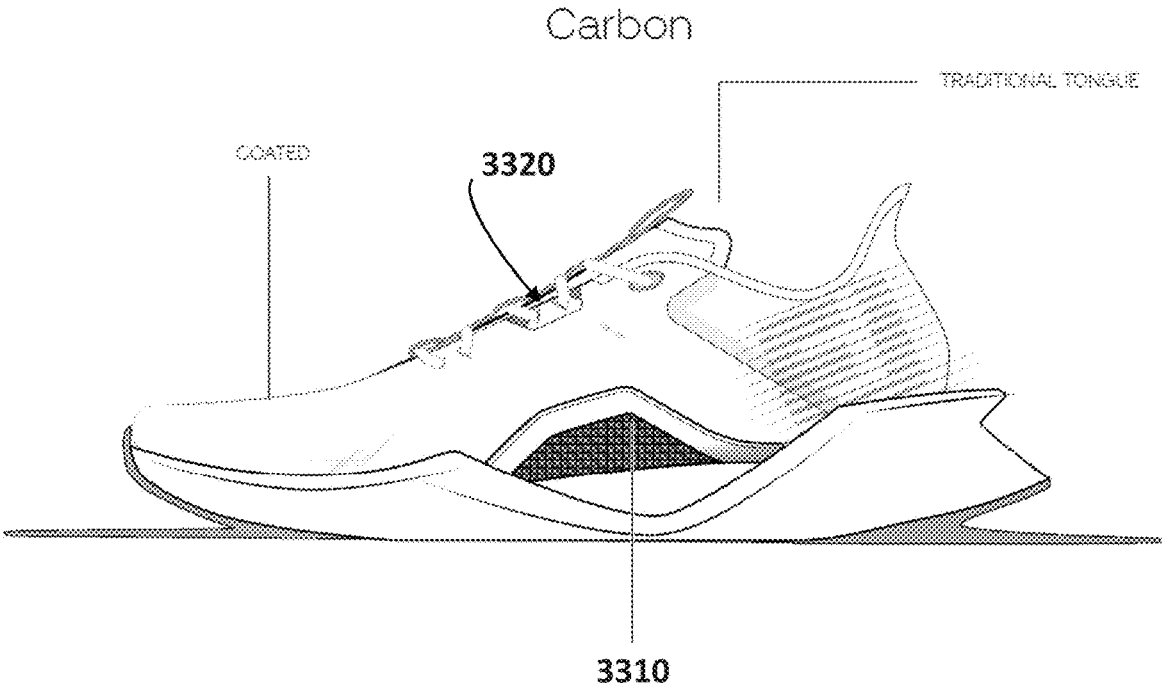
FIGS. 33A-33B and 34 schematically illustrate various examples of golf shoes incorporating an internal saddle configuration, in accordance with some embodiments.
Figure 33B:
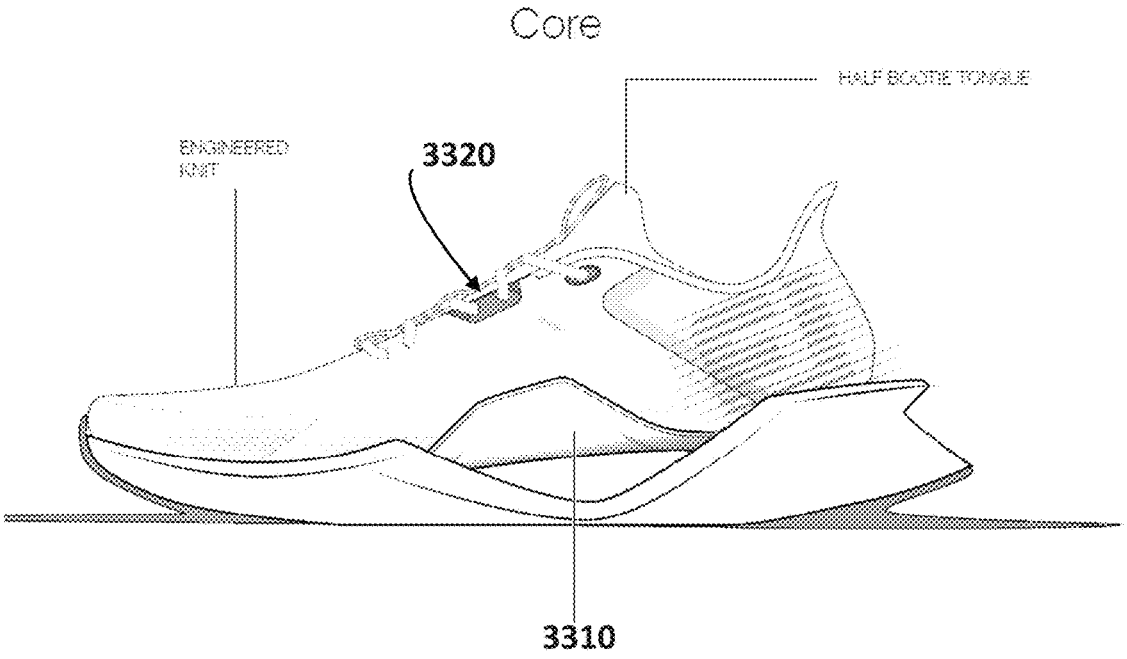

FIGS. 33A and 33B schematically illustrate examples of a golf shoe comprising a shank structure 3310 and an internal saddle 3320. In some embodiments, the shank structure 3310 may comprise a composite shank structure or a TPU shank structure as described elsewhere herein. In some embodiments, an outer layer of the upper may be positioned between the shank structure 3310 and the internal saddle 3320. In some embodiments, the outer layer of the upper may be configured to cover or conceal at least a portion of the internal saddle 3320. In some non-limiting embodiments, the outer layer may comprise a synthetic material or a coated mesh material. In other non-limiting embodiments, the upper may comprise a knit material.

In some embodiments, the golf shoe may comprise a tongue construction. In some cases, the tongue construction may comprise a traditional tongue construction. In other cases, the tongue construction may comprise a half bootie tongue construction.

Recessed Midsole

In some non-limiting embodiments, the midsole component may comprise one or more recessed regions on a medial side or a lateral side of the midsole. In some embodiments, the one or more recessed regions may be positioned underneath or below the shank structure of the golf shoe. In some embodiments, the one or more recessed regions may be configured to expose an underlying structure or internal material of the midsole component. In some embodiments, the one or more recessed regions may be configured to expose an underlying material or an internal structure or function of the shank structure of the golf shoe.

Figure 34:
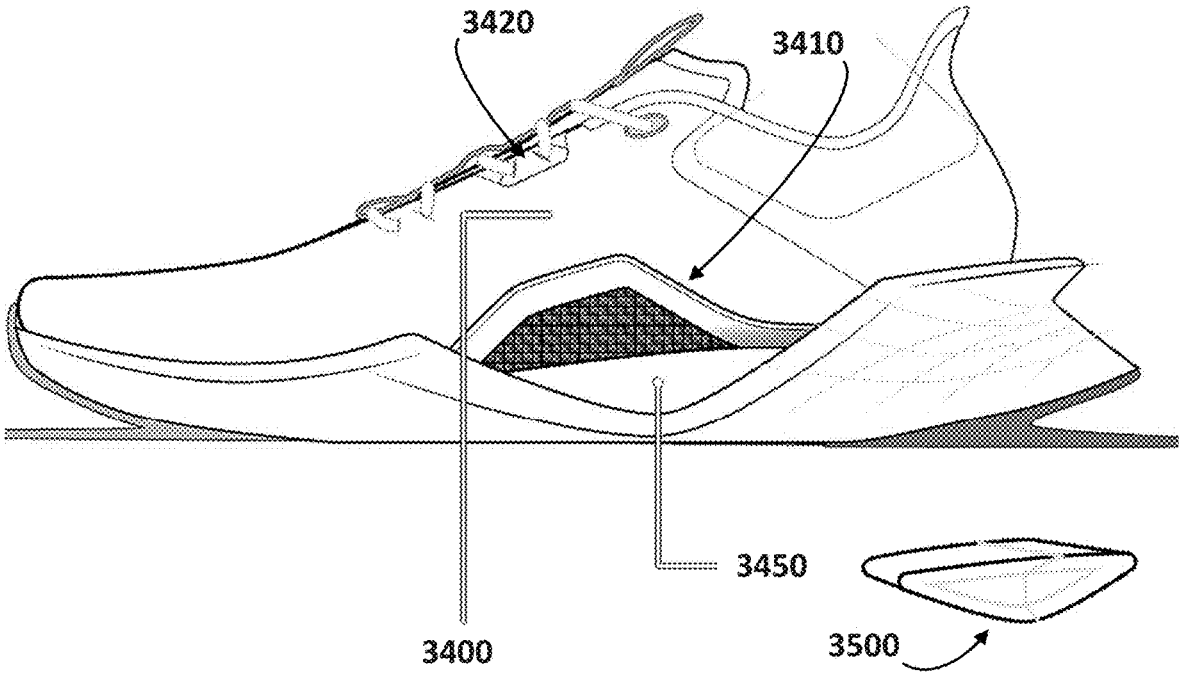

FIG. 34 schematically illustrates another example of a golf shoe 3400 according to various non-limiting embodiments of the present disclosure. In some embodiments, the golf shoe 3400 may comprise a shank structure 3410 integrated with a sole assembly of the golf shoe 3400. In some embodiments, the golf shoe 3400 may comprise an internal saddle 3420 as described elsewhere herein.

In some embodiments, the golf shoe 3400 may comprise one or more recessed regions 3450 provided in a midsole portion of the sole assembly. In some embodiments, the one or more recessed regions 3450 may include a first recessed region on one of the medial or lateral side of the sole assembly, and a second recessed region on the other of the medial or lateral side of the sole assembly.

In some embodiments, the one or more recessed regions 3450 may be configured to receive one or more modular components 3500. In some cases, the one or more modular components 3500 may be configured to enhance a cushioning or suspension effect provided by the sole assembly of the golf shoe 2400. In some cases, the one or more modular components 3500 may be configured to enhance the structural support, the stiffness, the strength, and/or the rigidity of the sole assembly or the shank structure 3410 integrated with the sole assembly.

In some embodiments, the one or more modular components 3500 may comprise a same or similar material as the midsole of the golf shoe. For example, in some non-limiting embodiments, the one or more modular components 3500 may comprise a foam material having a same or similar material composition as the midsole of the golf shoe. In other embodiments, the one or more modular components 3500 may comprise a different material or a different material composition than the midsole of the golf shoe.

Ethylene-Vinyl Acetate (EVA) Cookie

In some embodiments, the one or more modular components 3500 may comprise an ethylene-vinyl acetate (EVA) cookie. In some embodiments, the EVA cookie may be configured to control a damping response of the shoe when one or more forces or loads are exerted on the midsole component or the shank structure of the golf shoe. In some embodiments, the EVA cookie may be configured to reinforce the mid-section of the shoe and to prevent the midsole of the shoe from collapsing under load (e.g., when the subject is standing, walking, running, or performing a golf-related action or movement).

In some embodiments, the EVA cookie may be integrated with a midsole component of the golf shoe. In some embodiments, the EVA cookie may be positioned within one or more recessed regions in the midsole component of the golf shoe.

In some optional embodiments, the EVA cookie may be integrated with a midsole component and/or a shank structure of the golf shoe. In some embodiments, the EVA cookie may be positioned between a body portion and a spring portion of the shank structure. In some embodiments, the EVA cookie may be positioned within an opening formed between the body portion and the spring portion of the shank structure.

In some embodiments, the EVA cookie may comprise an EVA component or structure that is configured to interface with the midsole component and/or the shank structure of the golf shoe. In some embodiments, the EVA component or structure may be sized and/or shaped to fit inside or within one or more recessed regions in the midsole component of the golf shoe. In some embodiments, the EVA component or structure may be sized and/or shaped to fit inside or within one or more windows or openings formed by the shank structures disclosed herein.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right", "left", "center", "middle", "proximal", "distal", "anterior", "posterior", "forefoot", "mid-foot", and "rear-foot", and the like are arbitrary terms used to refer to one position of an element based on one perspective and should not be construed as limiting the scope of the technology.

All patents, publications, test procedures, and other references cited herein, including priority documents, are fully incorporated by reference to the extent such disclosure is not inconsistent with this technology and for all jurisdictions in which such incorporation is permitted. It is understood that the shoe materials, designs, constructions, and structures; shoe components; and shoe assemblies and sub-assemblies described and illustrated herein represent only some embodiments of the technology. It is appreciated by those skilled in the art that various changes and additions can be made to such products and materials without departing from the spirit and scope of this invention. It is intended that all such embodiments be covered by the appended claims.

What is claimed is:

1. A golf shoe, comprising:

an upper; and a sole assembly connected to the upper, the sole assembly comprising a midsole and an outsole, wherein the midsole comprises (i) a first midsole component extending from a heel region of the sole assembly to a midfoot region of the sole assembly and (ii) a second midsole component extending from a forefoot region of the sole assembly to the midfoot region of the sole assembly, wherein the first midsole component and the second midsole component overlap each other in the midfoot region of the sole assembly, wherein the first midsole component and the second midsole component have a variable thickness that tapers towards the midfoot region of the sole assembly; and a reinforcement structure comprising (i) a lateral side wing that extends upward from a lateral side of the sole assembly and crosses over a lateral side of the upper, (ii) a medial side wing that extends upward from a medial side of the sole assembly and crosses over a medial side of the upper, and (iii) a bridge section that extends between the lateral side wing and the medial side wing, wherein the first midsole component has a top surface that is attached or coupled to a bottom surface of the reinforcement structure, and wherein the second midsole component has a bottom surface that is attached or coupled to a top surface of the reinforcement structure.

2. The golf shoe of claim 1, wherein the first midsole component has a first thickness at the heel region and a second thickness at the midfoot region, wherein the second thickness is less than the first thickness.

3. The golf shoe of claim 1, wherein the second midsole component has a first thickness at the forefoot region and a second thickness at the midfoot region, wherein the second thickness is less than the first thickness.

4. The golf shoe of claim 1, wherein the first midsole component extends to a first location in the midfoot region, and wherein the second midsole component extends to a second location in the midfoot region, wherein the first location and the second location are offset relative to each other.

5. The golf shoe of claim 1, wherein the first midsole component comprises a first end disposed in the heel region and a second end disposed in the midfoot region, and wherein the second midsole component comprises a first end disposed in the forefoot region and a second end disposed in the midfoot region.

6. The golf shoe of claim 5, wherein the second end of the first midsole component is positioned closer to the forefoot region of the sole assembly than the second end of the second midsole component.

7. The golf shoe of claim 5, wherein the second end of the second midsole component is positioned closer to the heel region of the sole assembly than the second end of the first midsole component.

8. The golf shoe of claim 1, wherein a midfoot portion of the reinforcement structure is positioned between a top surface of the first midsole component and a bottom surface of the second midsole component.

9. The golf shoe of claim 1, wherein the reinforcement structure comprises a symmetric wing configuration.

10. The golf shoe of claim 1, wherein the reinforcement structure comprises an asymmetric wing configuration.

11. The golf shoe of claim 1, wherein the lateral side wing and the medial side wing include a curved upper edge and a curved lower edge forming a curvilinear distal end of the medial or lateral side wing.

12. The golf shoe of claim 1, wherein the lateral side wing or the medial side wing extends forward to the forefoot region of the sole assembly.

13. The golf shoe of claim 1, wherein the lateral side wing or the medial side wing extends rearward to the heel region of the sole assembly.

14. The golf shoe of claim 1, wherein the lateral side wing extends forward to the forefoot region of the sole assembly, and wherein the medial side wing extends rearward to the heel region of the sole assembly.

15. The golf shoe of claim 1, wherein an upper surface portion of the first midsole component is positioned below a lower surface portion of the second midsole component in the midfoot region of the sole assembly, and wherein the lower surface portion of the second midsole component is positioned above the upper surface portion of the first midsole component in the midfoot region of the sole assembly.

16. The golf shoe of claim 1, wherein the first midsole component is positioned entirely below a lower surface of the bridge section and the second midsole component is positioned entirely above an upper surface of the bridge section.

17. The golf shoe of claim 1, wherein the first midsole component is positioned between the outsole and a bottom surface of the reinforcement structure.

18. The golf shoe of claim 1, wherein a rearfoot end of the reinforcement structure is positioned between an upper surface of the first midsole component and a bottom surface of an insole component of the golf shoe.

19. The golf shoe of claim 1, wherein the bridge section comprises (i) a rear portion adjacent to the heel region, (ii) a front portion adjacent to the forefoot region, and (iii) a middle portion disposed between the front portion and the rear portion, wherein the middle portion is positioned closer to a ground surface under the golf shoe than the front portion and the rear portion.

* * * * *